US011118862B1

(12) United States Patent
Troemel

(10) Patent No.: US 11,118,862 B1
(45) Date of Patent: Sep. 14, 2021

(54) ELECTROMECHANICAL SEMI-AUTOMATIC, SCALABLE, EXPANDABLE, WEAPON-MOUNTED OR STANDALONE LAUNCHER AND ELECTROMECHANICAL, SCALABLE, EXPANDABLE, STACKABLE MAGAZINE—GL300 AND TURTLE

(71) Applicant: Kevin Thomas Troemel, Tifton, GA (US)

(72) Inventor: Kevin Thomas Troemel, Tifton, GA (US)

( * ) Notice: Subject to any disclaimer, the term of this patent is extended or adjusted under 35 U.S.C. 154(b) by 95 days.

(21) Appl. No.: 16/295,805

(22) Filed: Mar. 7, 2019

(51) Int. Cl.
*F41C 27/06* (2006.01)
*F41A 9/38* (2006.01)

(52) U.S. Cl.
CPC ..... *F41C 27/06* (2013.01); *F41A 9/38* (2013.01)

(58) Field of Classification Search
CPC ..... F41C 27/06; F41A 9/38
USPC ..... 42/105
See application file for complete search history.

(56) References Cited

U.S. PATENT DOCUMENTS 3,981,225 A * 9/1976 Smith ..... F41C 27/06 89/1.818
4,077,384 A * 3/1978 Montefeltro R. ..... F41J 9/16 124/1
4,307,529 A * 12/1981 White ..... A01K 15/02 340/12.5
H87 H * 7/1986 Reynolds ..... 42/25
5,239,911 A * 8/1993 Ostor ..... F41A 9/12 42/105
5,628,137 A * 5/1997 Cortese ..... F41C 27/06 42/105
6,276,353 B1 * 8/2001 Briggs ..... F41B 11/57 124/71
6,591,535 B2 * 7/2003 Reynolds ..... F41A 3/38 42/105
10,352,638 B1 * 7/2019 Day ..... F41A 9/38
2002/0082125 A1 * 6/2002 Markin ..... A63B 69/406 473/451
2003/0089018 A1 * 5/2003 Reynolds ..... F41A 9/19 42/105
2004/0025393 A1 * 2/2004 Reynolds ..... F41A 9/19 42/17
2006/0196490 A1 * 9/2006 Davidson ..... A63B 69/0002 124/78
2010/0154766 A1 * 6/2010 Skilling ..... F41A 19/03 124/71

* cited by examiner

*Primary Examiner* — Joshua E Freeman

(57) ABSTRACT

An improved, projectile launching system that carries the bulk of its weight and ammunition in a mechanical backpack called Turtle. Turtle can be scaled up to carry much larger rounds like torpedoes or artillery shells, for submarines and artillery. The GUN can be scaled up as well.

1 Claim, 84 Drawing Sheets

PARTS LIST

| ITEM | QTY | PART NUMBER |
|---|---|---|
| 1 | 1 | Gate_Assembly |
| 2 | 1 | Gate Gear Assembly |
| 3 | 1 | Battery |
| 4 | 1 | Powered_Barrel_Assembly |
| 5 | 1 | Barrel_Assembly_mm |
| 6 | 1 | Barrel_Sheath |
| 7 | 1 | Ejector Assembly |
| 9 | 1 | Frame Assembly |
| 10 | 1 | Hose_Adapter |

PARTS LIST

| ITEM | QTY | PART NUMBER |
|---|---|---|
| 1 | 1 | Gate |
| 3 | 1 | Gate_Solenoid |
| 4 | 1 | Gate_Plate |
| 6 | 1 | Round_Casing_Assembly |
| 8 | 3 | Gate_Harness |

| PARTS LIST | | |
|---|---|---|
| ITEM | QTY | PART NUMBER |
| 1 | 1 | Gear_Rod |
| 2 | 2 | Gate_Gear |
| 3 | 2 | Bearing_Cap |
| 4 | 2 | Ball_Bearing |
| 5 | 1 | Trigger_Wheel |
| 6 | 1 | Electric_Motor_Assembly |
| 7 | 1 | Band_One |
| 8 | 1 | Front_Motor_Joist |

PARTS LIST

| ITEM | QTY | PART NUMBER |
|---|---|---|
| 1 | 1 | Electric_Motor |
| 2 | 1 | Trigger_Wheel |
| 3 | 1 | Trigger_Wheel_Rod |

| PARTS LIST | | |
|---|---|---|
| ITEM | QTY | PART NUMBER |
| 1 | 1 | Front_Motor_Joist |
| 2 | 1 | Front_Motor_Joist_Hinge |
| 3 | 1 | Rear_Motor_Joist_Rod |

PARTS LIST

| ITEM | QTY | PART NUMBER |
|---|---|---|
| 1 | 1 | Gear_Rod_Two |
| 2 | 2 | Trigger_Wheel |
| 3 | 2 | Bearing_Cap |
| 4 | 1 | Barrel_Gear |
| 5 | 2 | Ball_Bearing |
| 6 | 2 | Band_Two |
| 7 | 2 | Electric_Motor_Assembly |
| 8 | 1 | Front_Motor_Joist_Left |
| 9 | 1 | Front_Motor_Joist_Right |

| PARTS LIST | | |
|---|---|---|
| ITEM | QTY | PART NUMBER |
| 1 | 1 | Front_Motor_Joist |
| 2 | 1 | Front_Motor_Joist_Rod |
| 3 | 1 | Front_Motor_Joist_Hinge_Left |

| PARTS LIST | | |
|---|---|---|
| ITEM | QTY | PART NUMBER |
| 1 | 1 | Front_Motor_Joist |
| 2 | 1 | Front_Motor_Joist_Rod |
| 3 | 1 | Front_Motor_Joist_Hinge_Right |

ASSEMBLY VIEW

| PARTS LIST | | |
|---|---|---|
| ITEM | QTY | PART NUMBER |
| 1 | 1 | Barrel_mm |
| 3 | 20 | Wheel_Assembly |

EXPLODED VIEW

ASSEMBLY VIEW

EXPLODED VIEW

| PARTS LIST | | |
|---|---|---|
| ITEM | QTY | PART NUMBER |
| 1 | 1 | Wheel_2 |
| 2 | 1 | Wheel_1 |

| PARTS LIST | | |
|---|---|---|
| ITEM | QTY | PART NUMBER |
| 1 | 2 | Ejector_Holder |
| 4 | 1 | Ejector |
| 6 | 1 | Spring |

| PARTS LIST | | |
|---|---|---|
| ITEM | QTY | PART NUMBER |
| 1 | 1 | Frame |
| 2 | 2 | Frame_Wire |
| 3 | 1 | Frame_Hatch |

ASSEMBLY VIEW

| PARTS LIST | | |
|---|---|---|
| ITEM | QTY | PART NUMBER |
| 1 | 1 | Turtle_Shell_2 |
| 2 | 12 | Roller_Assembly |
| 3 | 2 | Motor_Assembly |
| 4 | 2 | Battery |
| 5 | 1 | Air_Tank |
| 6 | 2 | CPU |
| 7 | 1 | Cover |
| 8 | 1 | Regulator |
| 9 | 1 | Tube_Assembly |
| 10 | 1 | Ammo_Belt |
| 16 | 1 | Door_Assembly |
| 18 | 1 | Magazine_Magnets |
| 19 | 6 | Latch |

EXPLODED VIEW

ASSEMBLY VIEW

EXPLODED VIEW

PARTS LIST

| ITEM | QTY | PART NUMBER |
|---|---|---|
| 1 | 1 | Roller_Rod |
| 2 | 1 | Roller |

PARTS LIST

| ITEM | QTY | PART NUMBER |
|---|---|---|
| 1 | 2 | Belt_Motor |
| 2 | 2 | Belt_Motor_Gear |

ASSEMBLED VIEW

EXPLODED VIEW

ASSEMBLY VIEW

PARTS LIST

| ITEM | QTY | PART NUMBER |
|---|---|---|
| 1 | 3 | Tube_Head |
| 2 | 1 | Tube |
| 3 | 2 | Funnel |
| 4 | 2 | Valve |

EXPLODED VIEW

ASSEMBLY VIEW

EXPLODED VIEW

PARTS LIST

| ITEM | QTY | PART NUMBER |
|---|---|---|
| 1 | 1 | Belt |
| 2 | 20 | Round_Casing_Assembly |
| 3 | 2 | Chain |

ASSEMBLY VIEW

| PARTS LIST | | |
|---|---|---|
| ITEM | QTY | PART NUMBER |
| 1 | 1 | Round_Casing |
| 2 | 12 | Round_Propper_Assembly |
| 3 | 12 | Round_Casing_Rod |

EXPLODED VIEW

ASSEMBLED VIEW

| PARTS LIST | | |
|---|---|---|
| ITEM | QTY | PART NUMBER |
| 1 | 1 | Round_Propper |
| 2 | 1 | Rubber_Band |
| 4 | 1 | Round_Propper_Stopper |

EXPLODED VIEW

ASSEMBLY VIEW

PARTS LIST

| ITEM | QTY | PART NUMBER |
|---|---|---|
| 1 | 1 | Door |
| 2 | 1 | Door_Magnets |

EXPLODED VIEW

ELECTROMECHANICAL SEMI-AUTOMATIC, SCALABLE, EXPANDABLE, WEAPON-MOUNTED OR STANDALONE LAUNCHER AND ELECTROMECHANICAL, SCALABLE, EXPANDABLE, STACKABLE MAGAZINE—GL300 AND TURTLE

CROSS-REFERENCES TO RELATED APPLICATIONS

There are currently (to my knowledge) no semi-automatic grenade launchers in existence

STATEMENT REGARDING FEDERALLY SPONSORED RESEARCH OR DEVELOPMENT

The GL300 and Turtle have not been given any funding from anyone except for the inventor.

BACKGROUND OF THE INVENTION

Field of The Invention US Classification 1/1. This is a military grenade-launching weapon. The GL300 fires grenade rounds, and the Turtle serves as a novel type of magazine.

DESCRIPTION OF THE RELATED ART

Whereas the M203 Grenade Launcher is slow to load, and the rounds are easily fumbled under extreme pressure (found in combat situations), this grenade launcher and magazine (also can be used on a larger scale to load tanks, submarines, and airplanes with certain accessories (i.e. hydraulic press to push the torpedo or shell into the breach), the GL300 and Turtle loads itself.

Whereas the Mk-19 Automatic Grenade Launcher weighs a staggering 80 pounds unloaded and without tripod, the GL300 weighs less.

Where as the Milkor MGL only holds 6 rounds, the GL12300 holds 20 plus. Some other grenade launchers are designed to hold many rounds within the weapon, but they are not practical because of their weight.

The police can use GL300 and Turtle for crowd control.

BRIEF SUMMARY OF THE INVENTION

A GL300 is the weapon component, and a Turtle is the round holding component. These two components when attached to each other by the hose component can do more damage in less time than any other hand-held weapon that I know of. The overall combination of these three components is made to neutralize enemy forces especially when outnumbered. The enemy cannot hide. With certain electrical and electronic parts (i.e. an electronic trigger, software, electrical wires, a personal drone for targeting, a helmet mounted sight, a wireless modem) the invention can hit anything within 700 m and cyclic tire of over 20 rounds per minute. The Turtle can be stacked onto another Turtle and expanded to allow' for more rounds to be carried. The GL300 weighs 10 pounds, and the Turtle weighs about 30 pounds (unloaded).

BRIEF DESCRIPTION OF THE DRAWINGS

FIG. 120 illustrates an isometric view of the hose tube.

FIG. 121 illustrates an isometric view of the magazine side adapter.

FIG. 122 illustrates an isometric view of the weapon side adapter.

DETAILED DESCRIPTION

Figure 1:
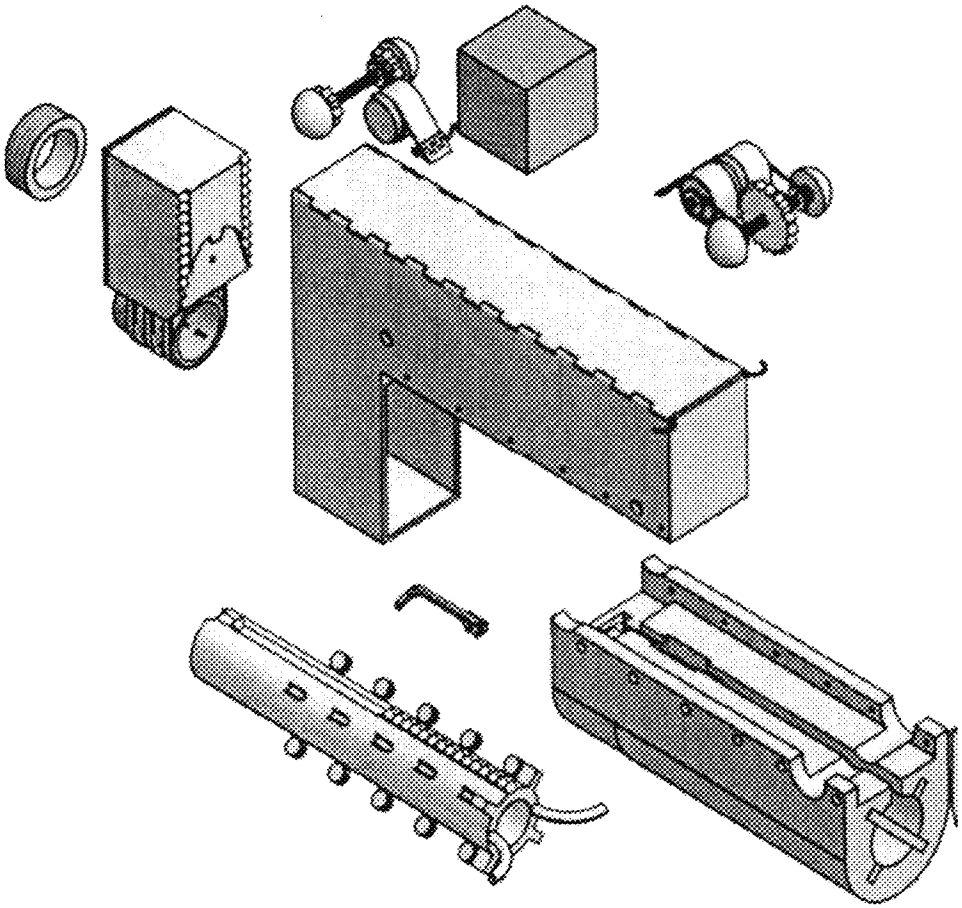
FIG. 1 illustrates an exploded view of a fully assembled weapon system.
Figure 2:
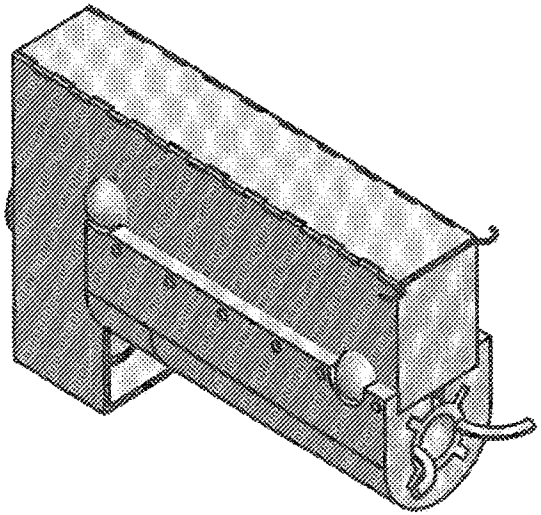
FIG. 2 illustrates a 2*x* enlarged isometric view of the GL300 when fully assembled.
Figure 4:
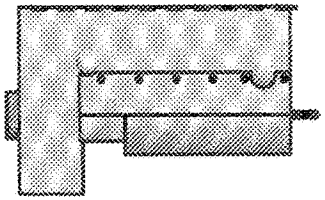
FIG. 4 illustrates a side view of the GL300.
Figure 3:
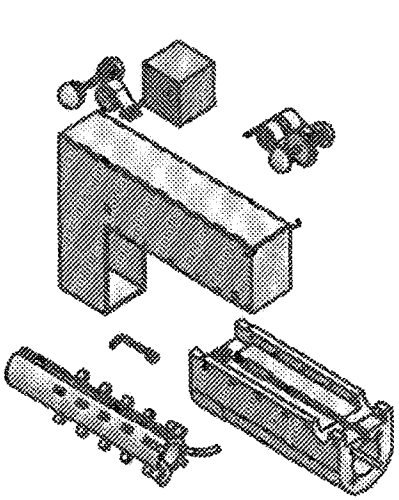
FIG. 3 illustrates an exploded view of the GL300 showing all assemblies fully assembled.
Figure 3:
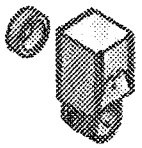
Figure 5:
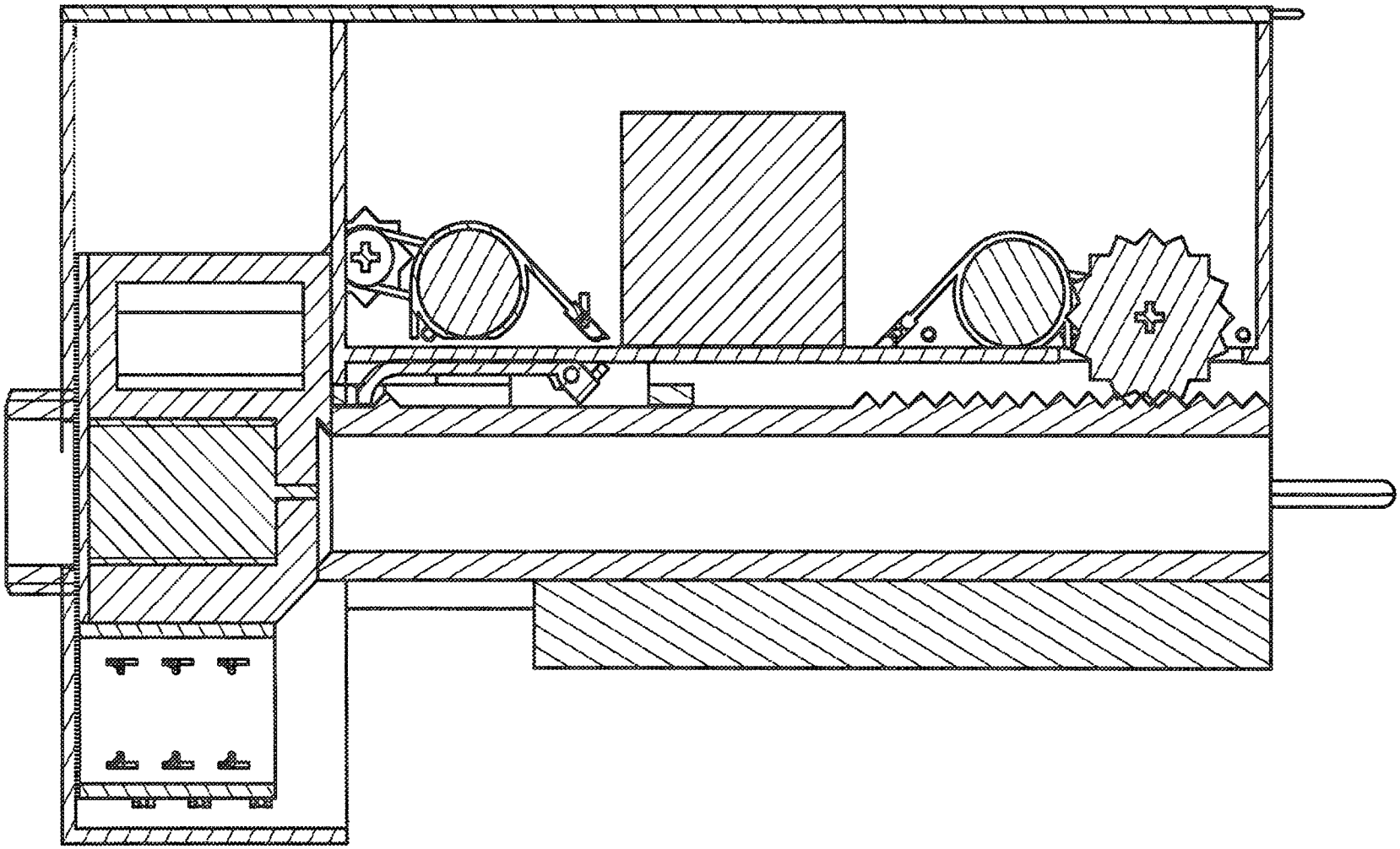
FIG. 5 illustrates a section view of the GL300.
Figure 7:
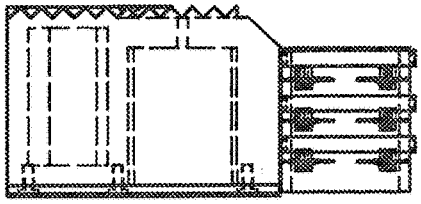
FIG. 7 illustrates a right side view of the gate assembly.
Figure 68:
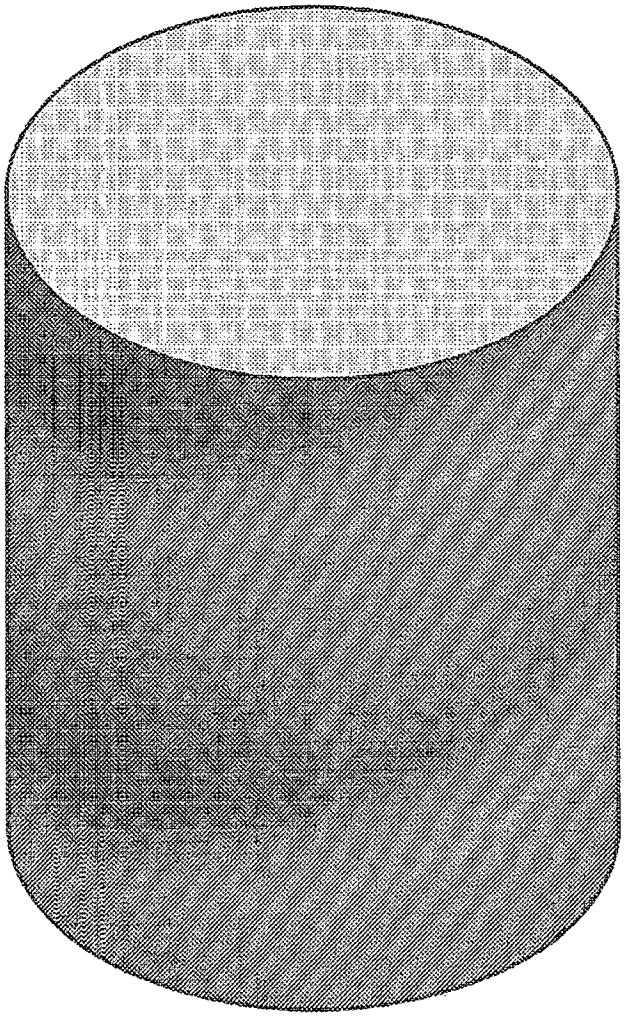
FIG. 68 illustrates an isometric view of a spring.

FIG. 1-68 are drawn to a first embodiment GL300 Grenade Launcher; FIG. 69-118 are drawn to a second embodiment Turtle; and FIG. 119-122 are drawn to a third embodiment hose.

First Embodiment Assembly

Figure 6:
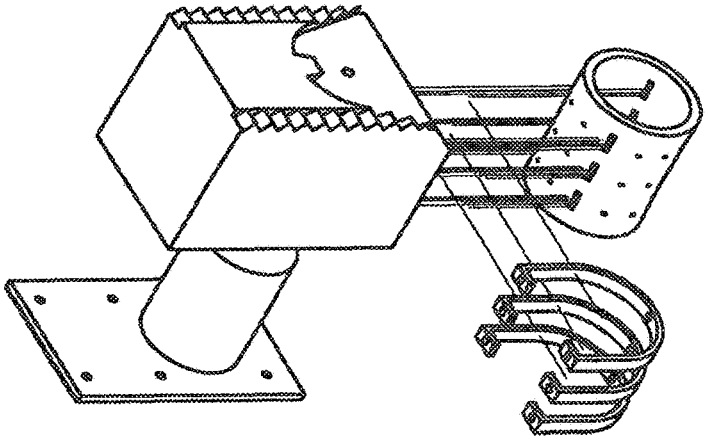
FIG. 6 illustrates an exploded view of the gate assembly.
Figure 9:
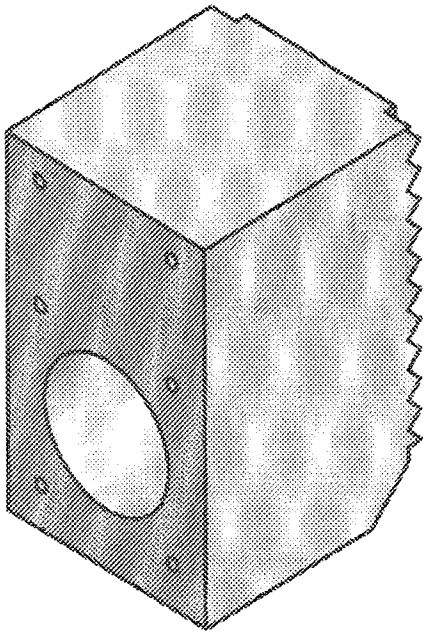
FIG. 9 illustrates a mostly rear isometric view of the gate.
Figure 8:
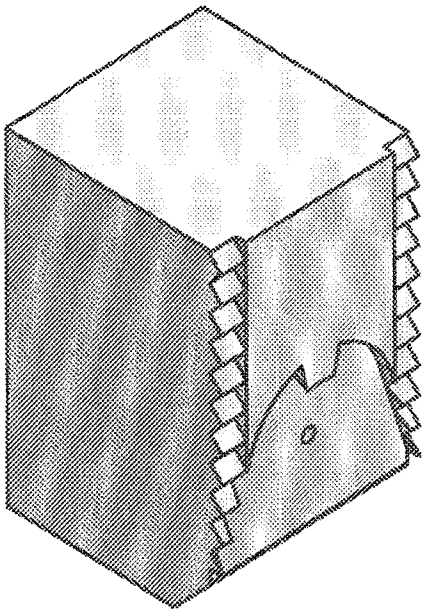
FIG. 8 illustrates a mostly front isometric view of the gate.
Figure 10:
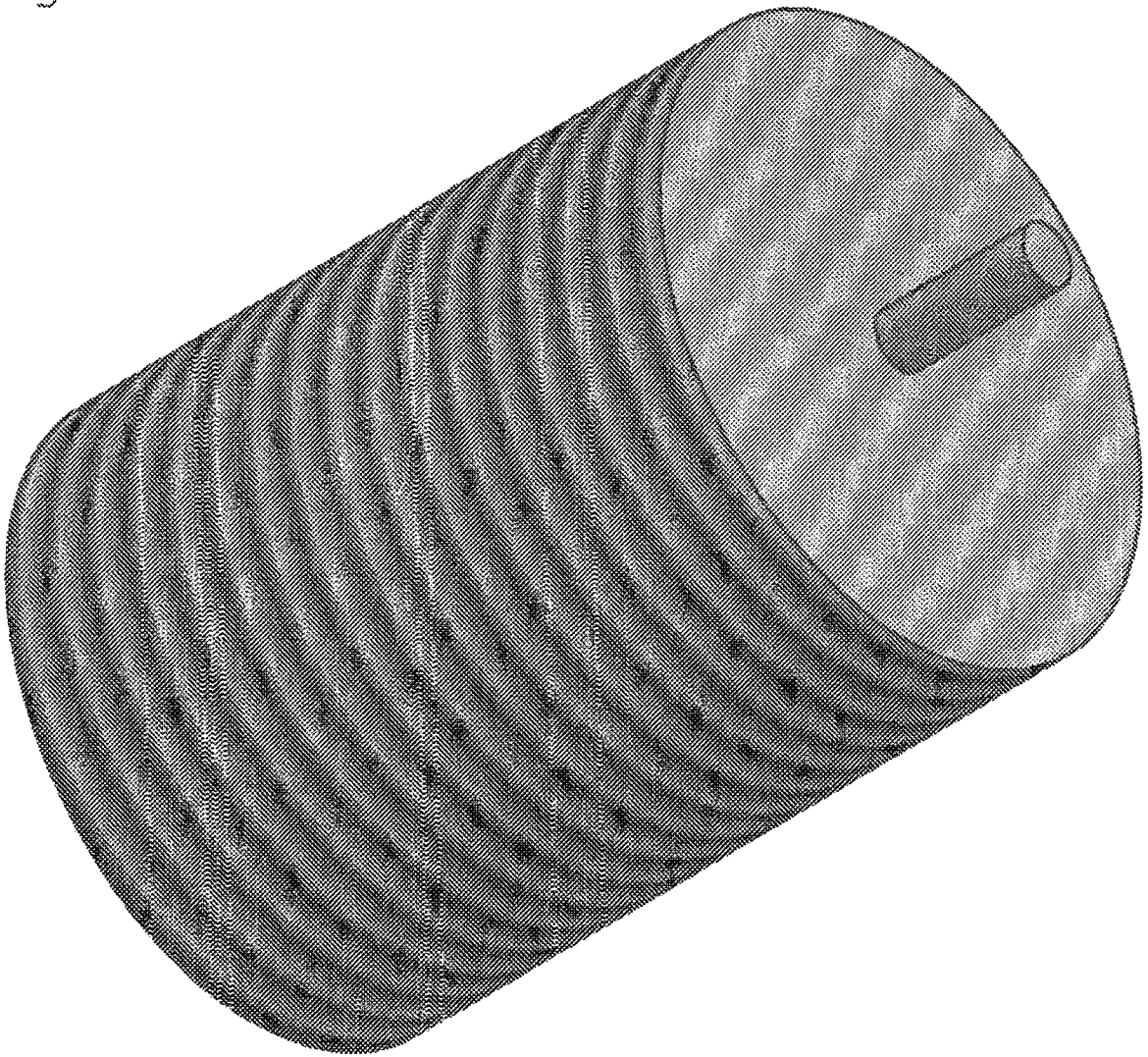
FIG. 10 illustrates an isometric view of the gate solenoid.
Figure 13:
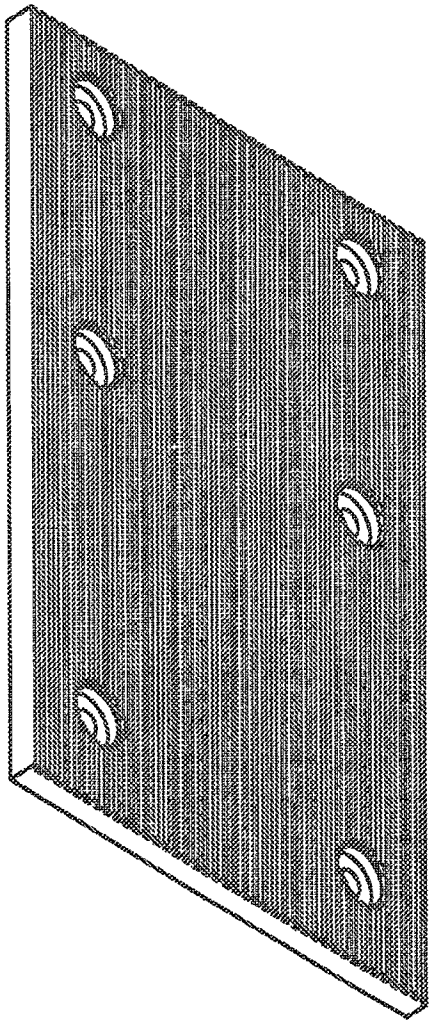
FIG. 13 illustrates an isometric view of the gate plate.
Figure 11:
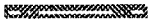
FIG. 11 illustrates a top view of the gate plate with many grooves on one side.
Figure 12:
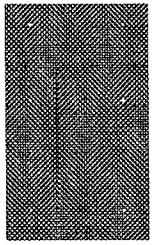
FIG. 12 illustrates a rear view of the gate plate.
Figure 16:
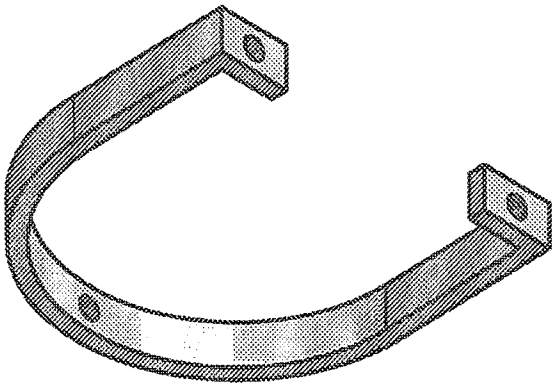
FIG. 16 illustrates an isometric view of gate harness.
Figure 14:
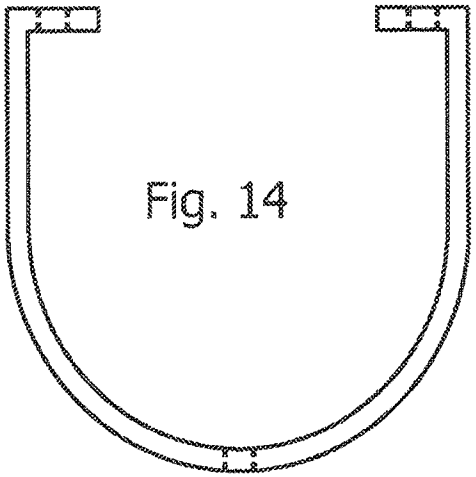
FIG. 14 illustrates a front view of the gate harness.
Figure 15:
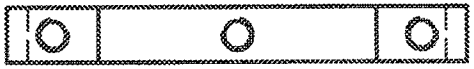
FIG. 15 illustrates a bottom of view of the gate harness.
Figure 17:
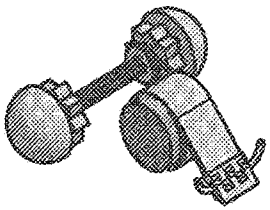
FIG. 17 illustrates an assembled, isometric view of the gate gear assembly.
Figure 18:
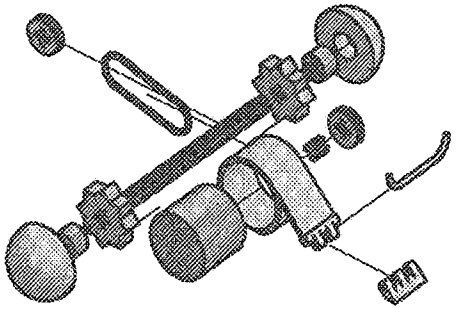
FIG. 18 illustrates an exploded isometric view of the gate gear assembly.
Figure 19:
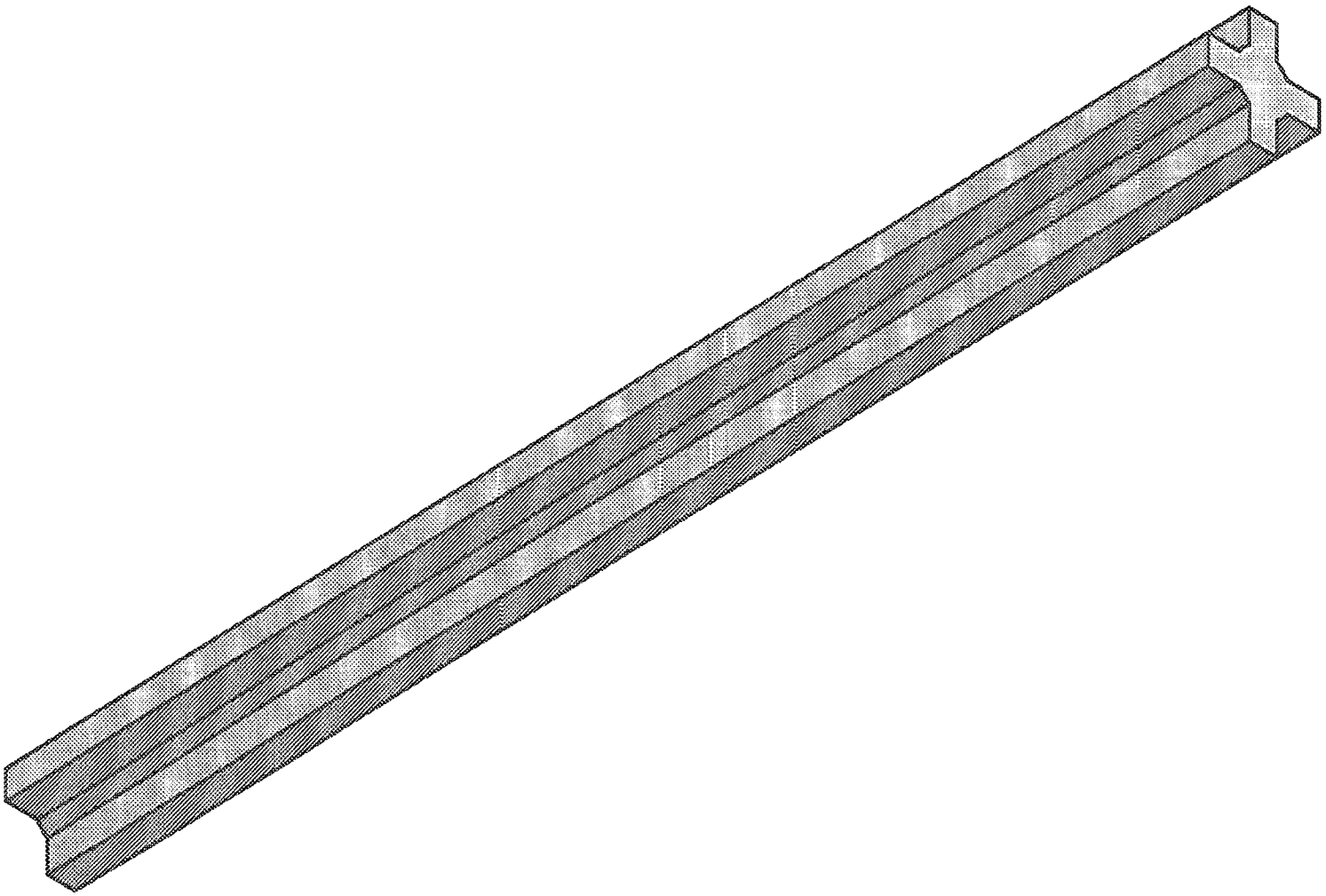
FIG. 19 illustrates an isometric view of the gear rod.
Figure 20:
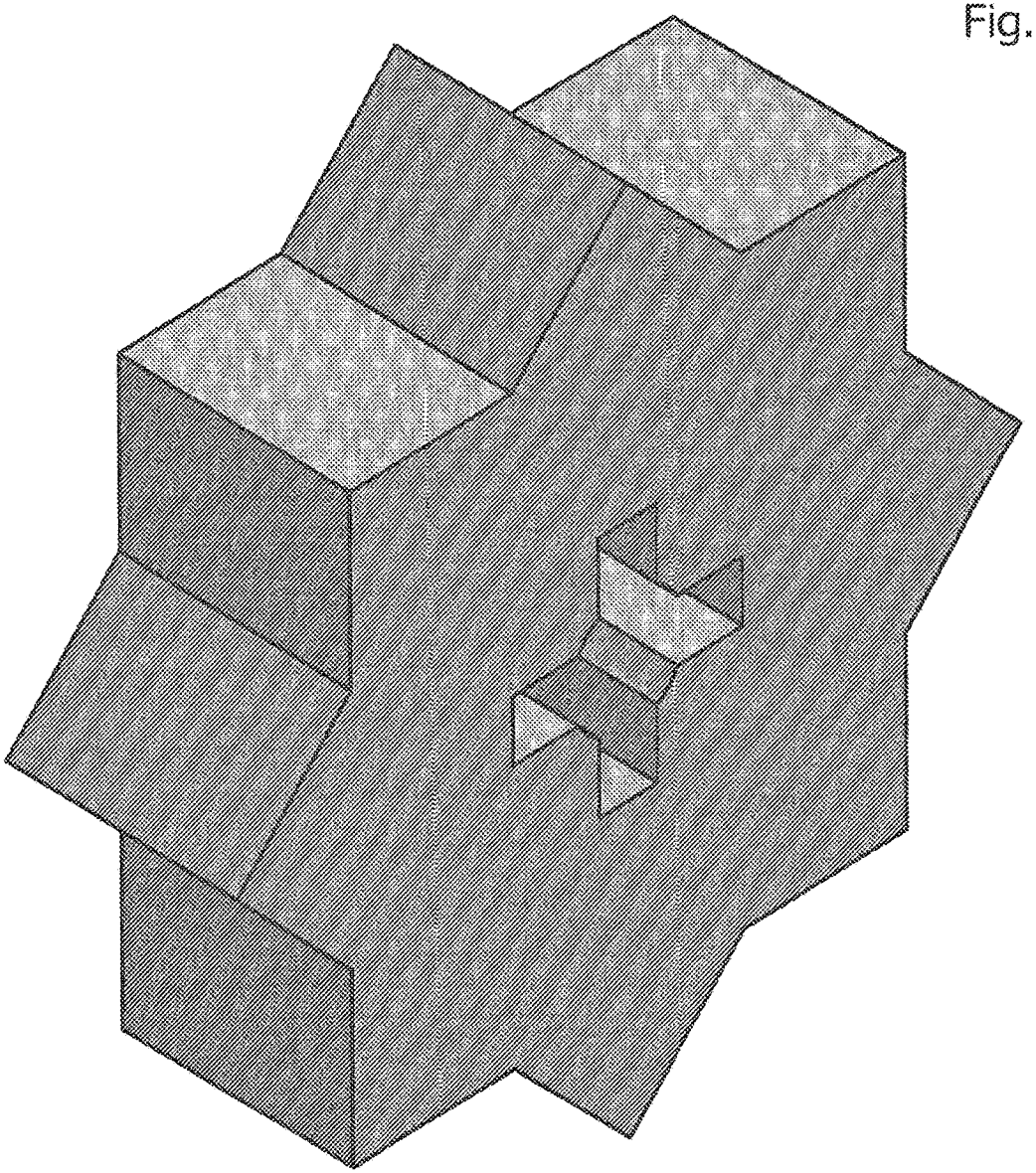
FIG. 20 illustrates an isometric view of the gate gear.
Figure 21:
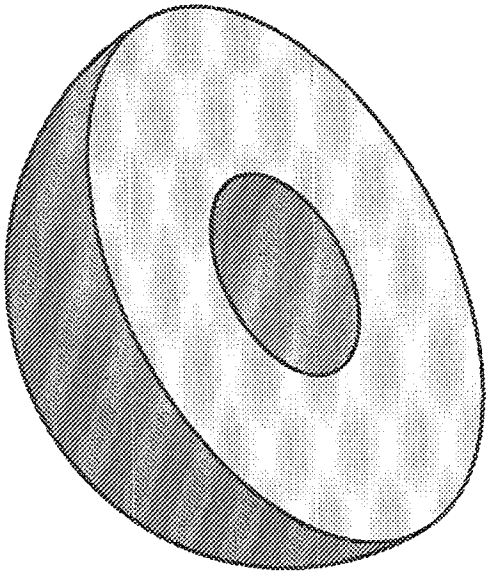
FIG. 21 illustrates an isometric view of the bearing cap.
Figure 24:
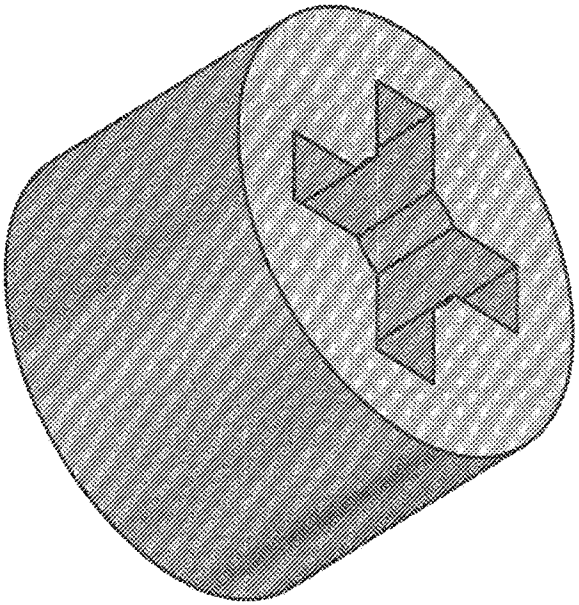
FIG. 24 illustrates an isometric view of the ball bearing.
Figure 35:
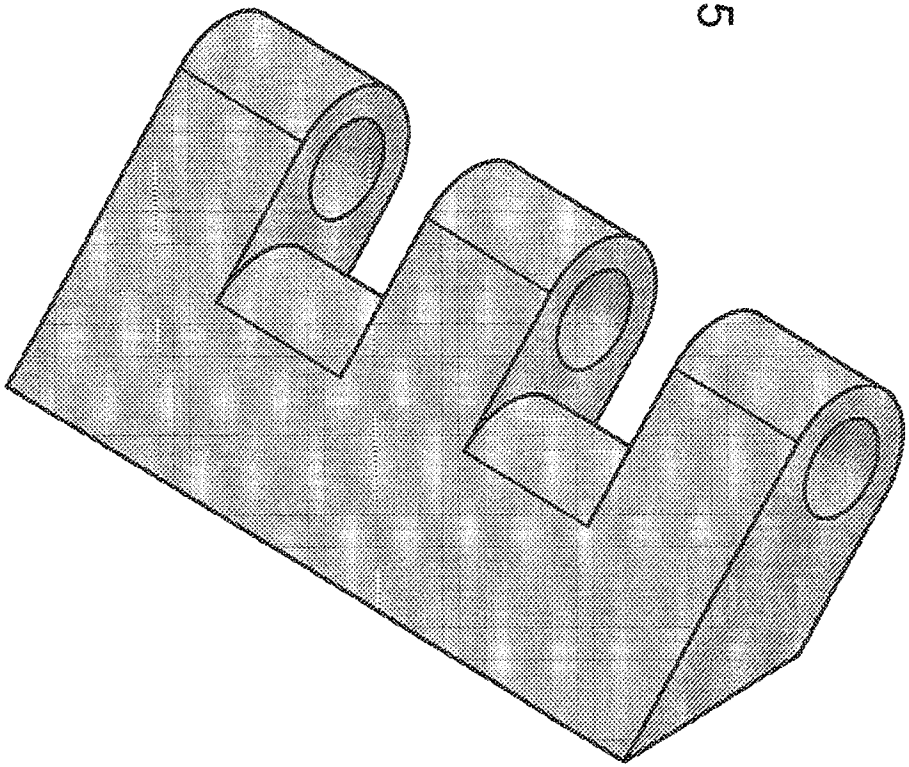
FIG. 35 illustrates an isometric view of the front motor joist hinge.
Figure 36:
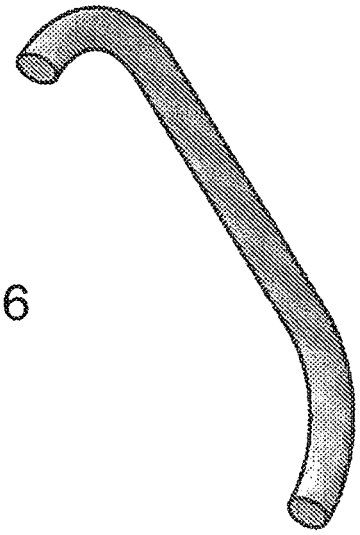
FIG. 36 illustrates an isometric view of rear motor joist rod.
Figure 37:
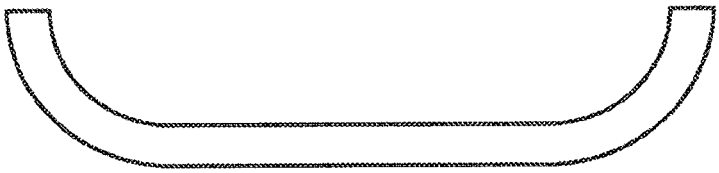
FIG. 37 illustrates a side view of a rear motor joist rod.
Figure 62:
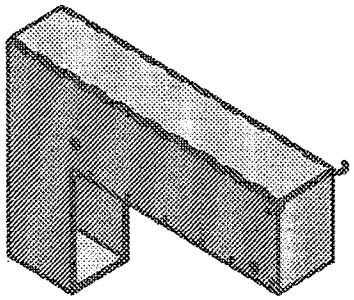
FIG. 62 illustrates an assembled, isometric view of the frame assembly.
Figure 63:
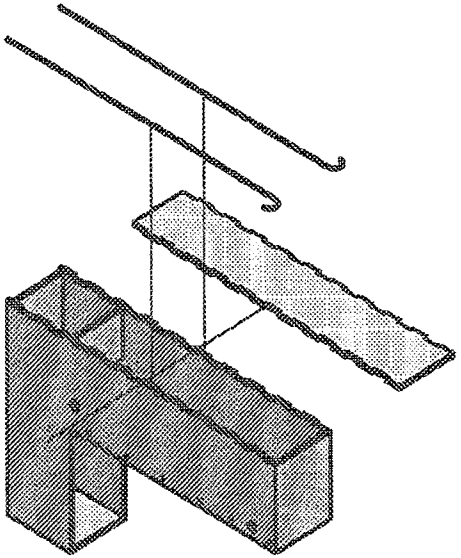
FIG. 63 illustrates an exploded isometric view of the frame assembly.
Figure 104:
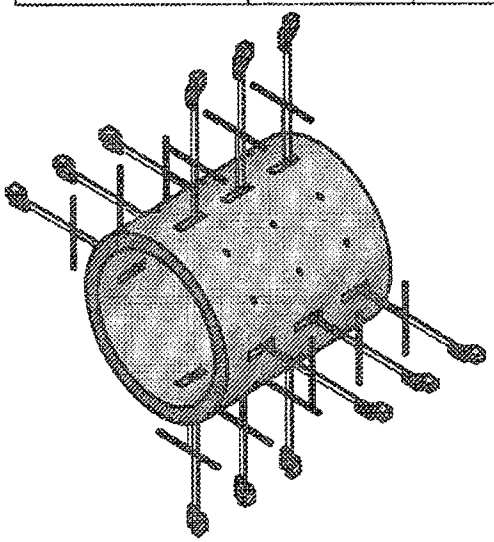
FIG. 104 illustrates an exploded isometric view of the round casing assembly.

Gate Assembly FIG. 6 goes inside a Frame Assembly FIG. 62. FIG. 6 includes a Gate FIG. 8, Gate Solenoid FIG. 10, Gate Plate FIG. 11, Round Casing Assembly FIG. 104, and a Gate Harness. The FIG. 8 is the base of the assembly. Gate Solenoid FIG. 10 is a two-way solenoid and returns to its original position after firing with a spring (spring not shown). The Gate Plate FIG. 11 is immediately behind the FIG. 8 gate assembly and these are screwed together (screws not shown). The Round Casing Assembly FIG. 104 is held in place by three Gate Harnesses FIG. 14 with one screw for each harness. Each Gate Harness FIG. 14 is also screwed to the bottom of the FIG. 8. Gate Gear Assembly FIG. 17 is mostly located within the Frame Assembly FIG. 62 and toward the back end of the upper-frontal chamber near where the Gate Assembly FIG. 6 is located. There are three exceptions to this being inside. These are the tips of Gear Rod FIG. 20, Bearing Cap FIG. 21, and Ball Bearing FIG. 22. The Ball Bearing FIG. 22 has a plus-sign shaped middle that holds Gear Rod FIG. 19. Bearing Cap FIG. 21 is glued to Ball Bearing FIG. 22 and Frame FIG. 64. This Gear Rod FIG. 19 is mostly an interior feature but does protrude out each side. This is where Gear Rod FIG. 19 meets Ball Bearing FIG. 22. Inside the Frame Assembly FIG. 62 are two Gate Gears FIG. 20, two Trigger Wheels FIG. 25 (all trigger wheels might be better as gears), an Electric Motor Assembly FIG. 26, Band One FIG. 30 (which might be better as a chain), and Front Motor Joist Assembly FIG. 31. All these components are focused on turning the Gate Gear FIG. 20. The Gate Gears FIG. 20 are arranged one-on-each-side and have the Gear Rod FIG. 19 going through them. In the middle of Gear Rod FIG. 19 is a Trigger Wheel FIG. 25. Trigger Fig. Wheel 25 is attached to an Electric Motor Assembly FIG. 26 via Band One FIG. 30 and another Trigger Wheel FIG. 25. The secondly mentioned Trigger Wheel FIG. 25 attaches to the Trigger Wheel Rod FIG. 29 and is part of the Electric Motor Assembly FIG. 26. The Trigger Wheel Rod FIG. 29 attaches to an Electric Motor 443. The Electric Motor FIG. 28 fits snugly into a Front Motor Joist FIG. 33. The Electric Motor Assembly FIG. 26 is held in place by a Front Motor Joist Assembly FIG. 31. The Front Motor Joist Assembly FIG. 31 has three parts. They are Front Motor Joist FIG. 33, Front Motor Joist Hinge FIG. 35, and Rear Motor Joist Rod FIG. 36. The Front Motor Joist Hinge FIG. 35 is welded to the Frame FIG. 64, The Front Motor Joist Hinge FIG. 35 allows for the operator to land a parachute or a jump without Band One FIG. 30 falling off. Rear Motor Joist Rod FIG. 36 holds Front Motor Joist FIG. 33, Front Motor Joist Hinge FIG. 35 together. Rear Motor Joist Rod FIG. 36 is made of a semi-flexible material such as solder. A battery FIG. 38 rests in the middle of the upper-frontal chamber of the GL300.

Figure 22:
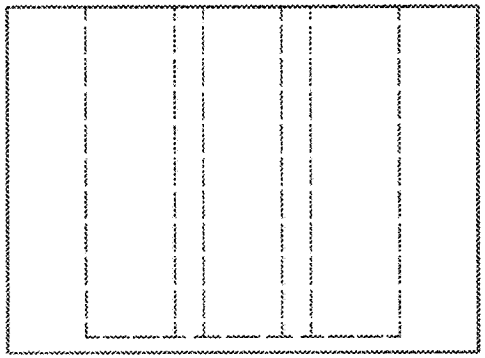
FIG. 22 illustrates a side view of the ball bearing with a plus sign on the inside.
Figure 23:
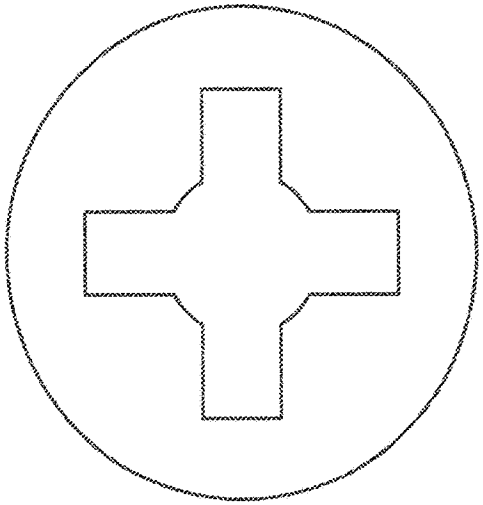
FIG. 23 illustrates a side view of the ball bearing.
Figure 39:
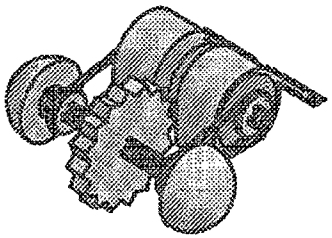
FIG. 39 illustrates an assembled and isometric view of the powered barrel assembly.
Figure 40:
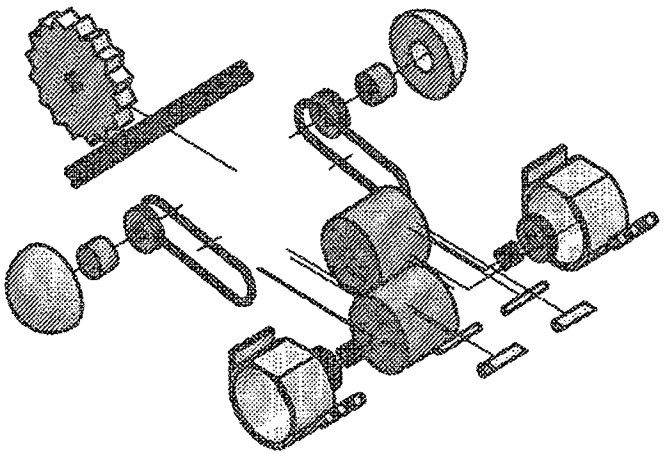
FIG. 40 illustrates an exploded and isometric rear-left view of a the powered barrel assembly.
Figure 50:
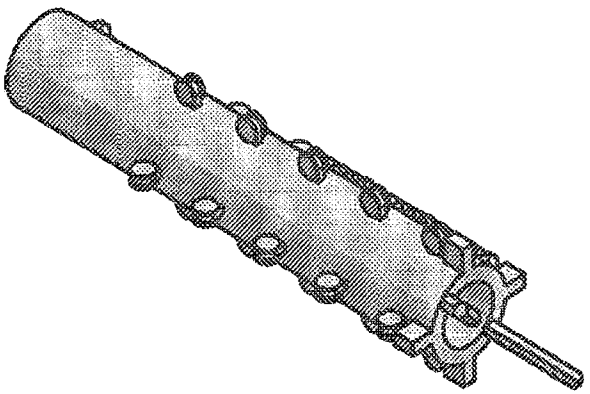
FIG. 50 illustrates an assembled isometric front view of the barrel assembly.
Figure 51:
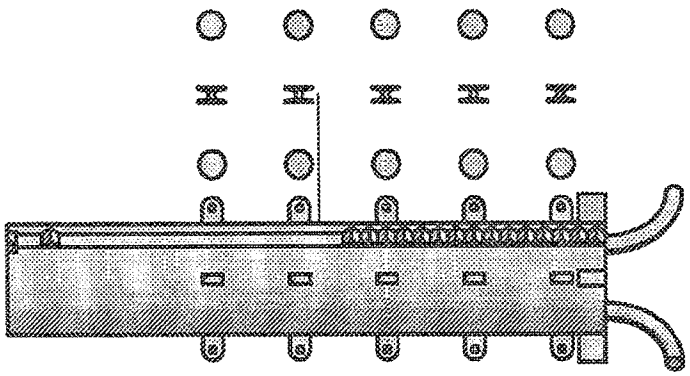
FIG. 51 illustrates an exploded view of the barrel assembly.
Figure 60:
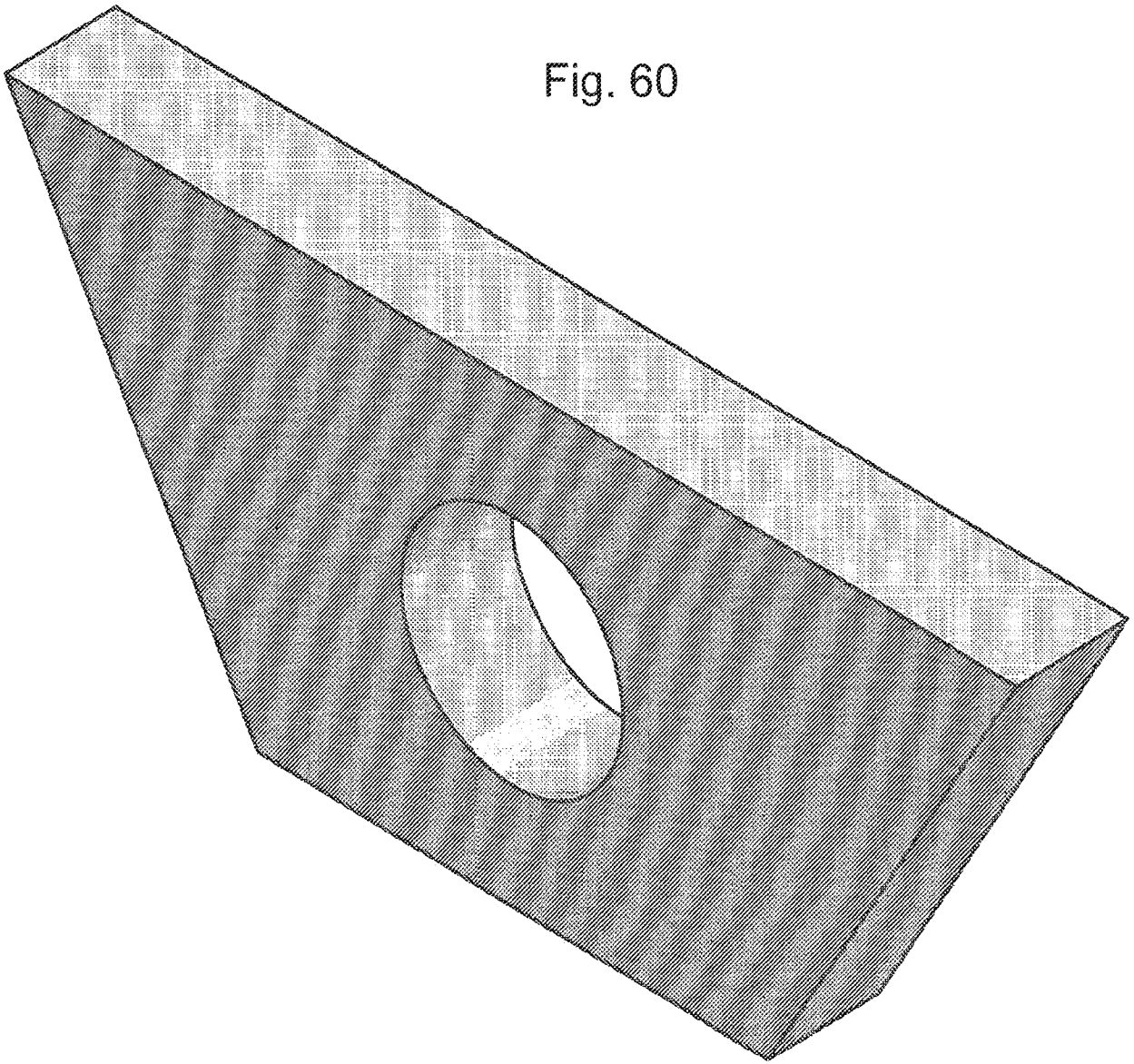
FIG. 60 illustrates an isometric view of the ejector holder.
Figure 64:
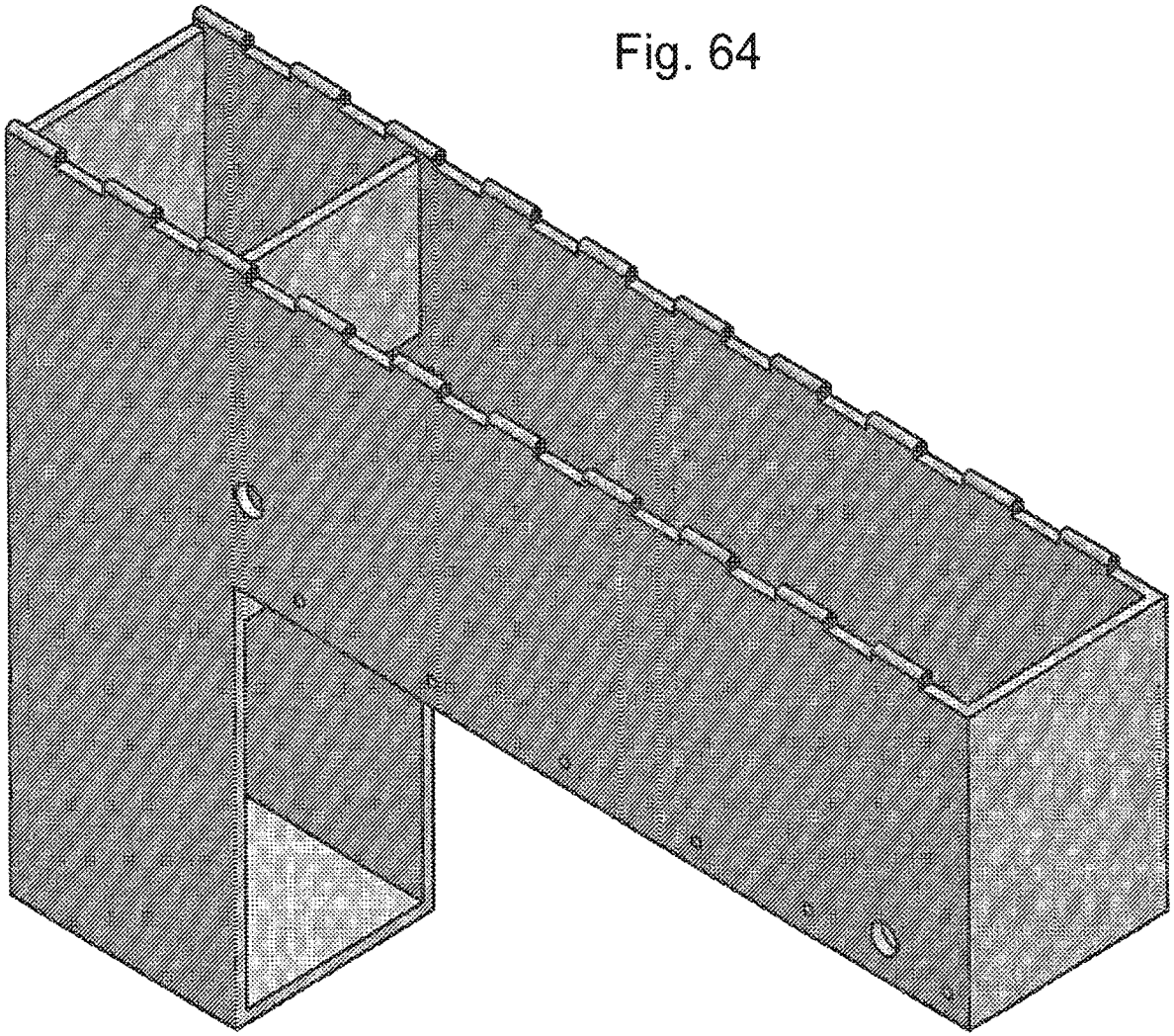
FIG. 64 illustrates an isometric view of the frame.

A Powered Barrel Assembly FIG. 39 is located near the front of the GL300's upper chamber. The Powered Barrel Assembly FIG. 39 has many parts (some of which have already been mentioned). There is Gear Rod Two FIG. 19, four Trigger Wheels FIG. 25, two Bearing Caps FIG. 21, One (1) Barrel Gear FIG. 41, two Ball Bearings FIG. 22, two Band Two's FIG. 42, two Electric Motor Assemblies FIG. 26, and two symmetric Front Motor Joists, Left and Right FIG. 43 and FIG. 47, respectively. Front Motor Joist Left FIG. 43 is comprised of a Front Motor Joist FIG. 33, Front Motor Joist Rod FIG. 45, and Front Motor Joist Hinge Left FIG. 46. The hinge is welded to the Frame FIG. 64 and is missing a link on its right side (when compared to Front Motor Joist FIG. 35). The joist holds an Electric Motor Assembly FIG. 26. The rod holds the Front Motor Joist FIG. 33 and Front Motor Joist Hinge Left FIG. 46 together. Front Motor Joists Right FIG. 47 is precisely the same as Front Motor Joists Left FIG. 43 with one exception—the hinge that holds it in place has a missing link on the left side of it (when compared to FIG. 35). It is a mirror image of Front Motor Joists Left FIG. 43. There are two Band Two's FIG. 42 connecting both motor joists to their own Electric Motor Assemblies FIG. 26 (at the Trigger Wheel FIG. 25) and another Trigger Wheel FIG. 25. The latter are connected to Gear Rod Two FIG. 19. Gear Rod Two FIG. 19 is connected (through the Frame FIG. 61) to Ball Bearings FIG. 22. Each Ball Bearing FIG. 22 is connected to its own Bearing Cap FIG. 21, and the Bearing Cap FIG. 21 is glued to the Frame FIG. 64 and Ball Bearings FIG. 22. In the middle of Gear Rod Two FIG. 19 is a large Barrel Gear FIG. 41. There is a Barrel Assembly FIG. 50 inside of the Barrel Sheath FIG. 57. The Barrel Sheath FIG. 57 screws bolts into the Frame FIG. 64 (screws bolts not shown in drawings). The Barrel Assembly FIG. 50 is a Barrel FIG. 52 and several Wheel Assemblies FIG. 53. Each Wheel Assembly FIG. 53 contains one Wheel 2 FIG. 55 and one (1) Wheel FIG. 56. The two wheels screw together inside of holes in the Barrel FIG. 52 to form a Wheel Assembly FIG. 53. There is an Ejector Assembly-FIG. 58. It is comprised of two Ejector Holders FIG. 60, an Ejector FIG. 61, and a Spring FIG. 68. The Ejector Fielders FIG. 60 are on each of the long sides of the Ejector FIG. 61. These three pieces are connected with a nut and bolt (not shown in drawings). The Ejector Holders FIG. 60 are welded to the Frame FIG. 64 on the larger surface of the bottom of the Frame FIG. 64. There is a Frame Assembly FIG. 62. It is comprised of a Frame FIG. 64, a Frame Wire FIG. 65, and a Frame Hatch-FIG. 66. The Frame FIG. 64 is the base of the First Embodiment. The Frame Hatch FIG. 66 is attached to the Frame FIG. 64 by two Frame Wires FIG. 65 (one on each side). There is a Hose Adapter FIG. 67 that is welded to the back of the Frame FIG. 64.

First Embodiment Operation

With simple programming, when the trigger is squeezed, a gate solenoid FIG. 10 is driven forward and into the printer of the 40 mm grenade and back to its' original position. This launches the grenade. Immediately following the launch, the barrel assembly FIG. 50 is driven forward and then back to its' seated position by the powered barrel assembly FIG. 39) using its' two motors FIG. 26 that power the trigger wheels FIG. 25 and trigger wheel rods FIG. 29 to spin gear rod two FIG. 19 and the barrel gear FIG. 41 and the barrel assembly FIG. 50). Gear rod two spins and is held in the appropriate place by a ball bearing on each side of the frame. The ball bearings are held in place by the bearing cap. The bearing cap is glued to the bearing and the frame. When the barrel reaches a certain distance from the seated position, it hits the ejector assembly FIG. 58. This triggers the ejector assembly FIG. 58 to launch the spent round out to make room for the next, round. If the grenade is a dud, the barrel assembly mm FIG. 50 must be removed, with the Grenade Launcher pointed in a downward position. The dud must be removed by hand, and the barrel must be slid back in. This should only take 1-5 seconds. The barrel is cooled by the same high-pressure air that loads it. While the barrel assembly FIG. 50 is moving back and forth, the gate assembly FIG. 6 is going up and down. This is done by the gate gear assembly FIG. 17. The gate gear spins on the gear rod FIG. 19 (which is held in place and given freedom to spin by the ball bearing FIG. 22 and bearing cap FIG. 21). The gear rod FIG. 19 is given the ability to spin by the electric motor assembly FIG. 26 which is held in place by the front motor joist assembly FIG. 31.

First Embodiment Function of Each Part

FIG. 6 Gate Assembly: is like the bolt of an M-16 or AK-47 in function.

FIG. 8 Gate: contains what is needed to fire the GL and interact with the gate gears. The zigzag is not accurate and should be shown as a gear-type pattern on a flat surface.

FIG. 10 Gate Solenoid: an electronic firing pin FIG. 11 Gate Plate: holds the solenoid in place.

FIG. 104 Round Casing Assembly: acts as a guide into the barrel (for the GL300).

Figure 105:
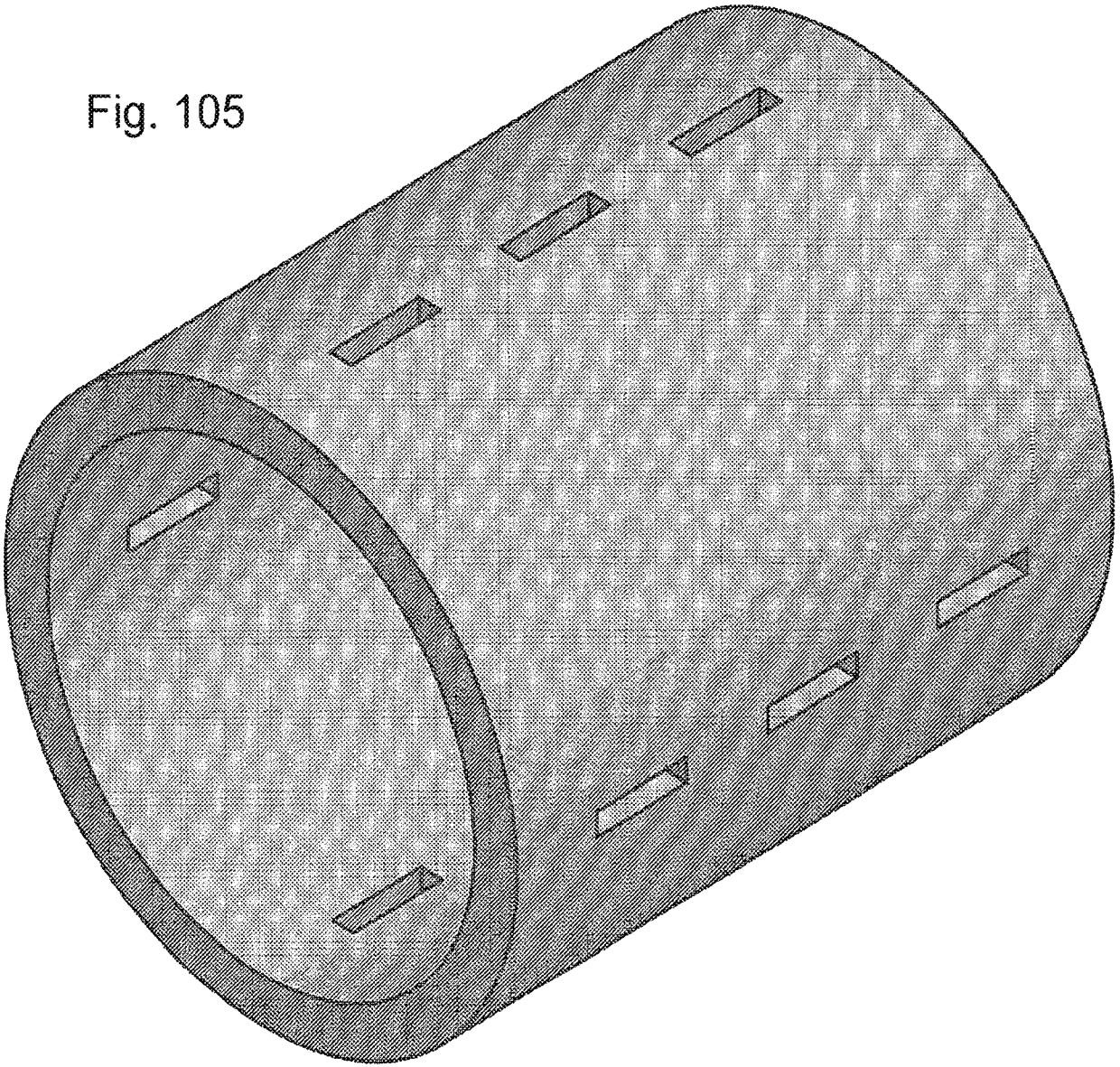
FIG. 105 illustrates an isometric view of the round casing.

FIG. 105 Round Casing: the frame of M10-2b thru M10-2c.

Figure 106:
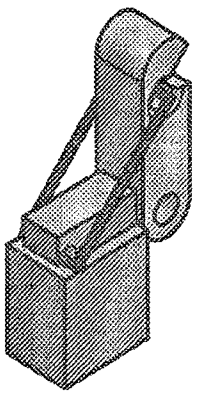
FIG. 106 illustrates an assembled isometric rear view of the round propper assembly.
Figure 107:
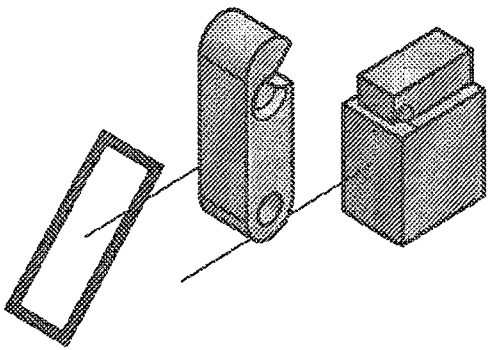
FIG. 107 illustrates an exploded, isometric, rear view of the round propper assembly.

FIG. 106 Round Propper Assembly: holds the round in place.

Figure 108:
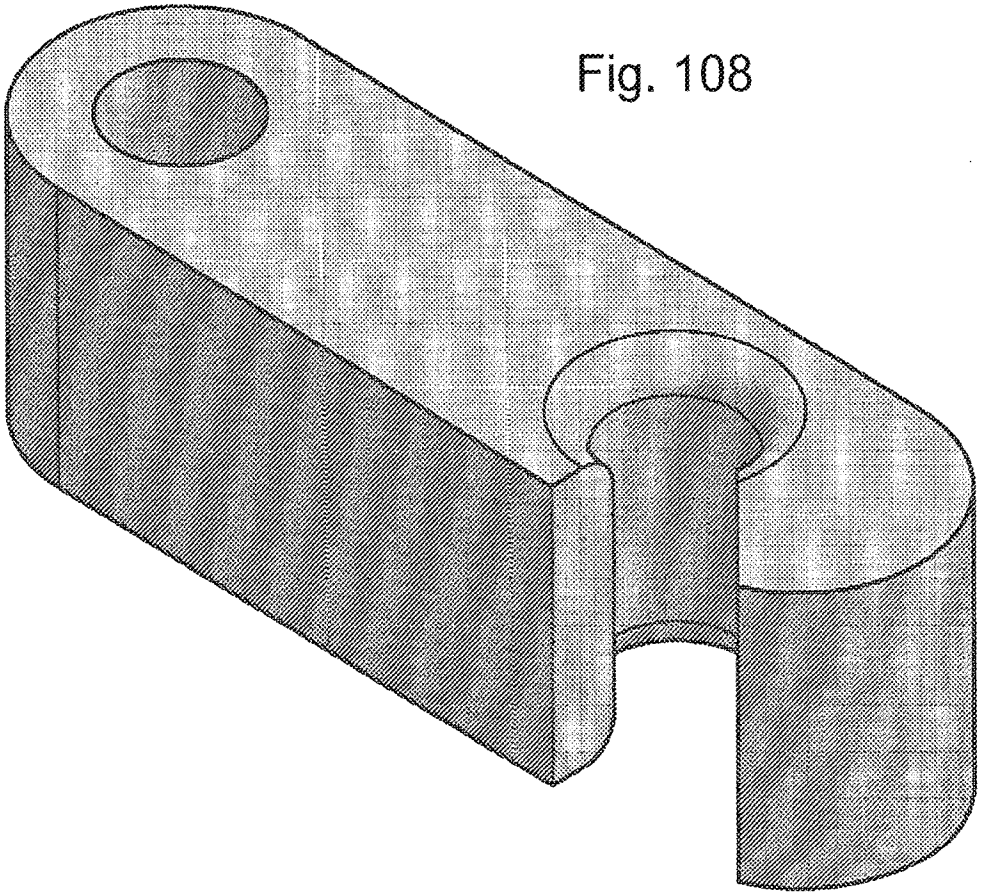
FIG. 108 illustrates an isometric top front view of the round propper.

FIG. 108 Round Propper: does the holding.

Figure 109:
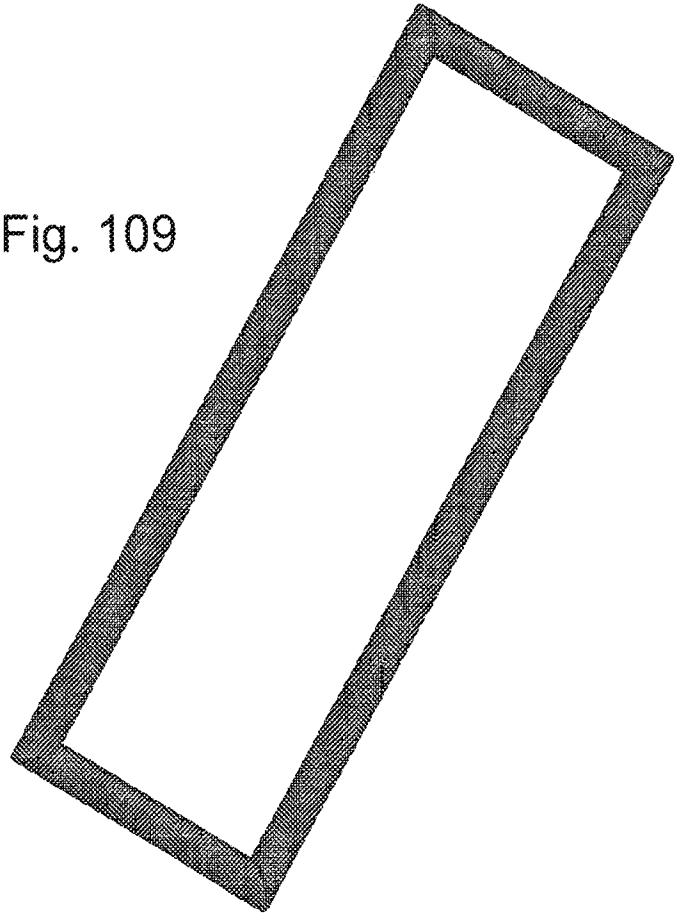
FIG. 109 illustrates an auxiliary view of the rubber band.

FIG. 109 Rubber Band: returns the round propper to its' erect position after the round is fired and it keeps the round in place while the round is loaded.

Figure 110:
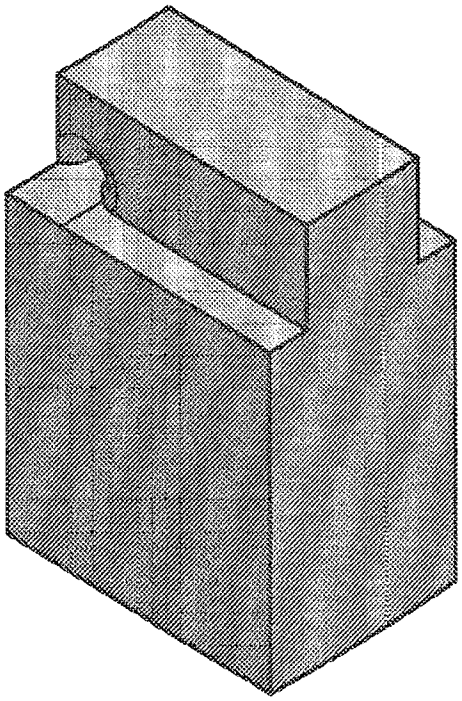
FIG. 110 illustrates an isometric view of the round propper stopper.
Figure 111:
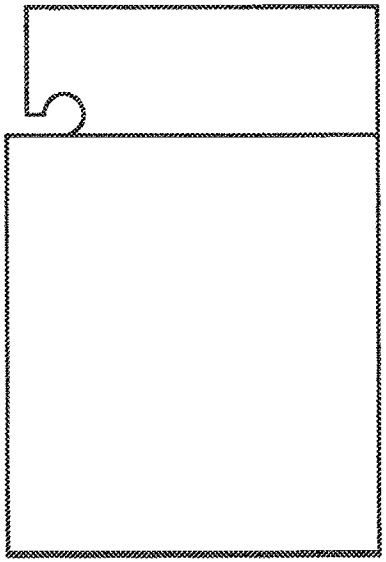
FIG. 111 illustrates a side view of the round propper stopper.

FIG. 110 Round Propper Stopper: keeps the round propper from extending too far.

Figure 112:
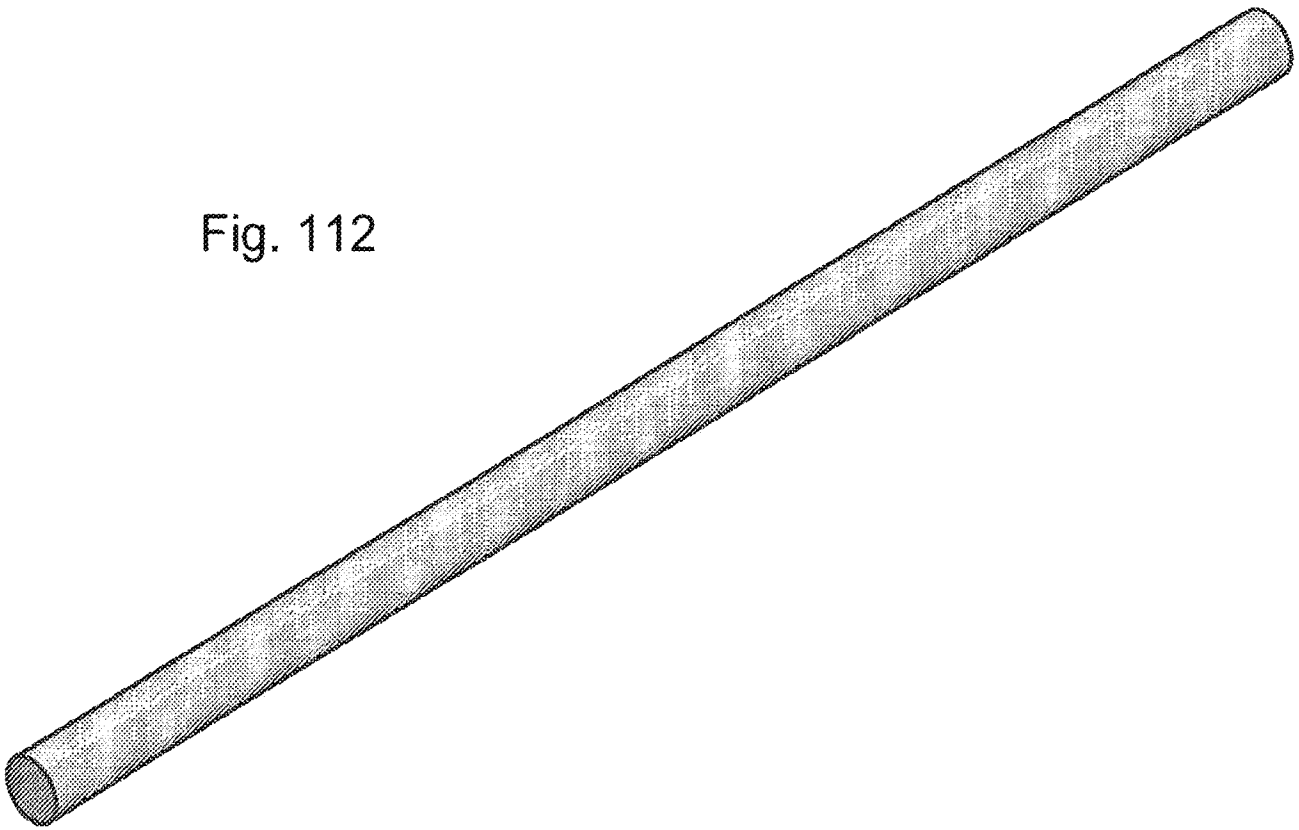
FIG. 112 illustrates an isometric view of a round casing rod.

FIG. 112 Round Casing Rod: holds the round propper in place.

FIG. 14 Gate Harness: holds the round casing assembly in place with 3 screws each (not shown).

FIG. 17 Gate Gear Assembly: moves the gate up and down.

FIG. 19 Gear Rod: acts like a drive shaft for FIG. 108 Gate Gear: a very rough view of a gear.

FIG. 21 Bearing Cap: holds the bearing to the frame.

FIG. 22 Ball Bearing: allows the gear rod to rotate.

Figure 25:
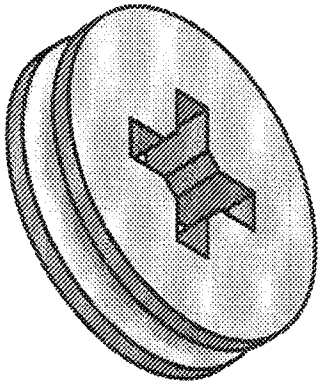
FIG. 25 illustrates an isometric view of the trigger wheel.
Figure 27:
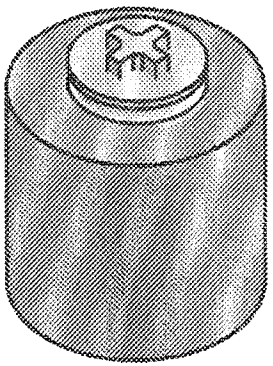
FIG. 27 illustrates an isometric view of the electric motor assembly.
Figure 26:
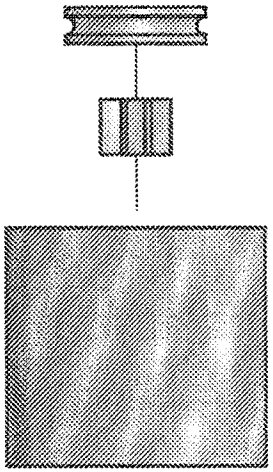
FIG. 26 illustrates a side and exploded view of the electric motor assembly.

FIG. 25 Trigger Wheel: can be either a gear or a belt wheel for either a chain or a rubber band.

FIG. 26 Electric Motor Assembly: produces the force necessary to operate gate and barrel (exact dimensions currently unknown).

Figure 28:
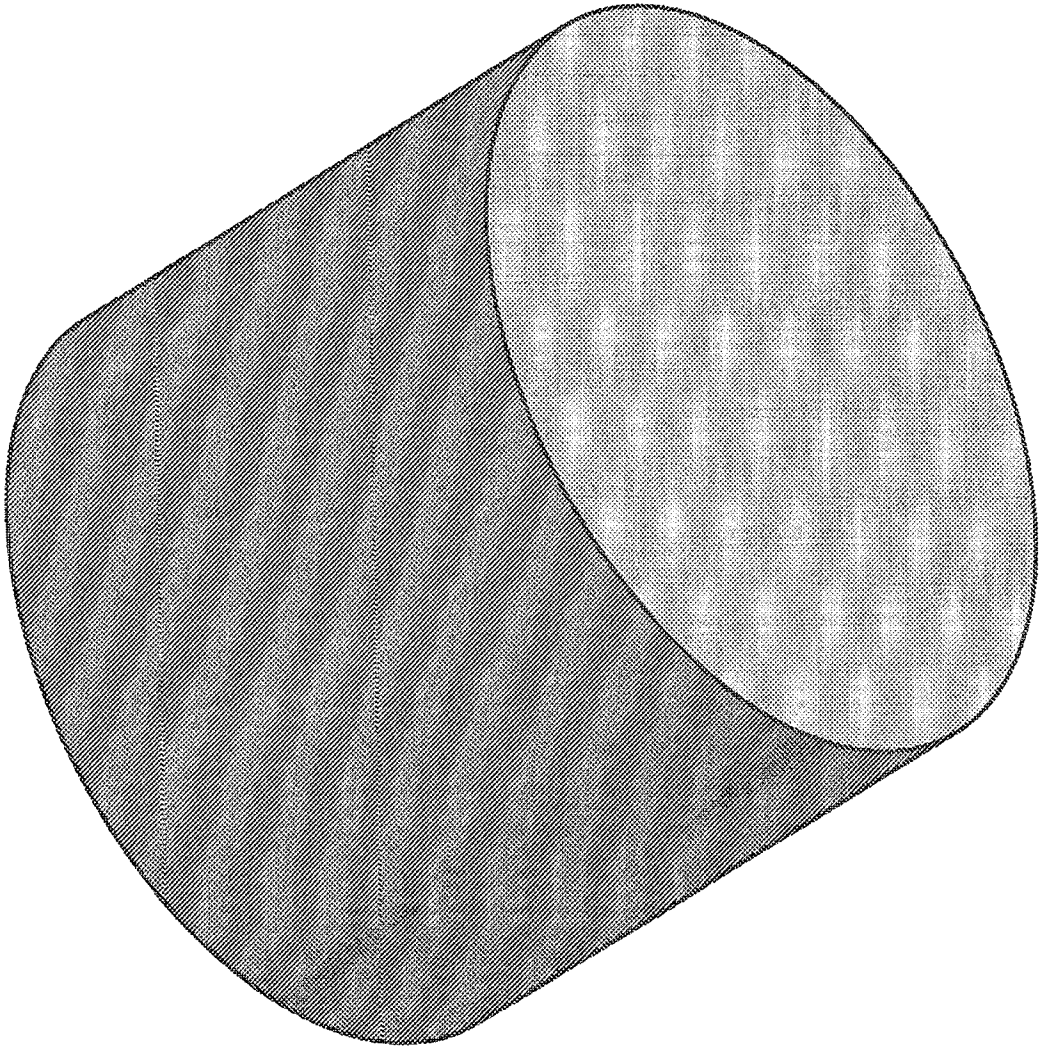
FIG. 28 illustrates an isometric view of an electric motor.

FIG. 28 Electric Motor: move the gate and barrel.

Figure 29:
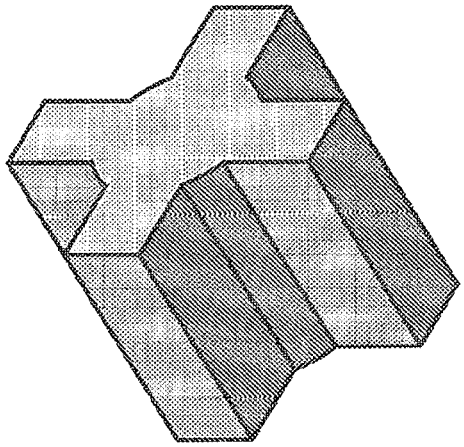
FIG. 29 illustrates an isometric view of the trigger wheel rod.

FIG. 29 Trigger Wheel Rod: connects electric motor and trigger wheel.

Figure 30:
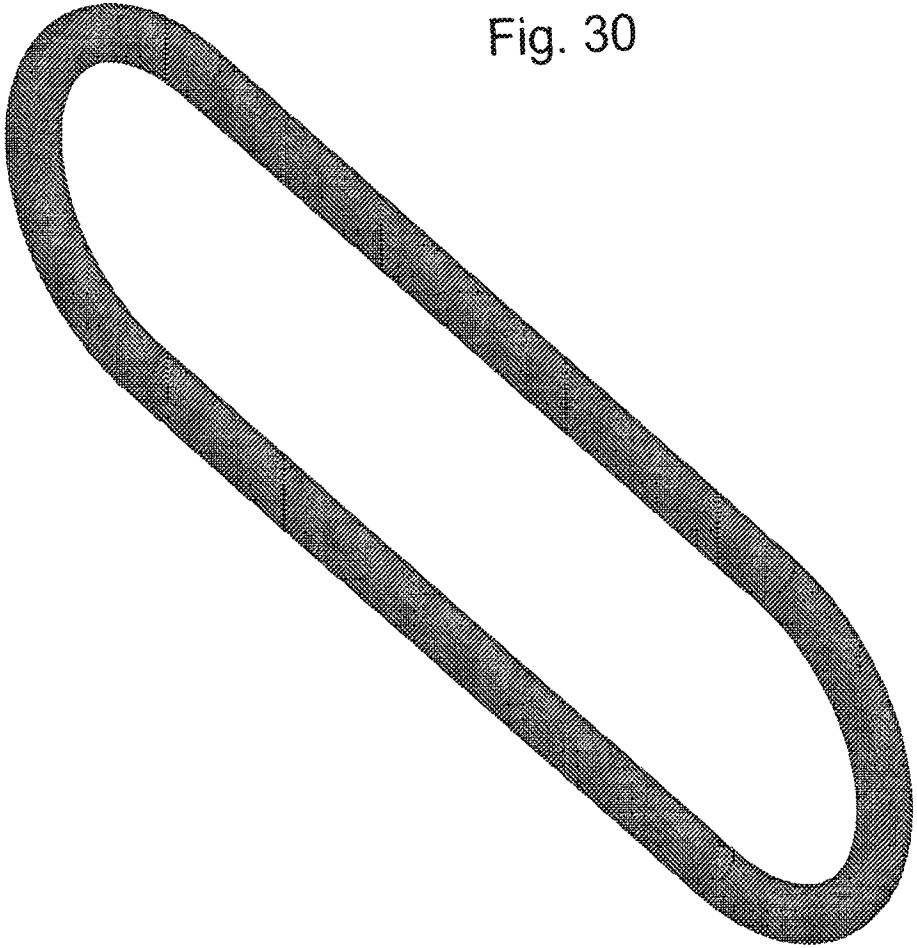
FIG. 30 illustrates an isometric view of band one, which can be a rubber band or a chain.

FIG. 30 Band One: can be either a rubber band or chain.

Figure 31:
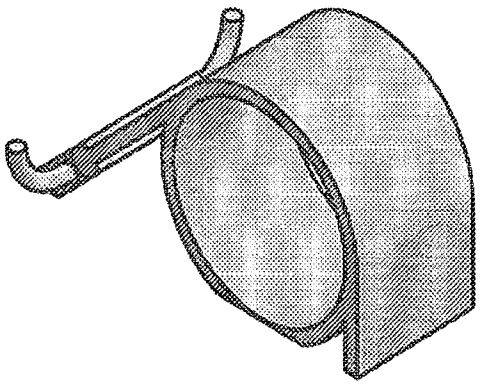
FIG. 31 illustrates an isometric view of the front motor joist assembly.
Figure 32:
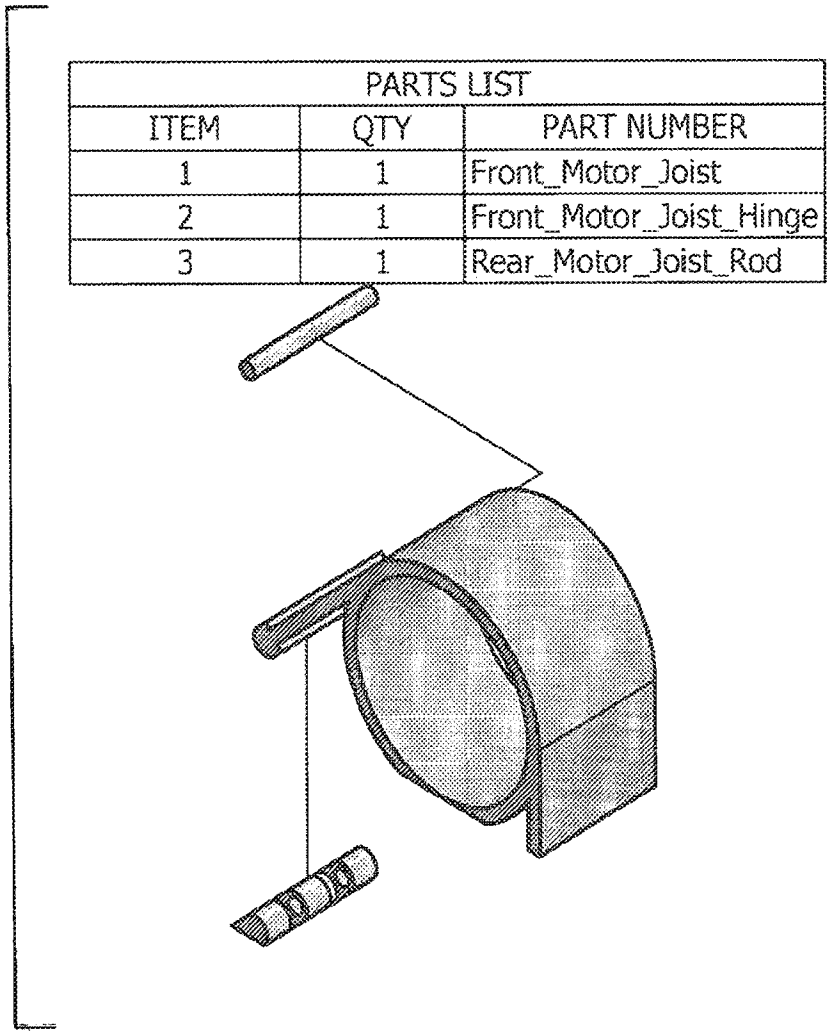
FIG. 32 illustrates an exploded and isometric view of the front motor joist assembly.
Figure 34:
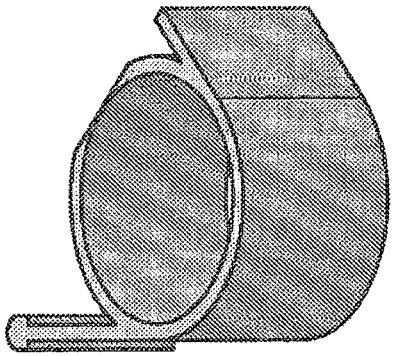
FIG. 34 illustrates an isometric view a front motor joist.

FIG. 31 Front Motor Joist Assembly: holds the electric motor in place.

Figure 33:
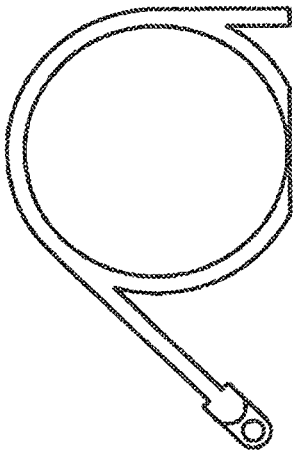
FIG. 33 illustrates a side view of the front motor joist.

FIG. 33 Front Motor Joist: holds the electric motor in place,

FIG. 35 Front Motor Joist Hinge: allows the motor to pivot up and down to absorb the shock caused by things such as landing a parachute, it is welded to the frame.

Figure 38:
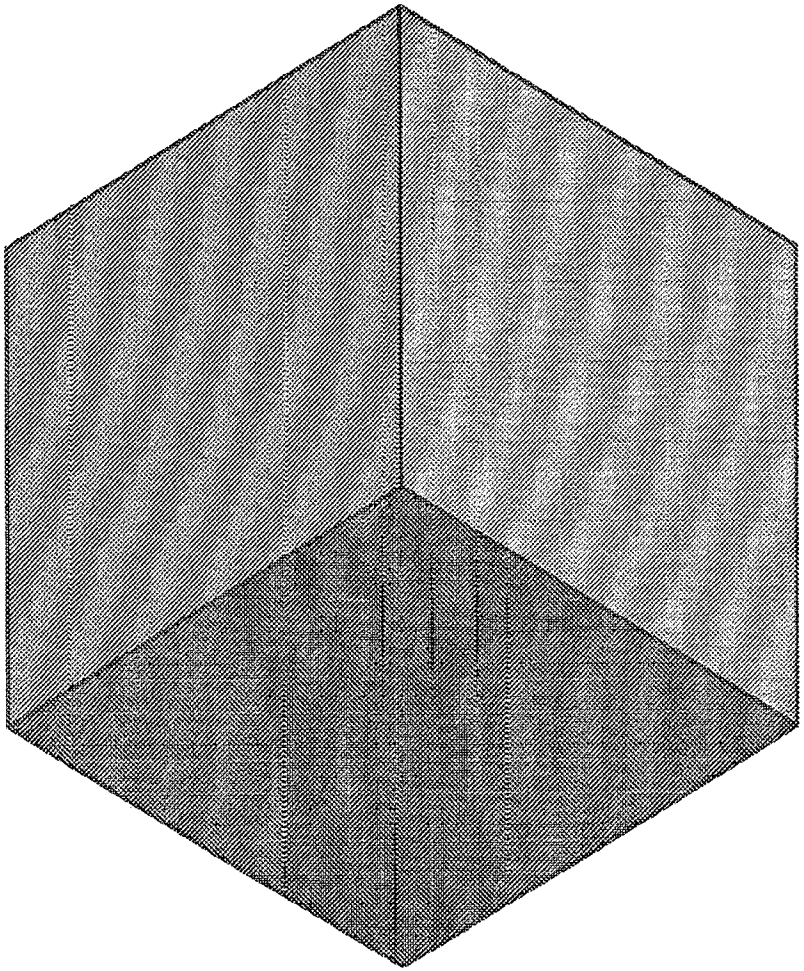
FIG. 38 illustrates an isometric view of the battery.

FIG. 36 Rear Motor Joist Rod: holds the front motor joist hinge together,

FIG. 38 Battery: can be used to power the electric motors (not necessary),

FIG. 39 Powered Barrel Assembly: moves the barrel,

FIG. 19 Gear Rod: acts as a driveshaft.

FIG. 25 Trigger Wheel: can be either a gear or a belt wheel for either a chain or a rubber band.

FIG. 21 Bearing Cap: holds the ball bearing in place, and is glued to the ball bearing and frame.

Figure 41:
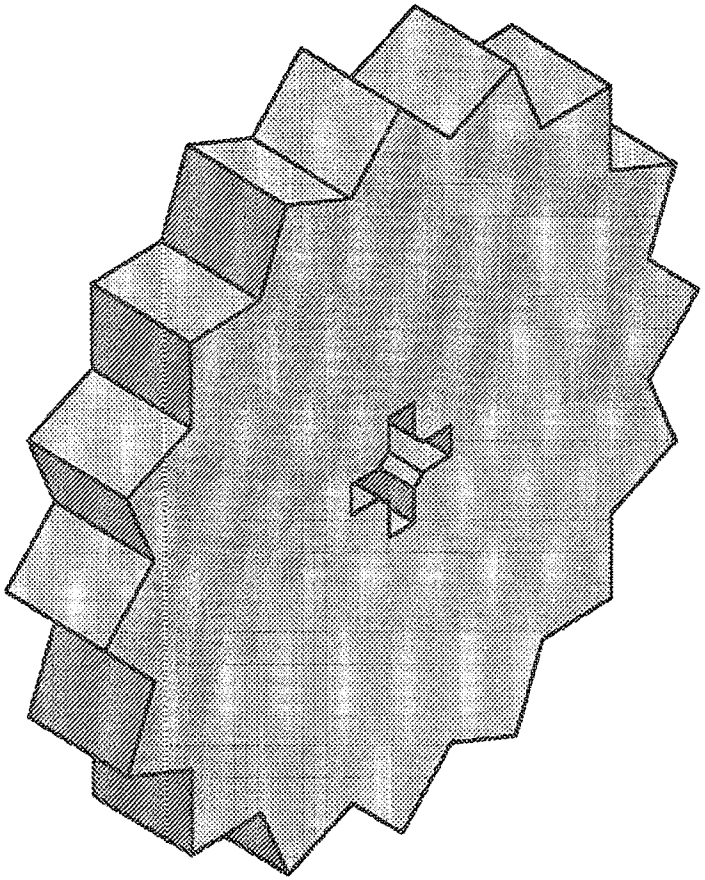
FIG. 41 illustrates an isometric view of the barrel gear.

FIG. 41 Barrel Gear: a rough drawing of a large gear that interacts with the barrel to move it in and out.

Figure 42:
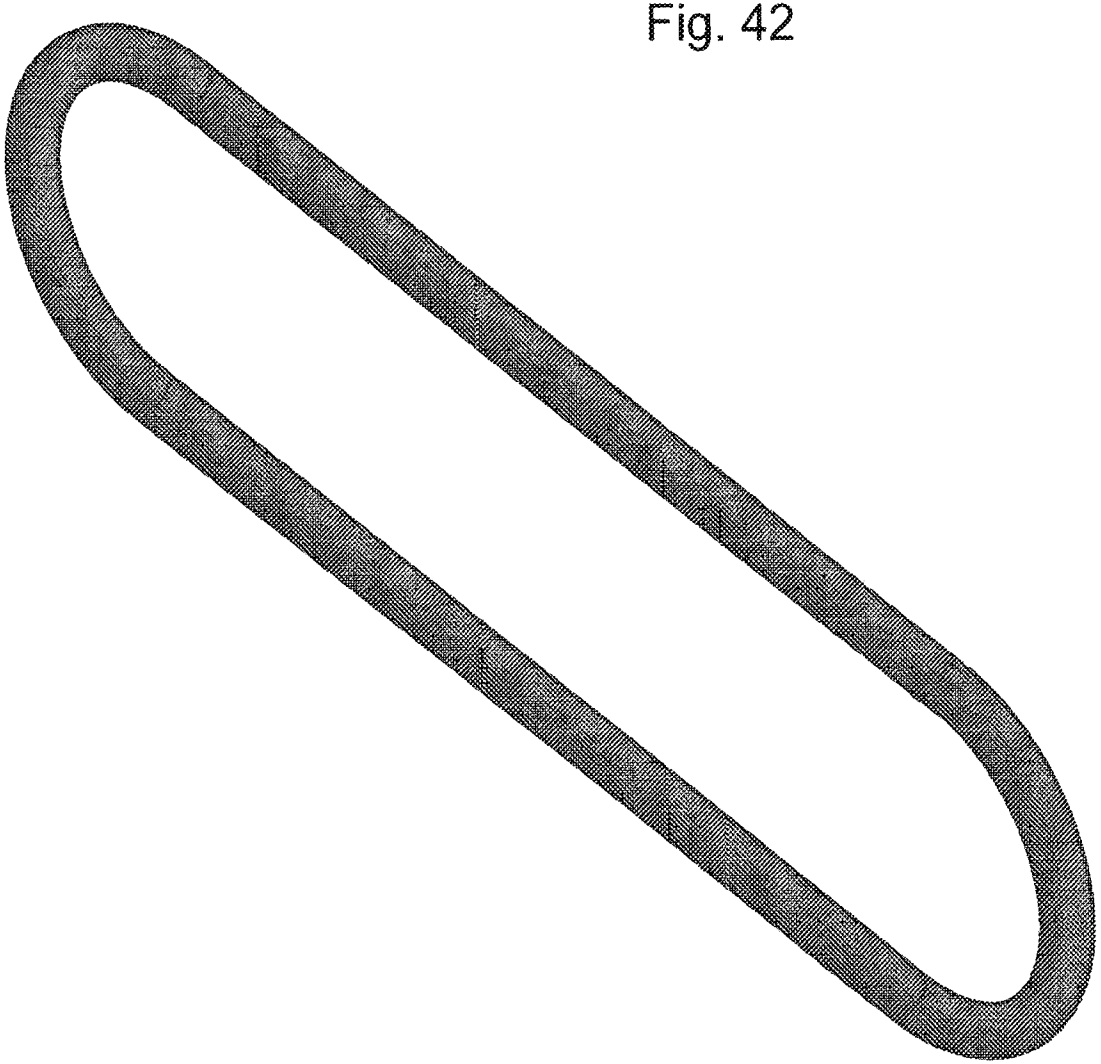
FIG. 42 illustrates an isometric view of Band two.
Figure 43:
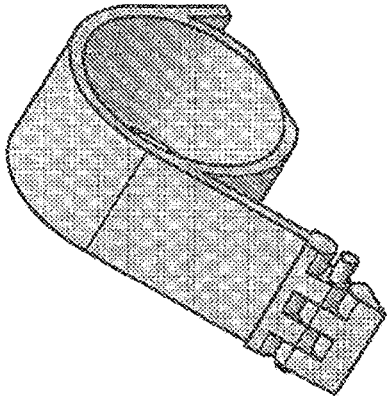
FIG. 43 illustrates an assembled and isometric view of the left front motor joist.
Figure 44:
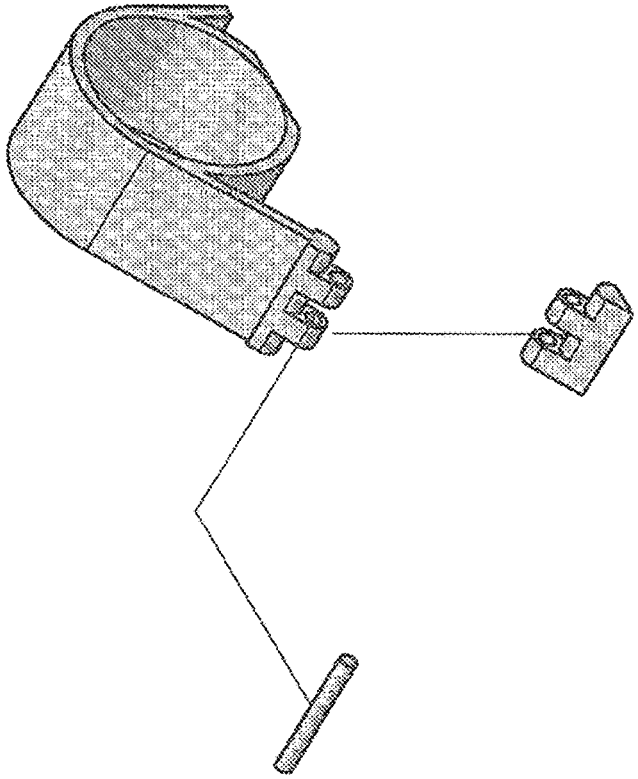
FIG. 44 illustrates an exploded and isometric view of the left front motor joist.

FIG. 22 Ball Bearing: allows gear rod two to spin with very little resistance, FIG. 42 Band Two: either a rubber band or a chain.

FIG. 26 Electric Motor Assembly: causes enough force to move the barrel quickly.

FIG. 28 Electric Motor: starts the mechanical reaction that moves the barrel.

FIG. 25 Trigger Wheel: can be either a gear or a belt wheel for either a chain or rubber band.

FIG. 29 Trigger Wheel Rod: a small driveshaft for the electric motor.

FIG. 43 Front Motor Joist Left: holds the electric motor in place,

FIG. 33 Front Motor Joist: holds the electric motor.

Figure 45:
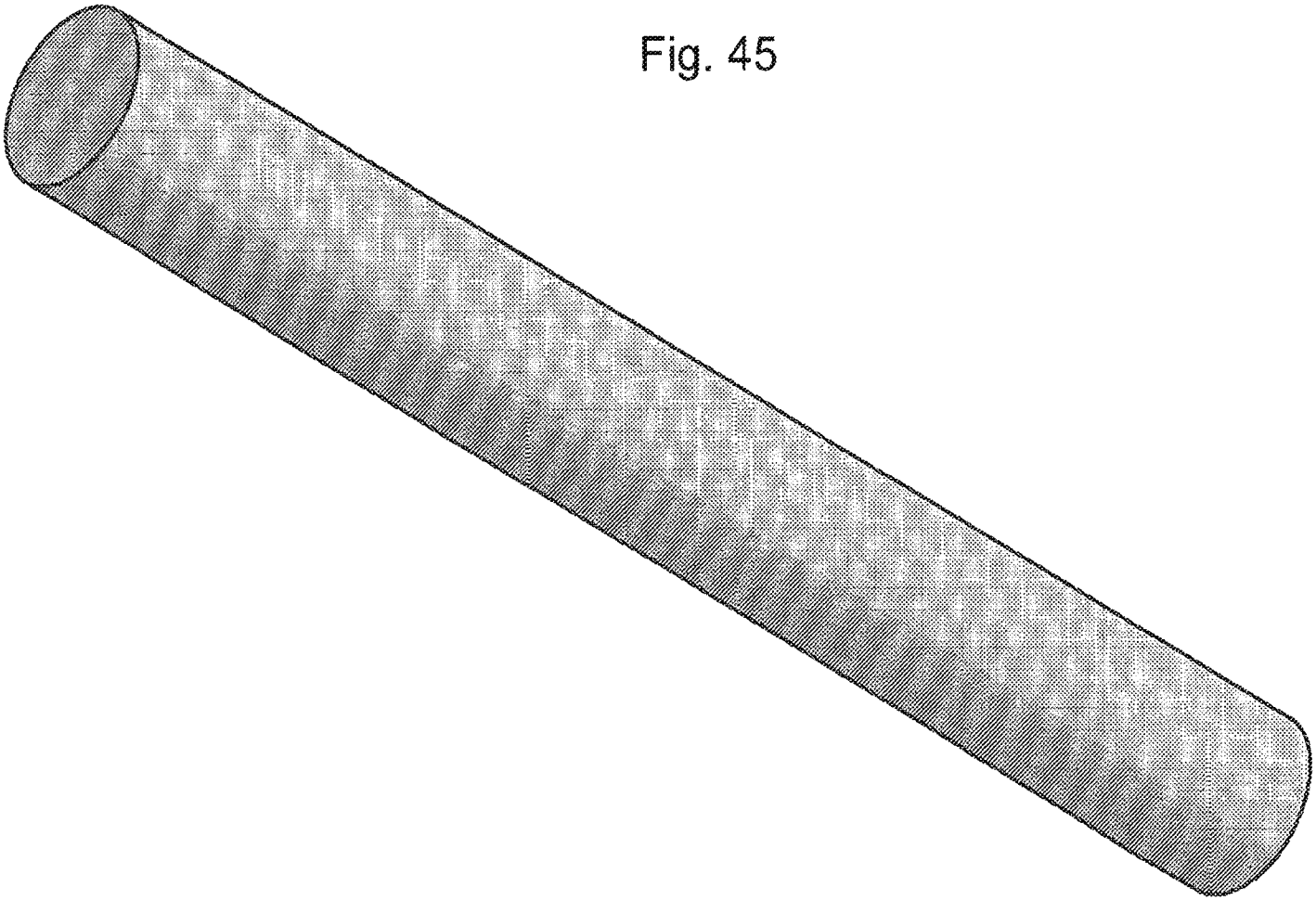
FIG. 45 illustrates isometric view of the left front motor joist rod.

FIG. 45 Front Motor Joist Rod: holds the front motor joist left and hinge in place.

Figure 46:
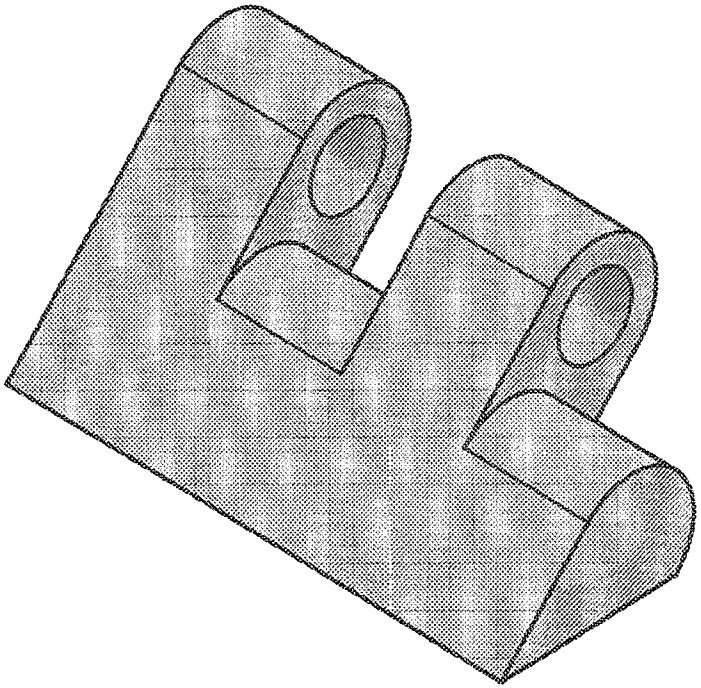
FIG. 46 illustrates an isometric view of the left front motor joist hinge.
Figure 47:
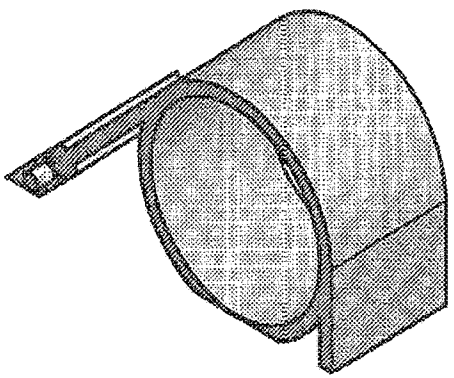
FIG. 47 illustrates an assembled, isometric view of the right front motor joist.
Figure 48:
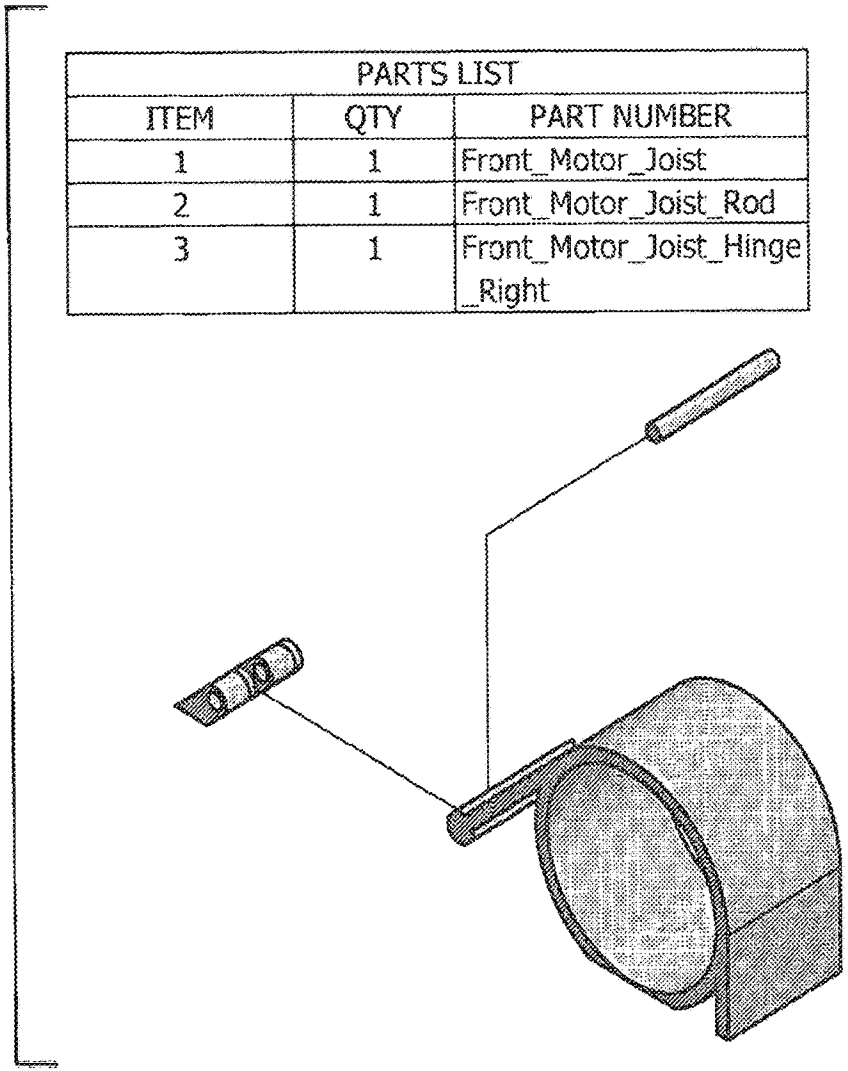
FIG. 48 illustrates an exploded, isometric view of the right front motor joist.

FIG. 46 Front Motor Joist Hinge Left: holds the front motor joist and frame together. It is welded in place.

FIG. 47 Front Motor Joist Right: holds the electric motor in place,

FIG. 33 Front Motor Joist: holds the electric motor.

FIG. 45 Front Motor Joist Rod: holds the front motor joist left and hinge in place.

Figure 49:
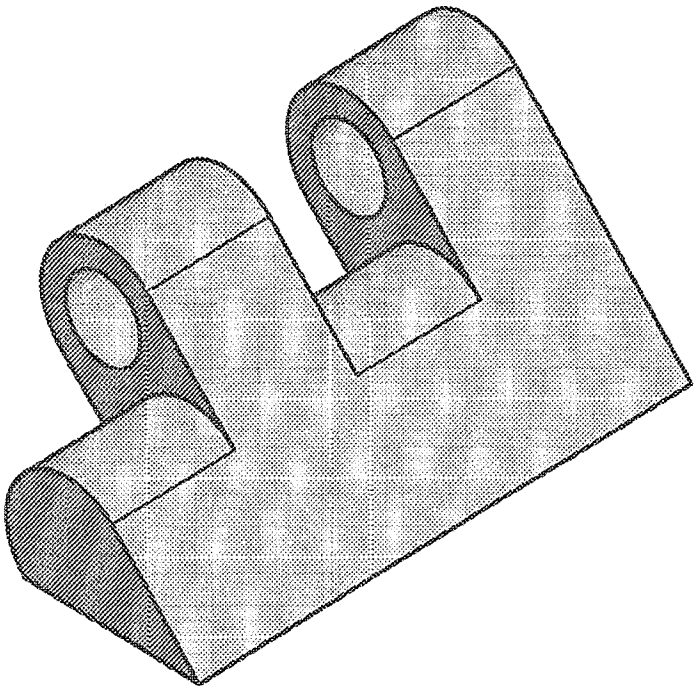
FIG. 49 illustrates an isometric view of the right front motor joist hinge.

FIG. 49 Front Motor Joist Hinge Right: holds the front motor joist and frame together. It is welded in place.

FIG. 50 Barrel Assembly: guides the round in a controlled direction.

Figure 52:
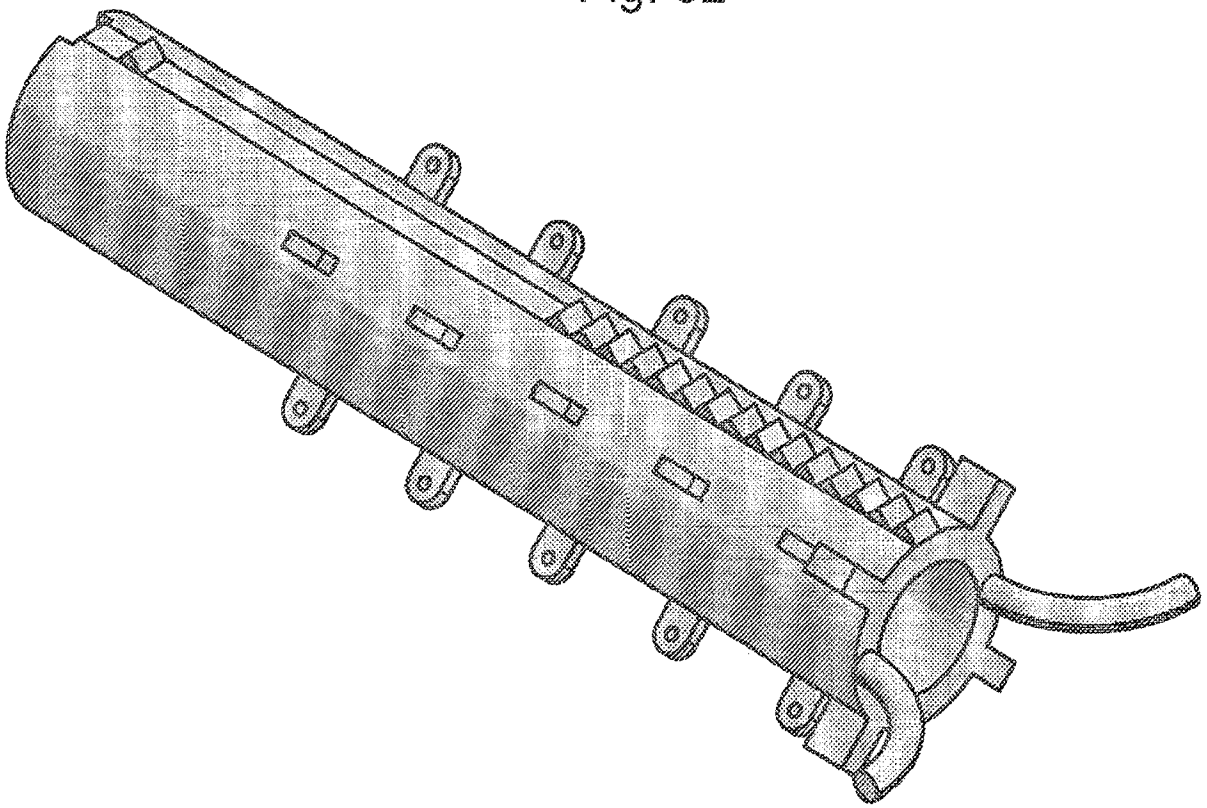
FIG. 52 illustrates a front, isometric view of a Barrel.
Figure 53:
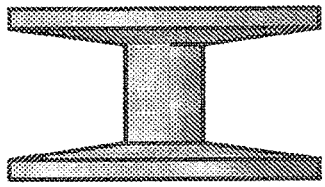
FIG. 53 illustrates an assembled front view of the wheel assembly.
Figure 54:
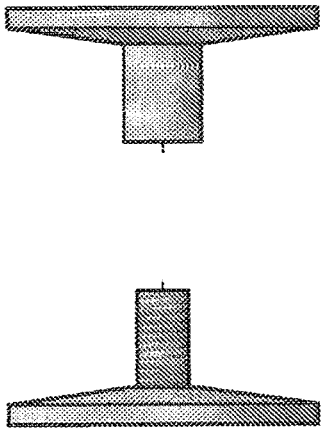
FIG. 54 illustrates an exploded front view of the wheel assembly.

FIG. 52 Barrel: holds the round and directs it after the round is fired,

FIG. 53 Wheel Assembly: guides the barrel during reloading and holds it in place while not reloading.

Figure 55:
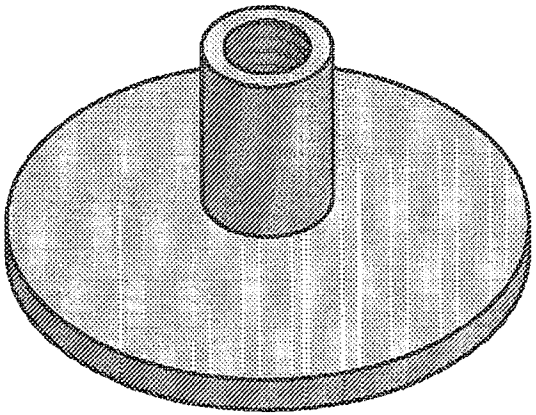
FIG. 55 illustrates an isometric view of Wheel two.

FIG. 55 Wheel 2: screws into wheel 1.

Figure 56:
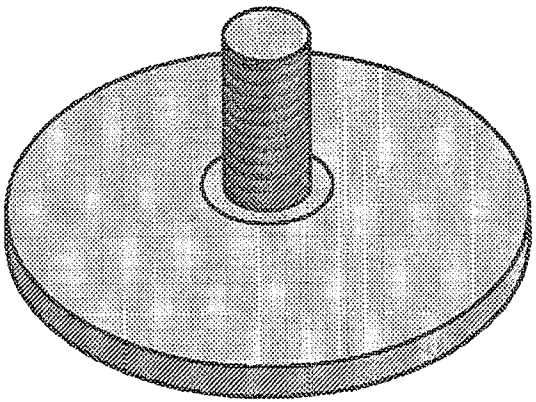
FIG. 56 illustrates an isometric view of Wheel one.
Figure 57:
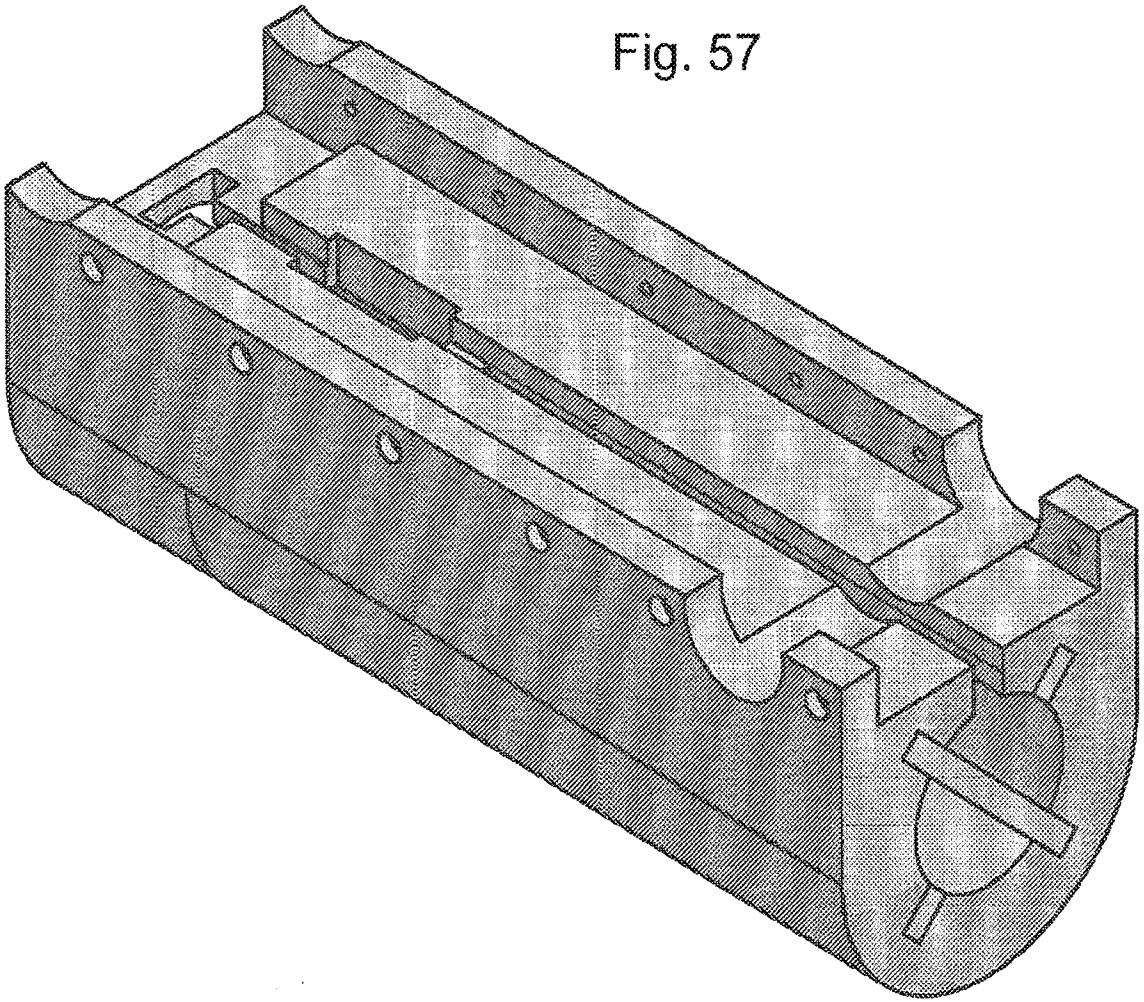
FIG. 57 illustrates an isometric view of the barrel sheath.

FIG. 56 Wheel 1: screws into wheel 2,

FIG. 57 Barrel Sheath: holds the barrel assembly.

Figure 58:
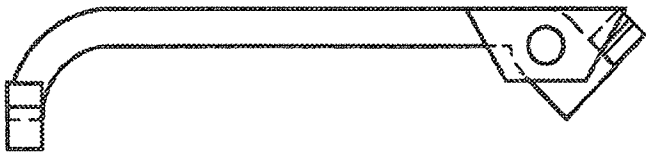
FIG. 58 illustrates a side view of the ejector assembly.
Figure 59:
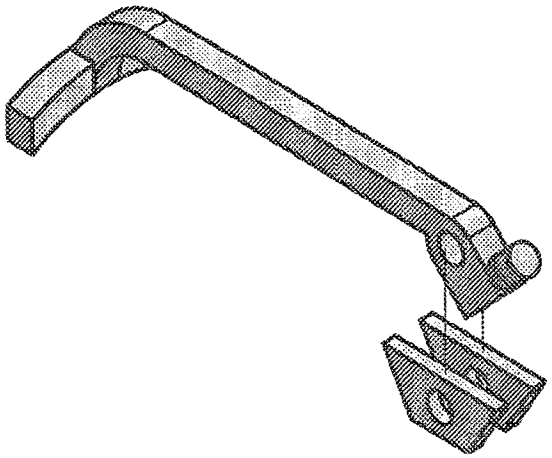
FIG. 59 illustrates an exploded, isometric view of the ejector assembly.

FIG. 58 Ejector Assembly: ejects the spent, round easing,

FIG. 60 Ejector Holder: connects ejector to frame.

Figure 61:
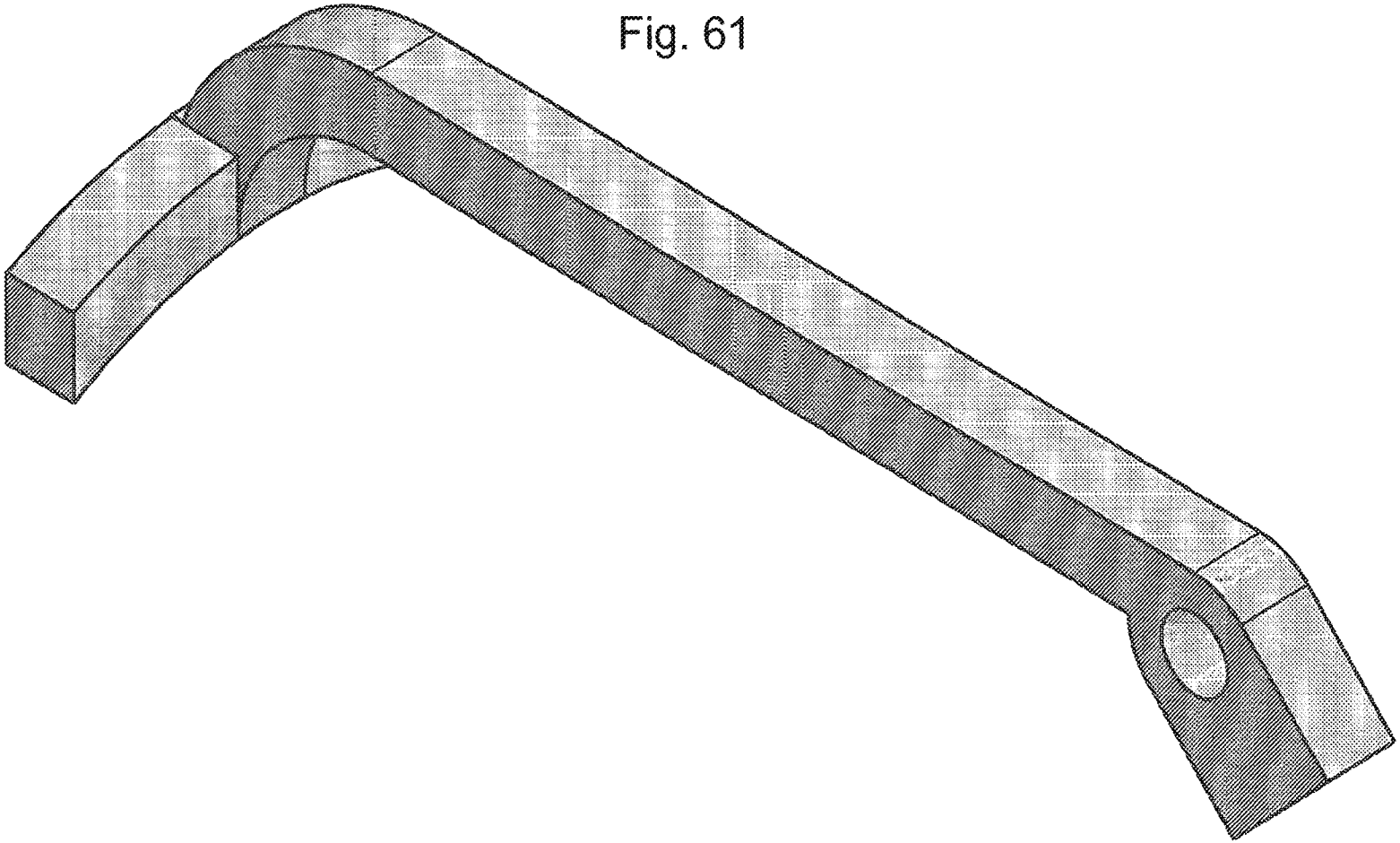
FIG. 61 illustrates an isometric view of the ejector.

FIG. 61 Ejector: is a lever that when hit (during reloading) knocks the remainder of the spent round out of the breach.

FIG. 68 Spring: returns the ejector back to its ready position.

FIG. 62 Frame Assembly: holds all of embodiment 1 together and connects to the hose.

FIG. 64 Frame: the main part, of the frame assembly.

Figure 65:
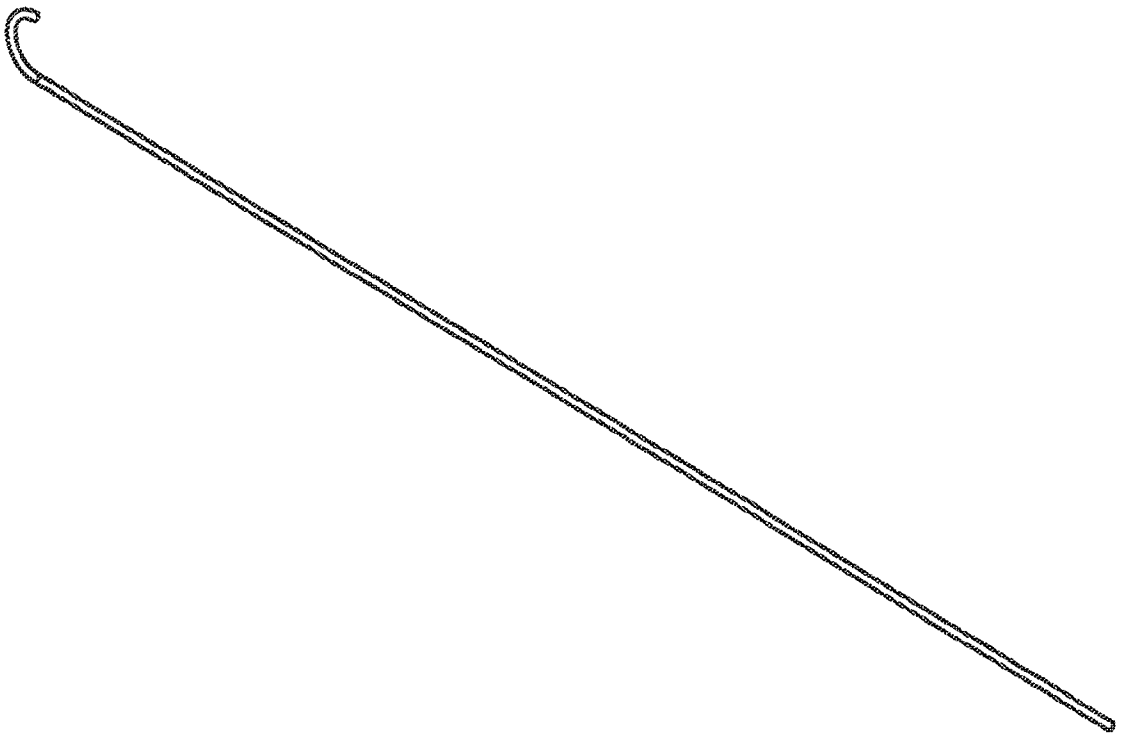
FIG. 65 illustrates an isometric view of the frame wire.
Figure 66:
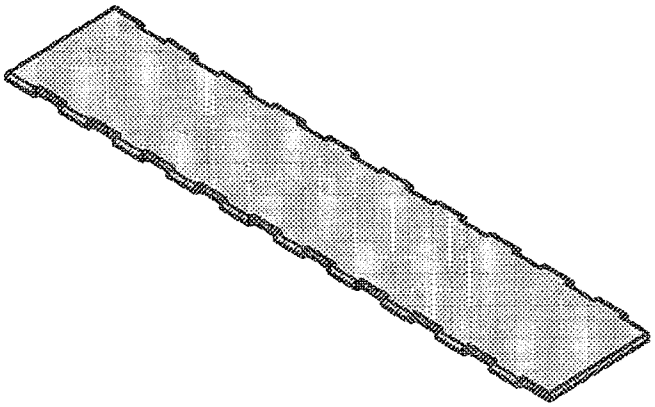
FIG. 66 illustrates an isometric view of the frame hatch.

FIG. 65 Frame Wire: holds the hatch and frame together, and is easily removed for maintenance.

FIG. 66 Frame Hatch: blocks most debris from entering the frame.

Figure 67:
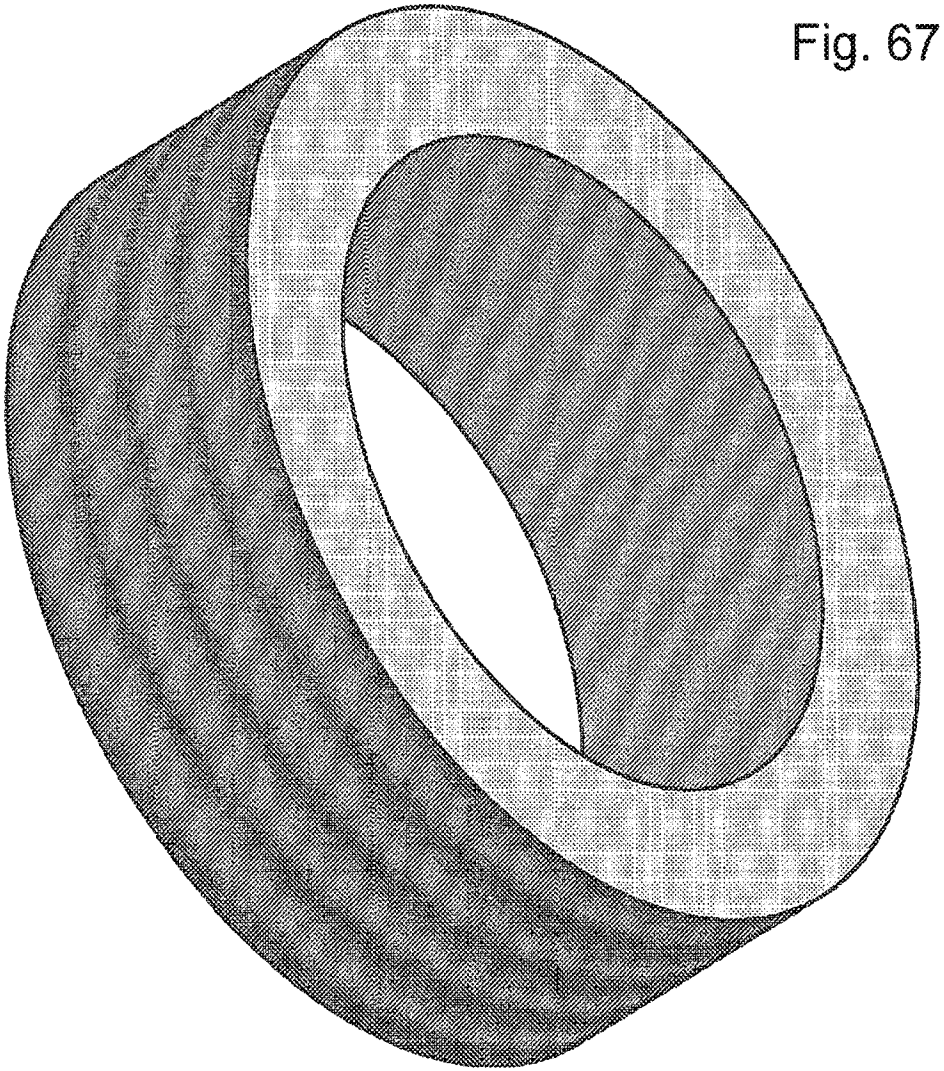
FIG. 67 illustrates an isometric view of the hose Adapter.
Figure 119:
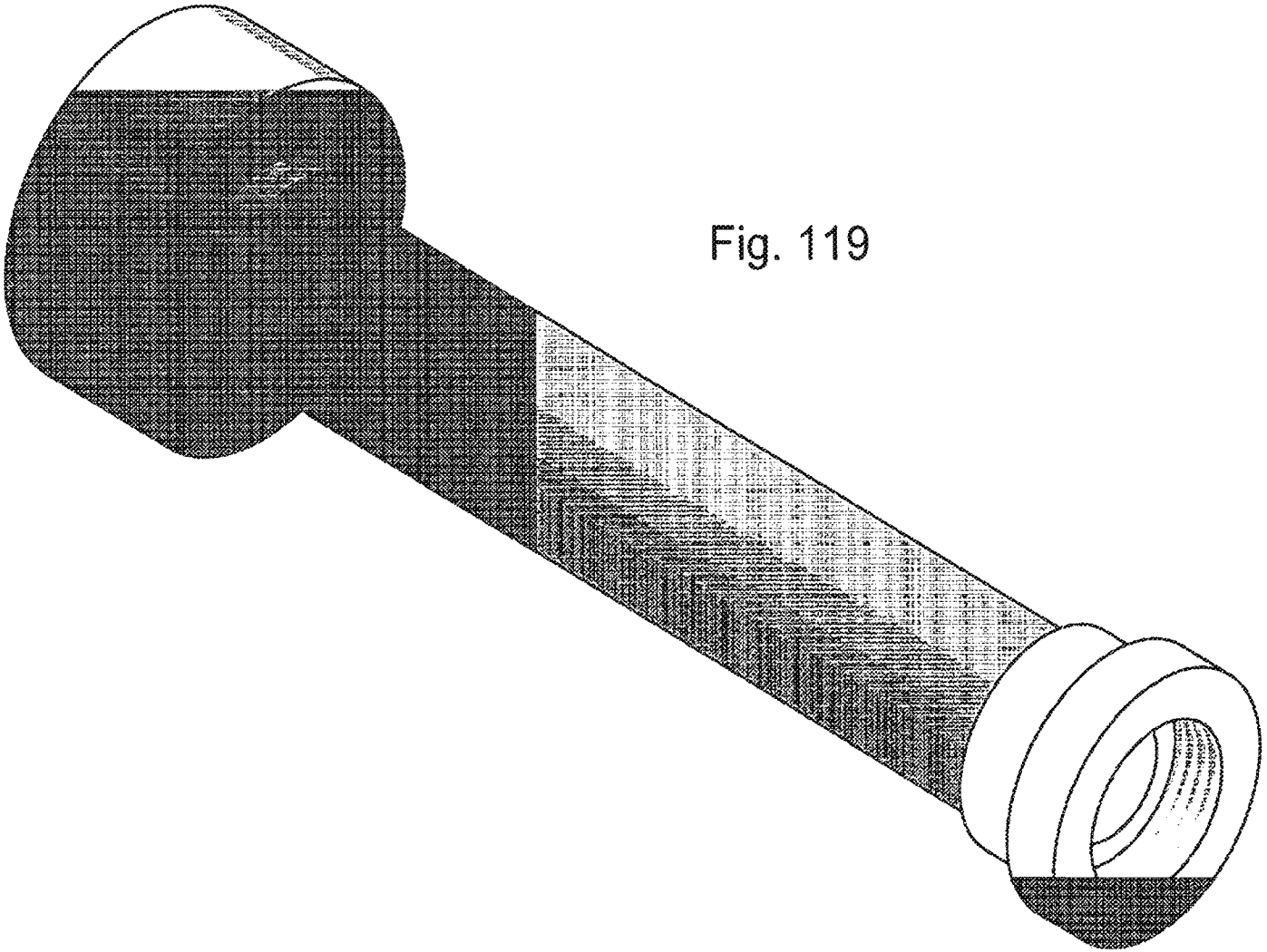
FIG. 119 illustrates an isometric view of the complete hose.

FIG. 67 Hose Adapter: connects GL.300 to FIG. 119 Hose.

First Embodiment—What the Parts are Made of

FIG. 6 Gate Assembly: various materials

FIG. 8 Gate: aluminum

FIG. 10 Gate Solenoid: various materials

FIG. 104 Round Casing Assembly: various materials

FIG. 105 Round Casing: a hard plastic such as PVC

FIG. 106 Round Propper Assembly: various materials

FIG. 108 Round Propper: a hard plastic such as PVC

FIG. 109 Rubber Band: silicone

FIG. 110 Round Propper Stopper: a hard plastic such as PVC

FIG. 112 Round Casing Rod: aluminum

FIG. 14 Gate Harness: a hard plastic such as PVC

FIG. 17 Gate Gear Assembly: various materials

FIG. 19 Gear Rod: aluminum

FIG. 21 Bearing Cap: a hard plastic such as PVC

FIG. 22 Ball Bearing: stainless steel

FIG. 25 Trigger Wheel: a hard plastic such as PVC

FIG. 26 Electric Motor Assembly: various materials

FIG. 28 Electric Motor: various materials

FIG. 25 Trigger Wheel: a hard plastic such as PVC

FIG. 29 Trigger Wheel Rod: aluminum

FIG. 30 Band One: silicone

FIG. 31 Front Motor Joist Assembly: various materials

FIG. 33 Front Motor Joist: a hard plastic such as PVC

FIG. 35 Front Motor Joist Hinge: a hard plastic such as PVC

FIG. 36 Rear Motor Joist Rod: aluminum and solder

FIG. 38 Batter: various materials

FIG. 39 Powered Barrel Assembly: various materials

FIG. 19 Gear Rod: aluminum

FIG. 25 Trigger Wheel: a hard plastic such as PVC

FIG. 21 Bearing Cap: a hard plastic such as PVC

FIG. 41 Barrel Gear: aluminum

FIG. 22 Ball Bearing: stainless steel

FIG. 42 Band Two: silicone

FIG. 26 Electric Motor Assembly: various materials

FIG. 28 Electric Motor: various materials

FIG. 25 Trigger Wheel: a hard plastic such as PVC or aluminum

FIG. 29 Trigger Wheel Rod: aluminum

FIG. 43 Front Motor Joist Left: a hard plastic such as PVC

FIG. 33 Front Motor Joist: a hard plastic such as PVC

FIG. 45 Front Motor Joist Rod: aluminum

FIG. 46 Front Motor Joist Hinge Left: a hard plastic such as PVC

FIG. 47 Front. Motor Joist Right: a hard plastic such as PVC

FIG. 33 Front Motor Joist: a hard plastic such as PVC

FIG. 45 Front Motor Joist Rod: aluminum

FIG. 49 Front Motor Joist Hinge Right: a hard plastic such as PVC

FIG. 50 Barrel Assembly: various materials

FIG. 52 Barrel: aluminum

FIG. 53 Wheel Assembly: a hard plastic such as PVC

FIG. 55 Wheel 2: a hard plastic such as PVC

FIG. 56 Wheel 1: a hard plastic such as PVC

FIG. 57 Barrel Sheath: a hard plastic such as PVC

FIG. 58 Ejector Assembly: various materials

FIG. 60 Ejector Holder: a hard plastic such as PVC

FIG. 61 Ejector: aluminum

FIG. 68 Spring: spring steel or some other material such as bronze or even plastic FIG. 62 Frame Assembly: various materials FIG. 64 Frame: a hard plastic such as PVC FIG. 65 Frame Wire: aluminum FIG. 66 Frame Hatch: a hard plastic such as PVC FIG. 67 Hose Adapter: a hard plastic such as PVC

Second Embodiment Assembly

Figure 76:
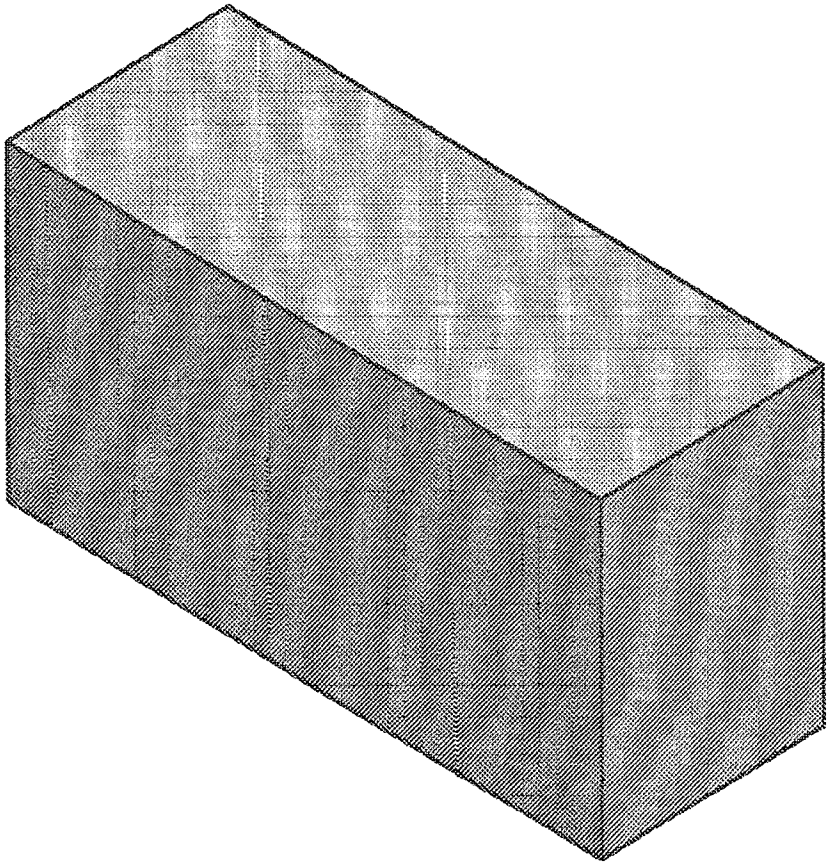
FIG. 76 illustrates an isometric view of the latch.
Figure 78:
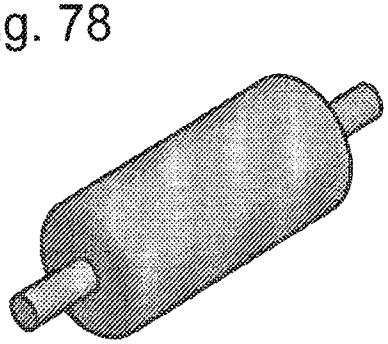
FIG. 78 illustrates an exploded view of the roller assembly.
Figure 77:
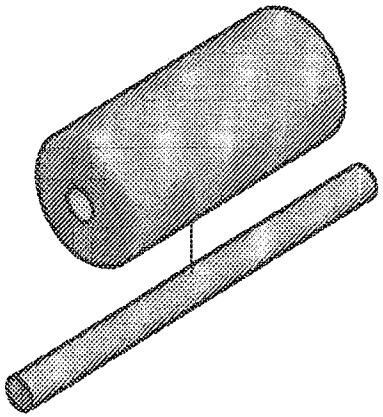
FIG. 77 illustrates an assembled isometric view of the roller assembly.
Figure 79:
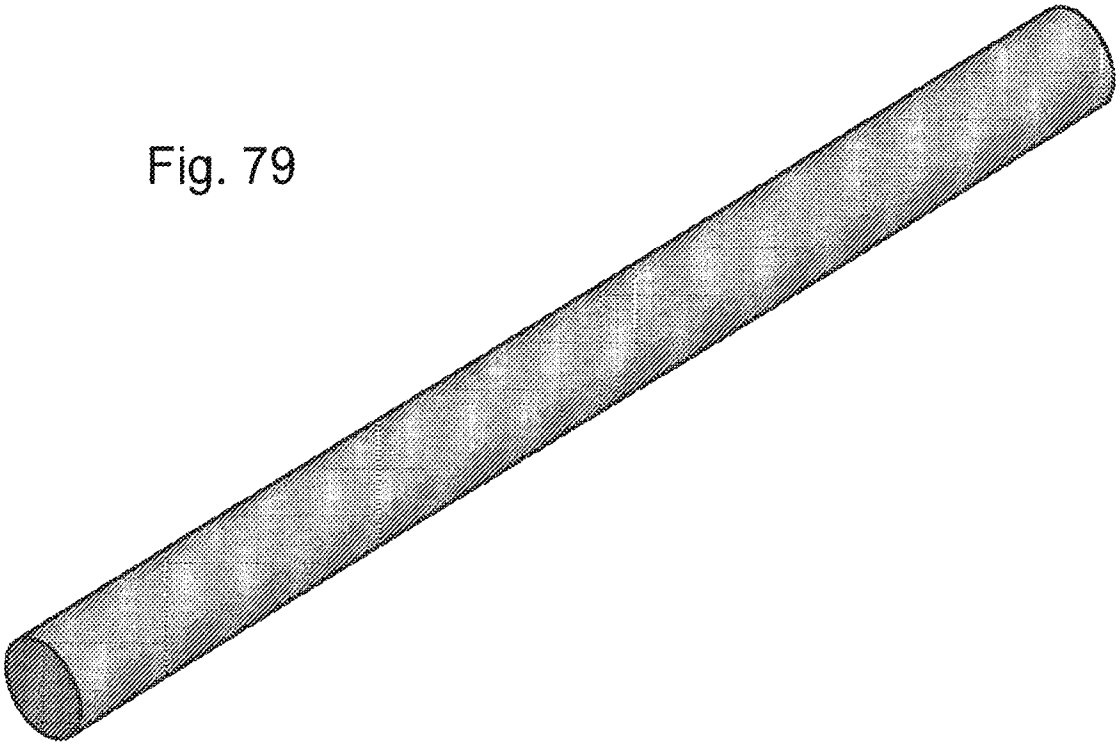
FIG. 79 illustrates an isometric view of the roller rod.
Figure 81:
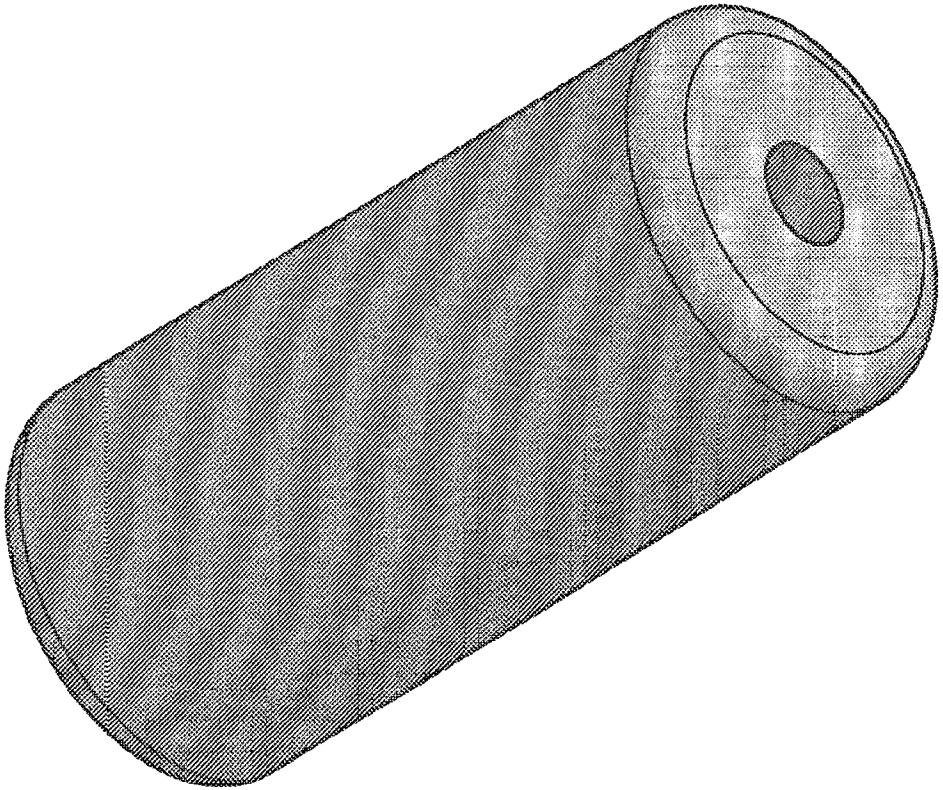
FIG. 81 illustrates a side view of the roller.
Figure 80:
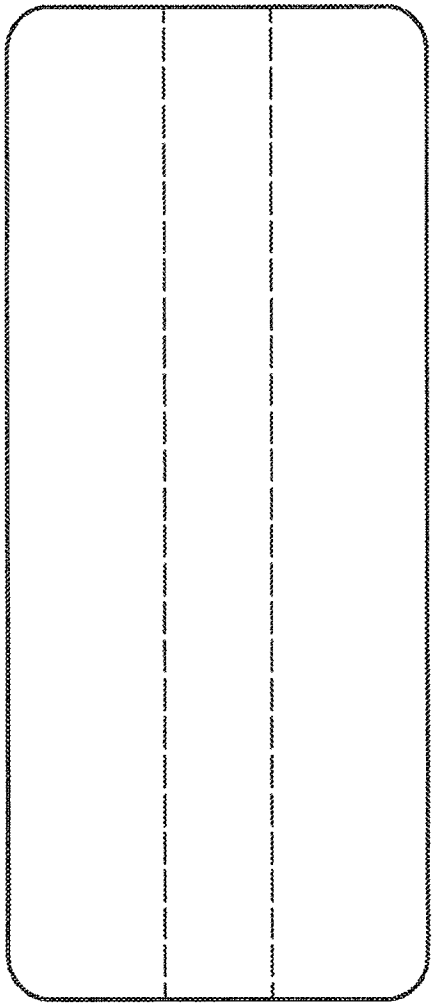
FIG. 80 illustrates an isometric view of the roller.
Figure 82:
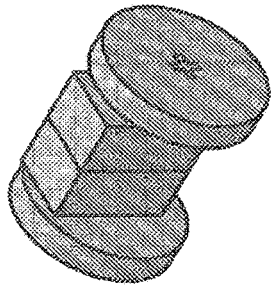
FIG. 82 illustrates an isometric, assembled view of the motor assembly.
Figure 83:
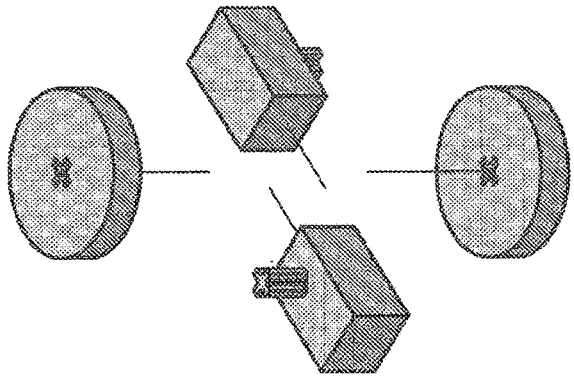
FIG. 83 illustrates an exploded view of the motor assembly.
Figure 87:
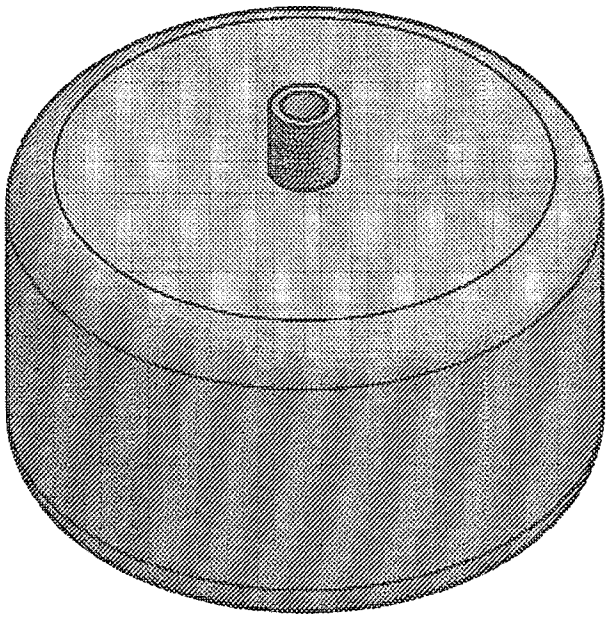
FIG. 87 illustrates an isometric view of the air tank.
Figure 88:
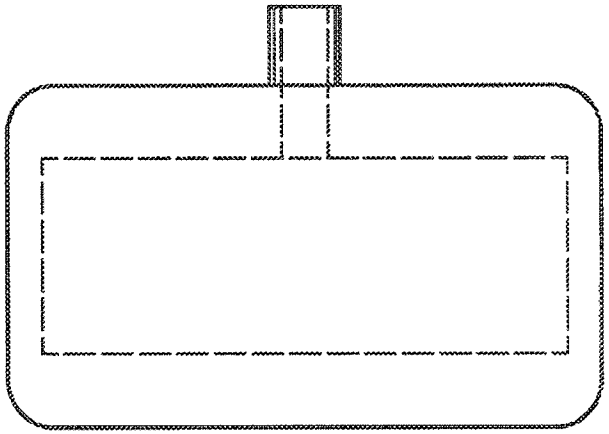
FIG. 88 illustrates a side view of the air tank.
Figure 96:
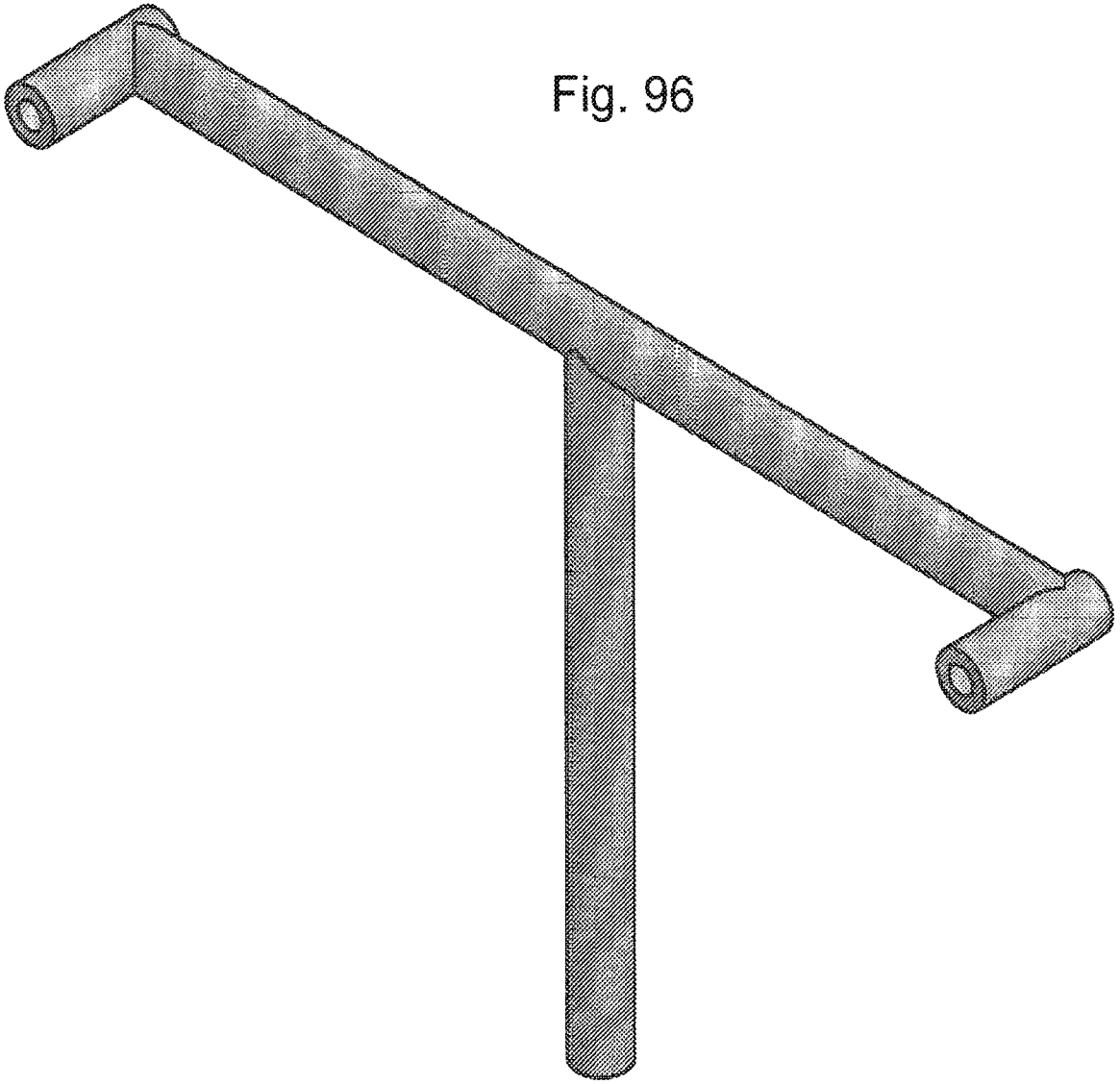
FIG. 96 illustrates an isometric view of the tube.
Figure 97:
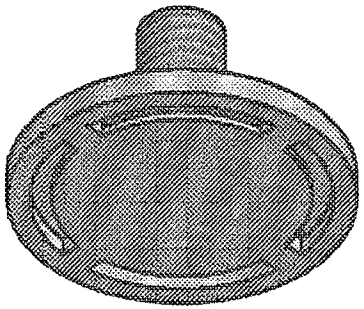
FIG. 97 illustrates an isometric view of the funnel.
Figure 98:
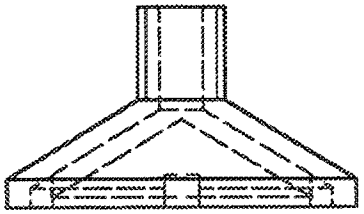
FIG. 98 illustrates a side view of the funnel.
Figure 102:
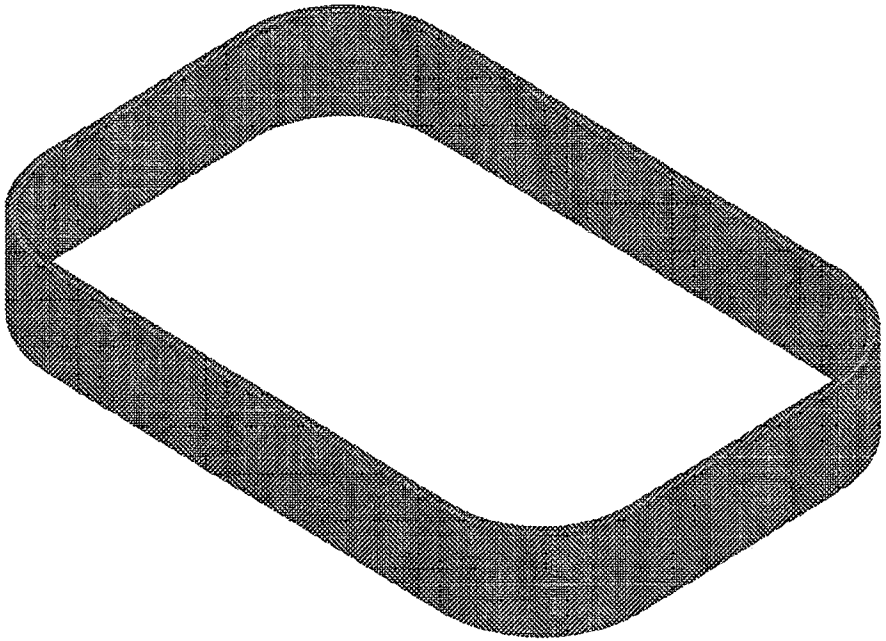
FIG. 102 illustrates an isometric view of the motor belt.
Figure 103:
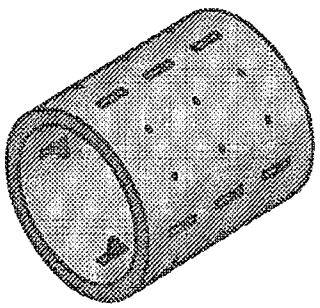
FIG. 103 illustrates an assembly view of the round casing.
Figure 113:
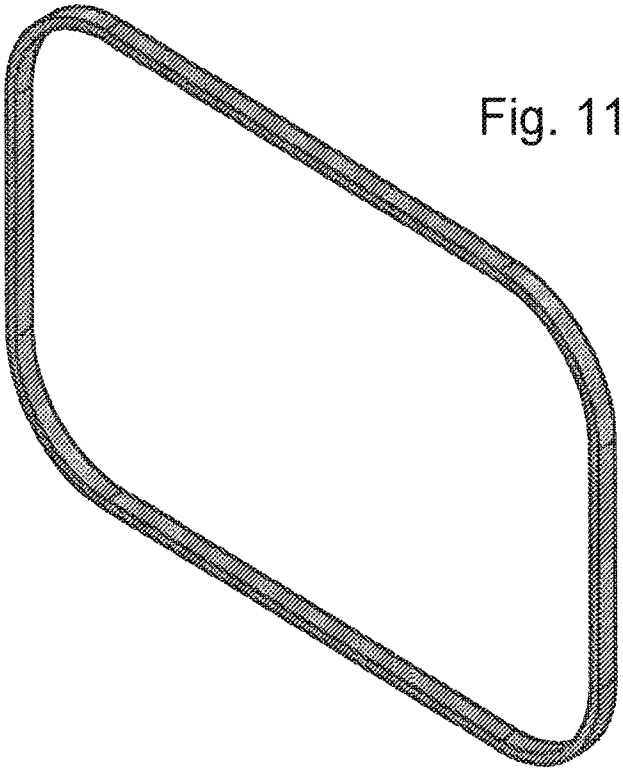
FIG. 113 illustrates an isometric view of the chain.

Roller Assembly FIG. 77 is comprised of Roller Rod FIG. 79 and Roller FIG. 80. Roller Rod FIG. 79 goes in the hole of Roller FIG. 80 and holds Roller FIG. 80 in place in the twelve slots that are part, of Turtle Shell FIG. 72. Motor Assembly FIG. 82 is comprised of Belt Motor FIG. 84 and Belt Motor Gear FIG. 85. The motor powers the gear. Protrusions of the gear are not shown in the drawing. There are four of each part in the overall assembly of the Turtle. There is space for each part to fit, and there are two pairs of motor assemblies. One is on top and one is on the bottom. The pairs meet back-to-back in the Turtle Shell FIG. 72. Two batteries power the whole invention. They are located within the Turtle Shell FIG. 72 and are connected to all electric parts by wires (not shown in drawings). Air Tank FIG. 87 is centrally located within the Turtle Shell FIG. 72 with its nozzle poking out. There are two CPUs in the Turtle, and they located within the Turtle Shell FIG. 72. A Cover FIG. 90 holds everything inside the Turtle and attaches to Turtle Shell FIG. 72 (on four sides) with 6 or more Latches FIG. 76 are arranged as so: one on top, one on bottom, two on each side, and all are evenly spaces between the two rounded corners of their corresponding sides. The Latches FIG. 76 on the longer sides sit at ⅓ and ⅔ of the overall length. Regulator FIG. 91 attaches directly to the Air Tank FIG. 87 with its side extrusion facing up toward a Tube Assembly FIG. 93. The Tube Assembly FIG. 93 consists of Tube Head FIG. 95, Tube FIG. 96, Funnel FIG. 97, and Automatic Valve FIG. 99. Tube Head FIG. 95 connects regulator. Tube Head FIG. 95 also connects Tube FIG. 96 to Funnel FIG. 97. Tube Head FIG. 95 twists on and off and it has grips on the outside (not shown in drawings). Tube FIG. 96 is T-shaped and attaches to all three Tube Heads FIG. 95. Funnel FIG. 97 is magnetically attached to the Cover FIG. 90 and aligns flush with the Cover FIG. 90. Automatic Valve FIG. 99 attaches on each end to Tube FIG. 96 with its bulging side facing toward the backside of the Turtle. Ammo Belt FIG. 100 is the most complicated assembly to explain. Motor Belt FIG. 102 is connected to all twenty Round Casing Assemblies and a type of gear-based Chain FIG. 113 (gear grips not shown in drawings). Chain FIG. 113 is where the Belt Motor Gears FIG. 85 contact and the Chain FIG. 113 as permanently attached to the Belt FIG. 101. The Chain FIG. 113 and the Motor Belt FIG. 102 are both made of a very flexible material. Round Casing Assembly FIG. 104 has an even smaller assembly in it called Round Propper Assembly FIG. 101. The Round Propper Assembly FIG. 105 is comprised of Round Propper FIG. 108, Rubber Band FIG. 109 and Round Propper Stopper FIG. 101. The Round Propper FIG. 108 is attached to Round Casing FIG. 105 with FIG. 112 a Round Casing Rod. On the rear-facing side of the Round Propper Assembly FIG. 106 is the Round Propper Stopper FIG. 110. The Round Propper Stopper FIG. 110 fits snugly between Round Casing Assembly FIG. 106 and Round Propper FIG. 108. The Rubber Band fits between two holes in other two parts of the Round Propper Assembly FIG. 106 (Round Propper FIG. 108 and Round Propper Stopper FIG. 110). The Round Casing Rod FIG. 112 is inserted into the Round Casing. Door Assembly FIG. 131 is placed at the top of the Turtle Shell FIG. 72 through small slits. There is a Door FIG. 115 and Door Magnets FIG. 116. They are attached with screws (not shown). Magazine Magnets FIG. 117 are the final pieces of the Turtle. They are located just below the Door Magnets FIG. 116 and screw into the Turtle Shells FIG. 72.

Operation—Second Embodiment

Figure 99:
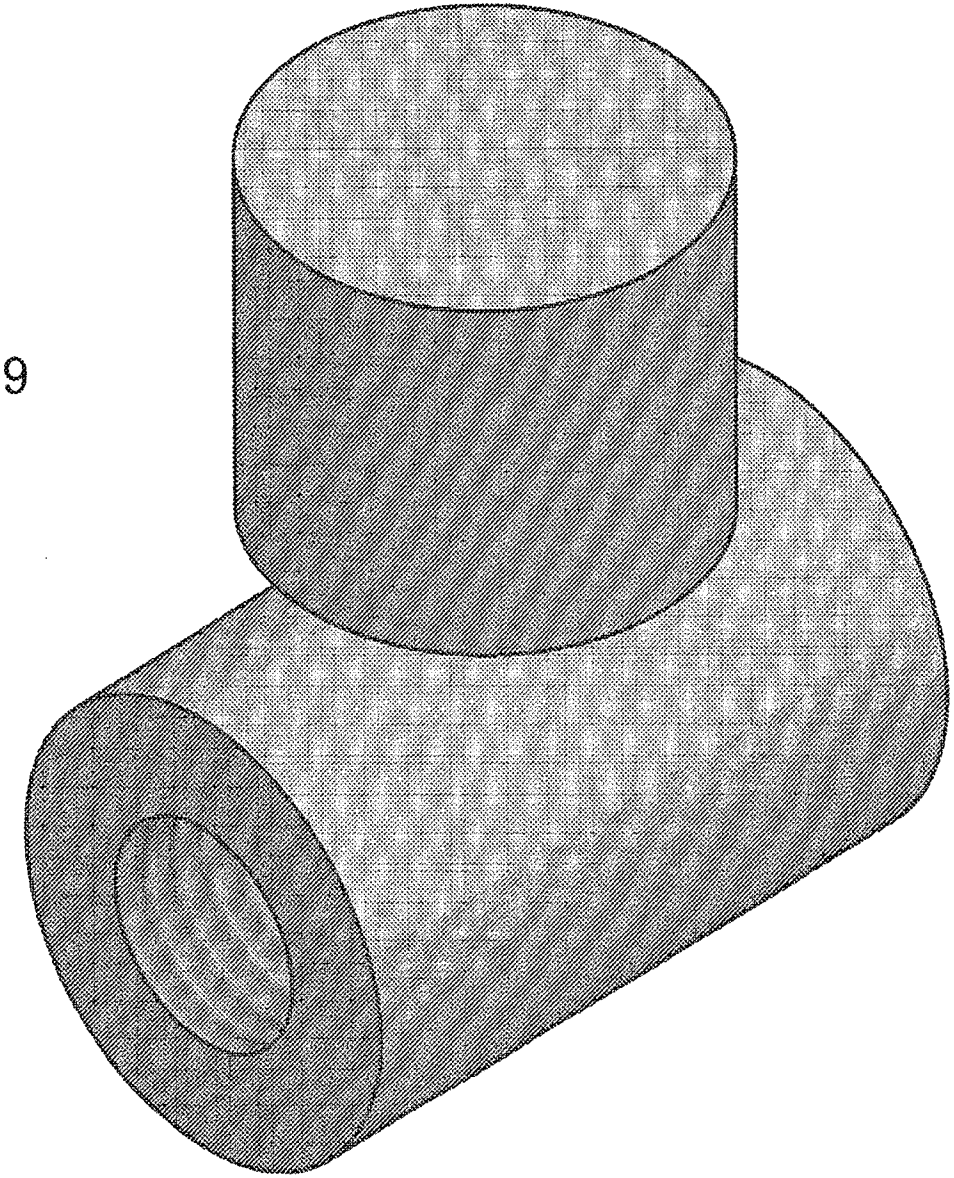
FIG. 99 illustrates an isometric view of the automatic valve.
Figure 100:
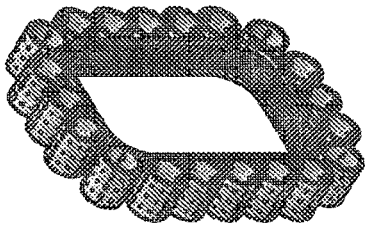
FIG. 100 illustrates an isometric view of the ammo belt.
Figure 101:
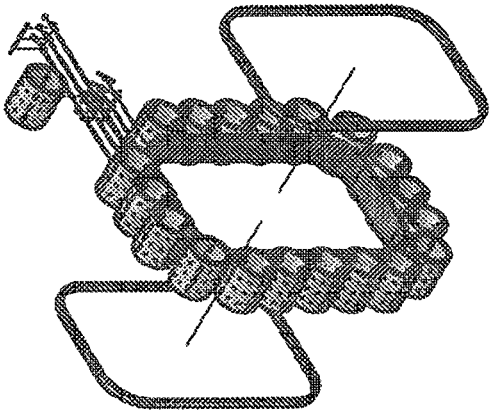
FIG. 101 illustrates a partially exploded isometric view of the ammo belt.

When the weapon fires, Automatic Valve FIG. 99 opens on the side that, the hose is attached to. This launches a round through a Hose FIG. 119 to the GL300 FIG. 1. Then Beit Motor FIG. 84 engages to move Ammo Belt FIG. 100 to allow for the next launching of a round. When the operator intends to change hands of the GL300 FIG. 1, he must, make sure that he is leaning back (even if slightly—to prevent, a round from falling out), disconnect Magazine Side Adapter FIG. 121, remove Hose H, remove Door Assembly FIG. 114, attach Hose H to other side of Turtle Shell FIG. 72, and Insert Door Assembly FIG. 114 to previously-used side of Turtle Shell FIG. 72.

Second Embodiment Function

Figure 69:
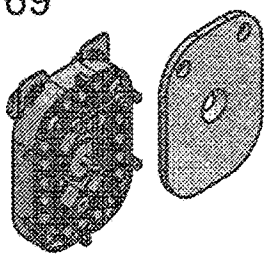
FIG. 69 illustrates an assembled view of a turtle (commonly known as a magazine).
Figure 70:
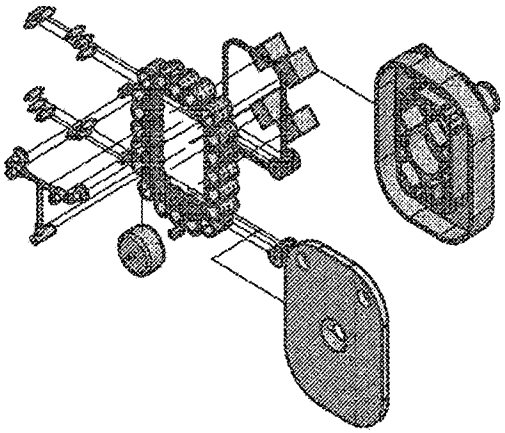
FIG. 70 illustrates an exploded isometric view of the turtle.
Figure 71:
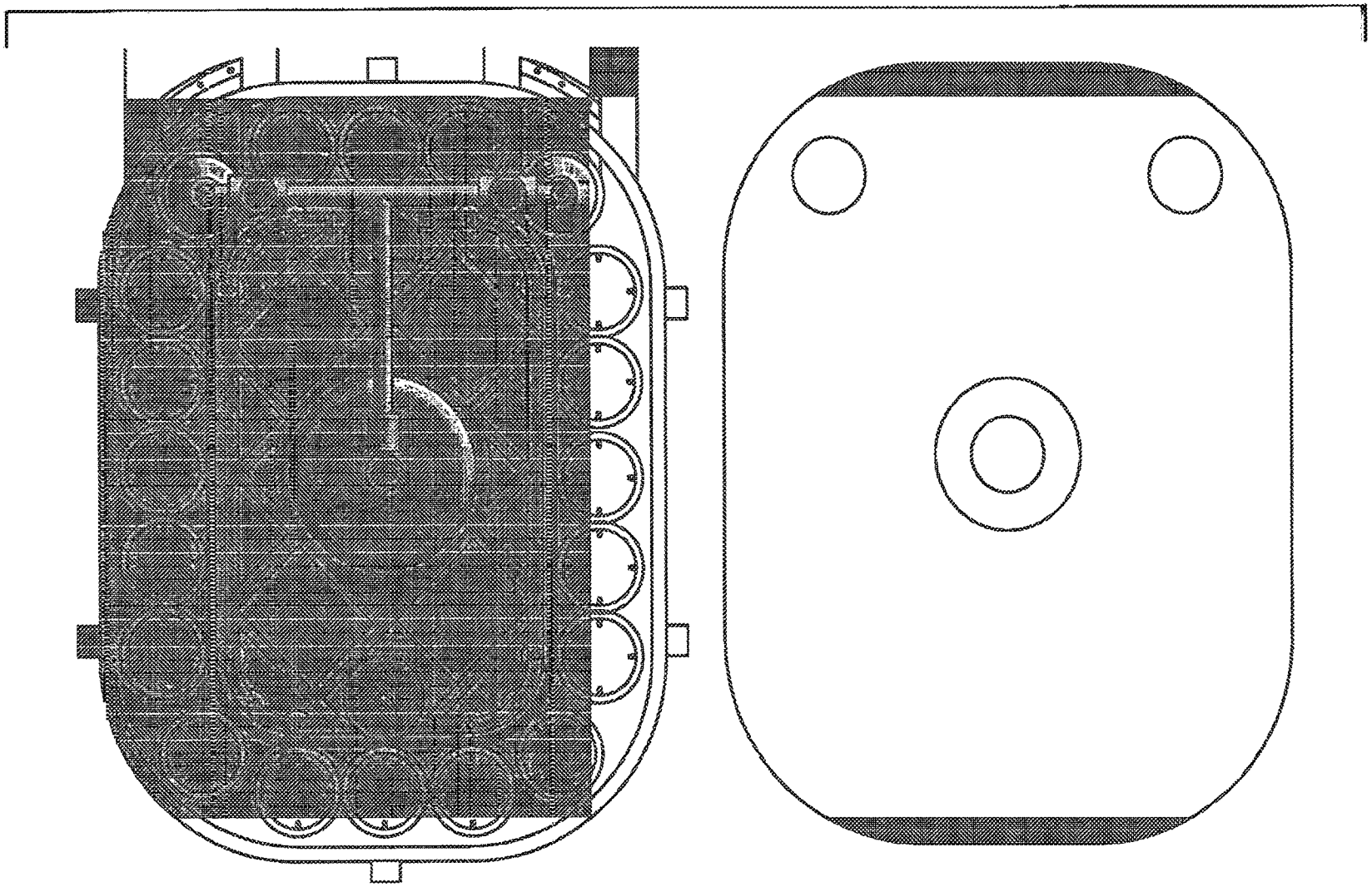
FIG. 71 illustrates a rear view of the assembled turtle with cover (FIG. 90) off to the side.

FIG. 69 Turtle—Ammunition Bearing Backpack.

Figure 72:
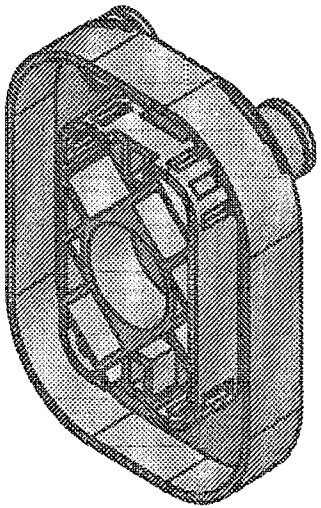
FIG. 72 illustrates an isometric view of the turtle shell.
Figure 75:
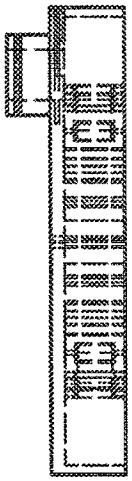
FIG. 75 illustrates a side view of the turtle shell.
Figure 73:
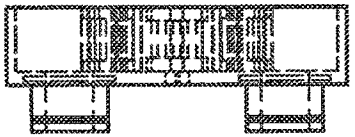
FIG. 73 illustrates a top view of the turtle shell.
Figure 74:
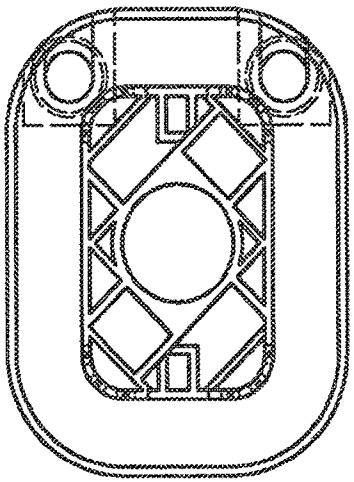
FIG. 74 illustrates a rear view of the turtle shell.

FIG. 72 Turtle Shell: holds the Turtle together and (along with cover) protects what is inside of it.

FIG. 76 Latch: holds cover and turtle shell together; preventing everything from falling out of the Turtle Shell.

FIG. 77 Roller Assembly: works like a rolling pin that one would use for baking.

FIG. 79 Roller Rod: allows the roller to rotate.

FIG. 80 Roller: contacts the belt and allows it to rotate.

FIG. 82 Motor Assembly: gives movement to the Turtle.

Figure 84:
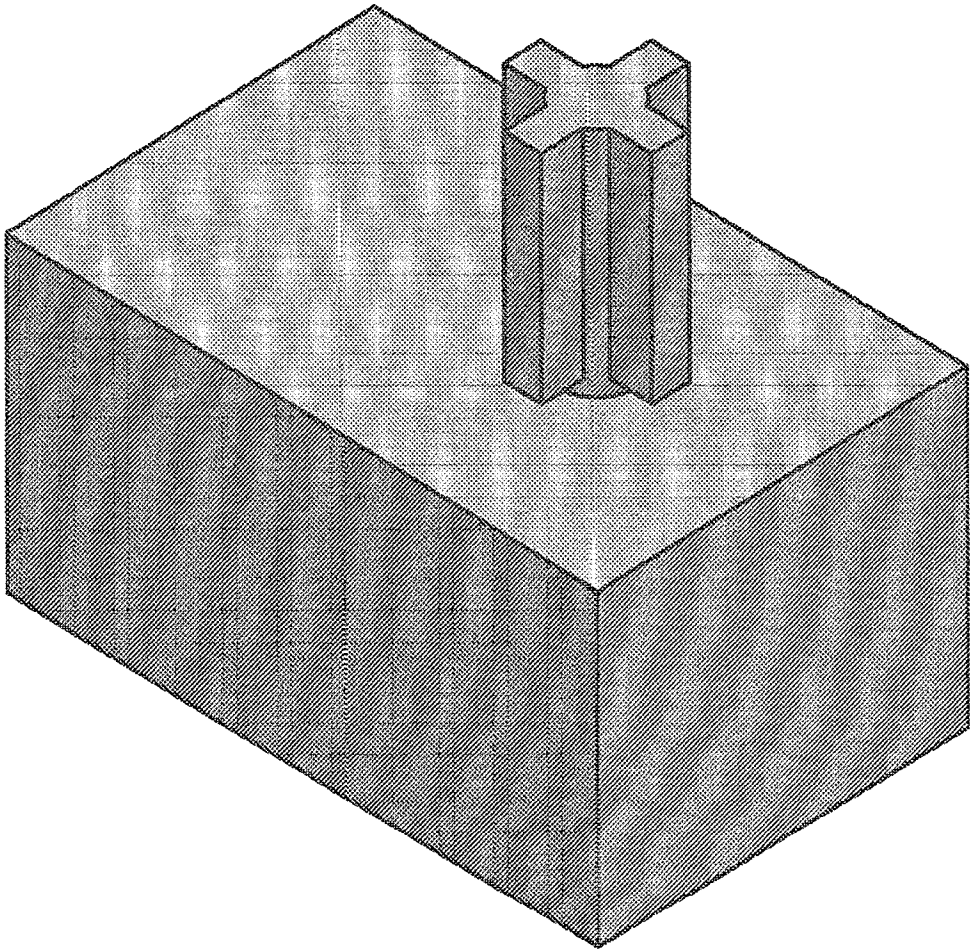
FIG. 84 illustrates an isometric view of the belt motor.

FIG. 84 Belt Motor: moves movement to the belt motor gear.

Figure 85:
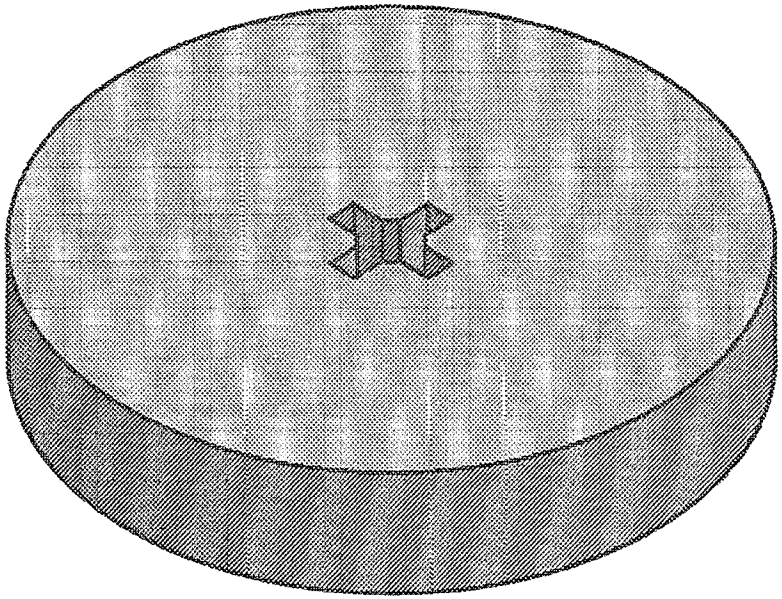
FIG. 85 illustrates an isometric view of the belt motor gear.

FIG. 85 Belt Motor Gear: spins the belt.

Figure 86:
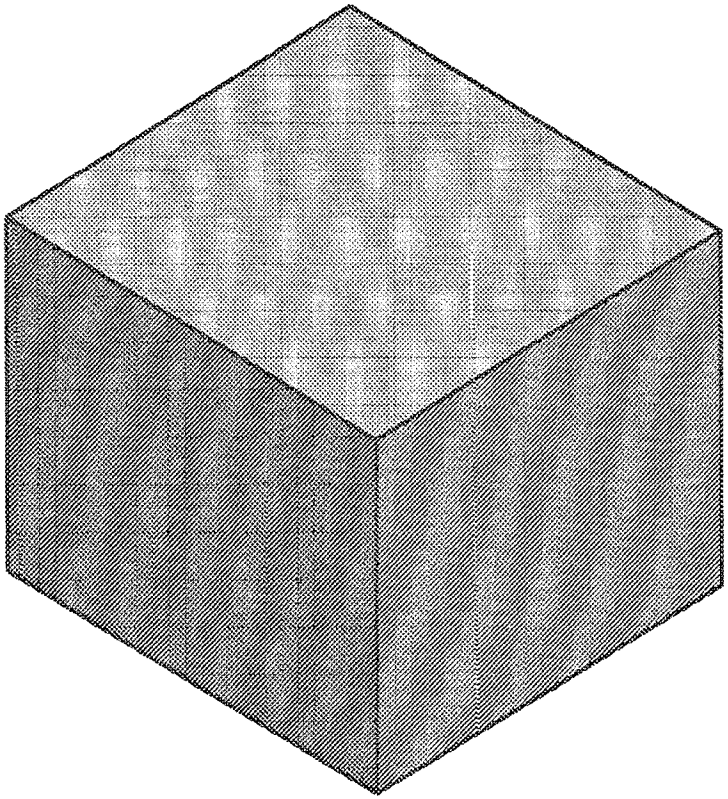
FIG. 86 illustrates an isometric view of the battery.

FIG. 86 Battery: powers the Turtle.

FIG. 87 Air Tank: holds the compressed air needed to launch rounds from round casing to barrel.

Figure 89:
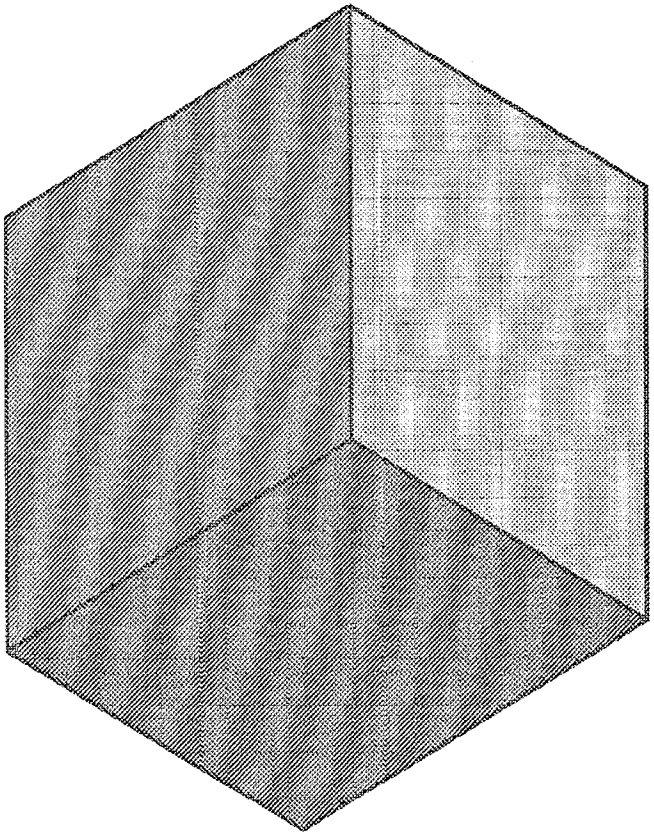
FIG. 89 illustrates an isometric view of the CPU.

FIG. 89 CPU: controls all components (with the right programming). One is for the invention and one is for communicating with a targeting drone.

Figure 90:
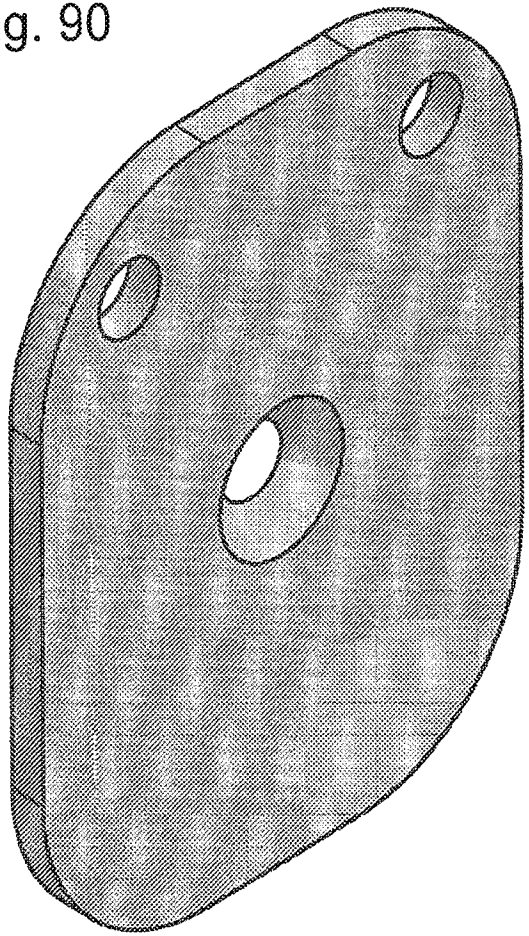
FIG. 90 an isometric view of the cover.

FIG. 90 Cover: connects to cover with latch and helps to hold everything in place.

Figure 91:
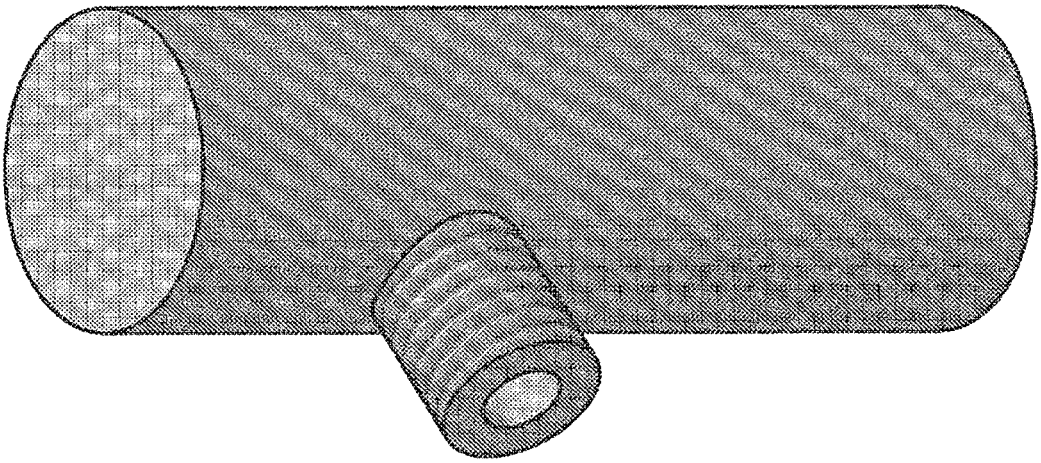
FIG. 91 illustrates an isometric view of a regulator.
Figure 92:
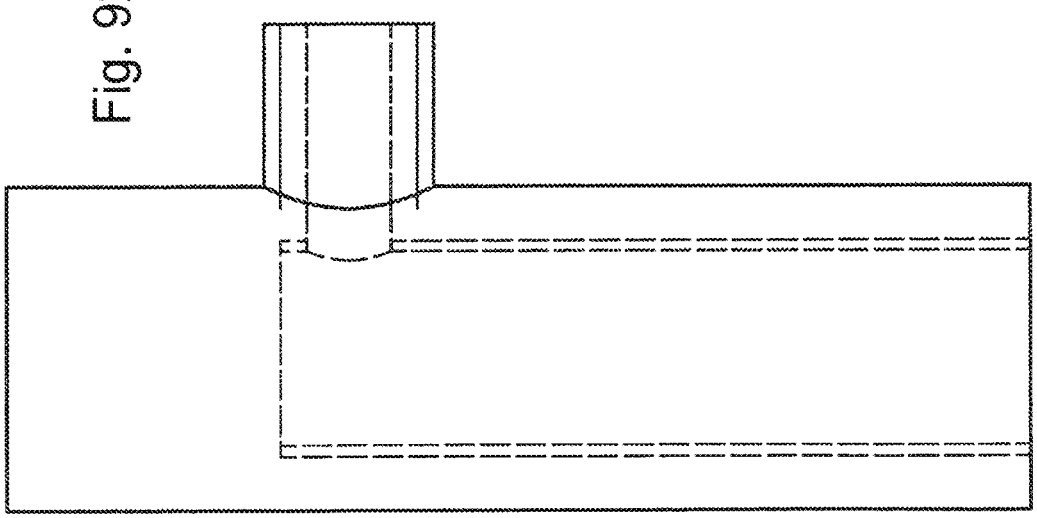
FIG. 92 illustrates a side view of a regulator.
Figure 94:
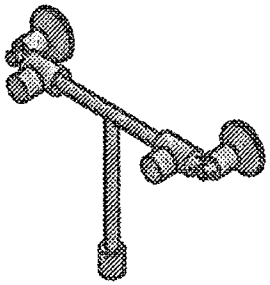
FIG. 94 an isometric view of the tube assembly.

FIG. 91 Regulator: keeps the air pressure consistent

Figure 93:
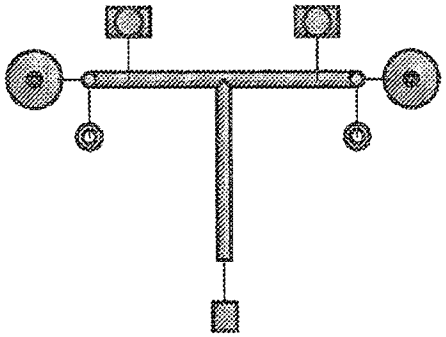
FIG. 93 illustrates an exploded rear view of the tube assembly.

FIG. 93 Tube Assembly: channels air from regulator to the back of rounds to aid in loading rounds.

Figure 95:
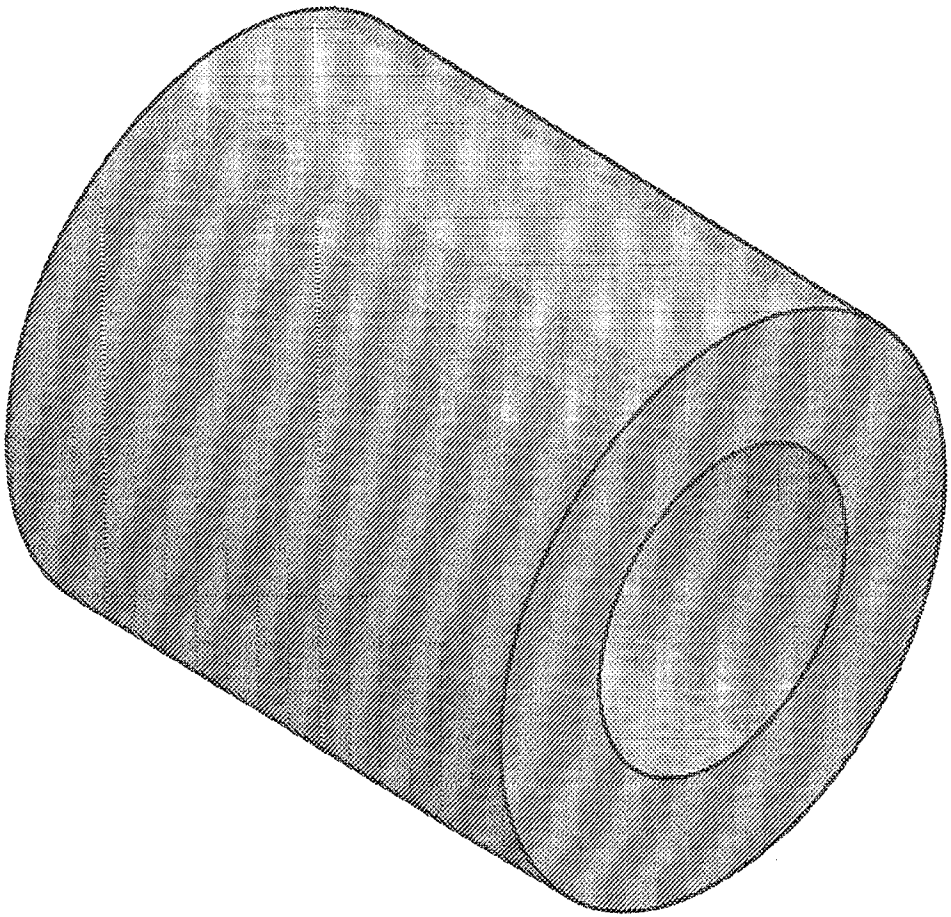
FIG. 95 illustrates an isometric view of the tube head.

FIG. 95 Tube Head: screws regulator to tube and tube to funnel there are three.

FIG. 96 Tube: holds air and air passes through it from regulator to funnel.

FIG. 97 Funnel: allows pressurized air to pass through it, and spreads the air out to prevent and misfire.

FIG. 99 Automatic Valve: turns air flow on and off.

FIG. 100 Ammo Belt: holds rounds to be fired.

FIG. 102 Motor Belt: holds round casing and rotates around turtle shell when needed.

FIG. 104 Round Casing Assembly: holds rounds and connects to belt with Velcro.

FIG. 105 Round Casing: the frame of FIG. 123 thru FIG. 129.

FIG. 106 Round Propper Assembly: holds the round in place.

FIG. 108 Round Propper: holds a round in place to avoid noise.

FIG. 109 Rubber Band: returns the round propper to an upright position.

FIG. 110 Round Propper Stopper: keeps the round propper from extending too far back.

FIG. 112 Round Casing Rod: holds the round propper in place.

FIG. 113 Chain: connects belt motor gear to belt.

Figure 114:
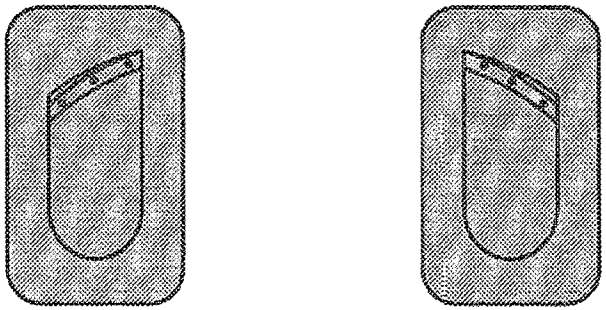
FIG. 114 illustrates an assembly view of the door assembly.
Figure 115:
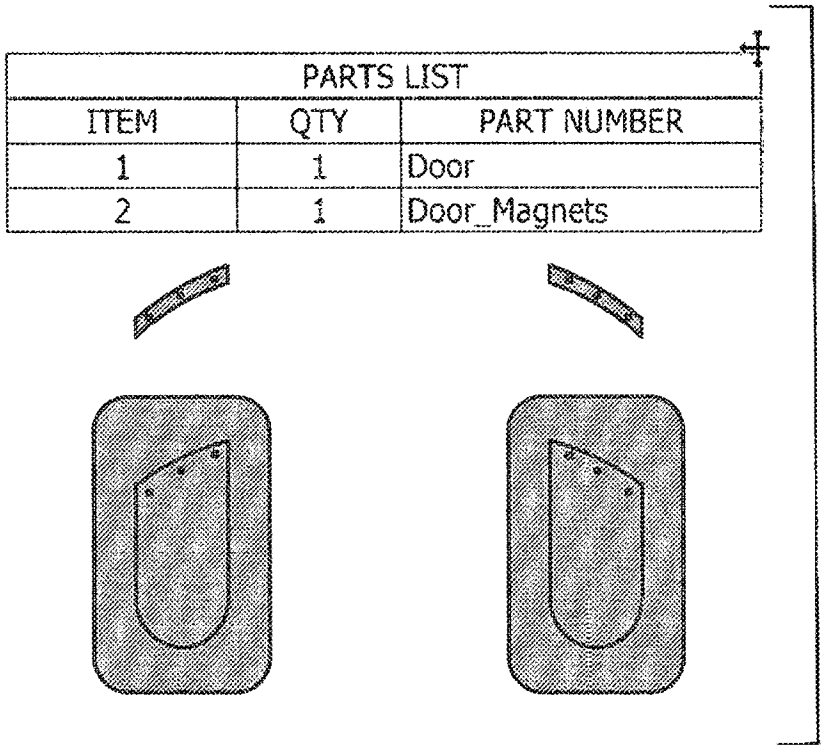
FIG. 115 illustrates an exploded view of the door.

FIG. 114 Door Assembly: keeps rounds from falling out when they are not needed.

Figure 116:
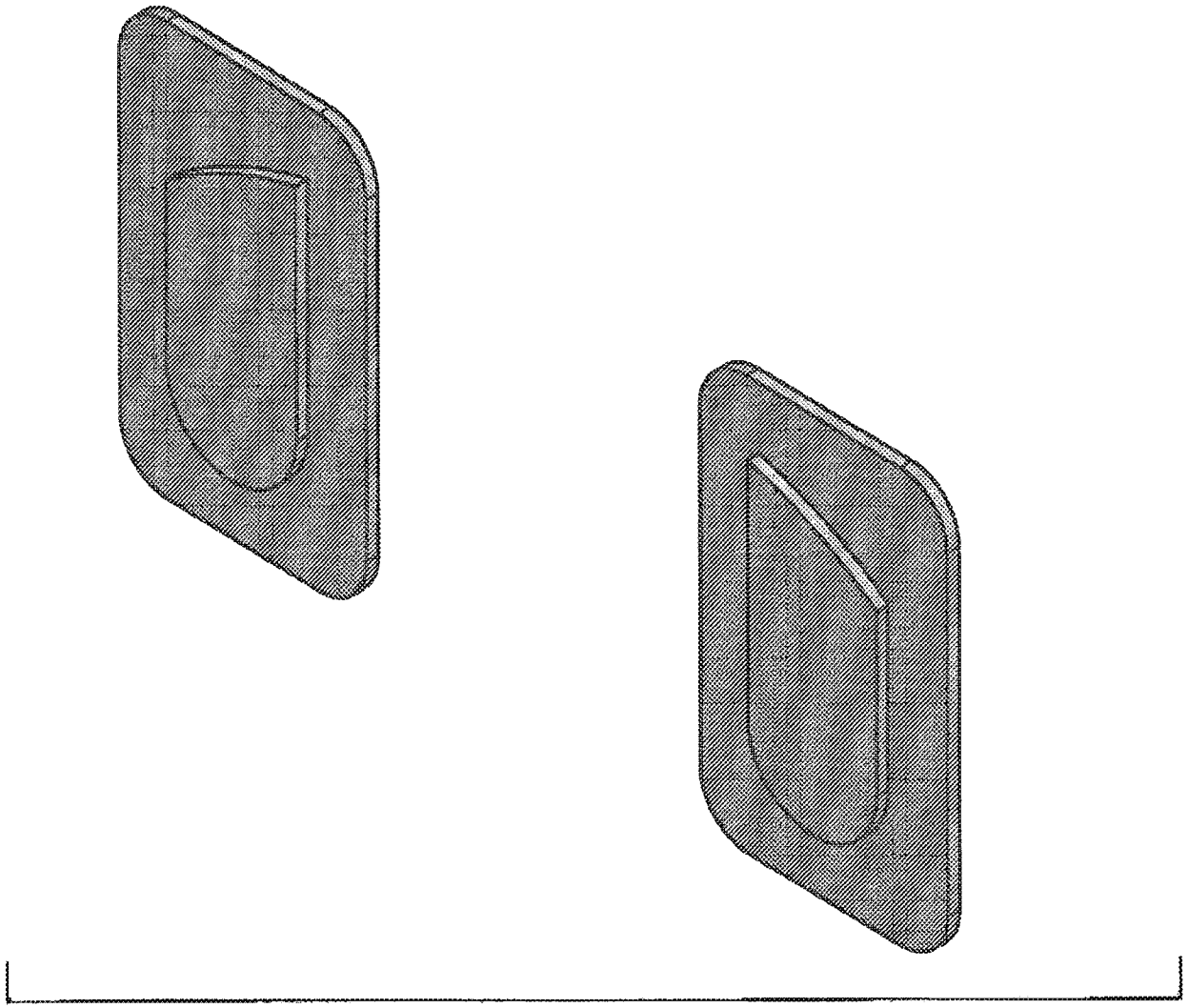
FIG. 116 illustrates an isometric view of the door.
Figure 117:
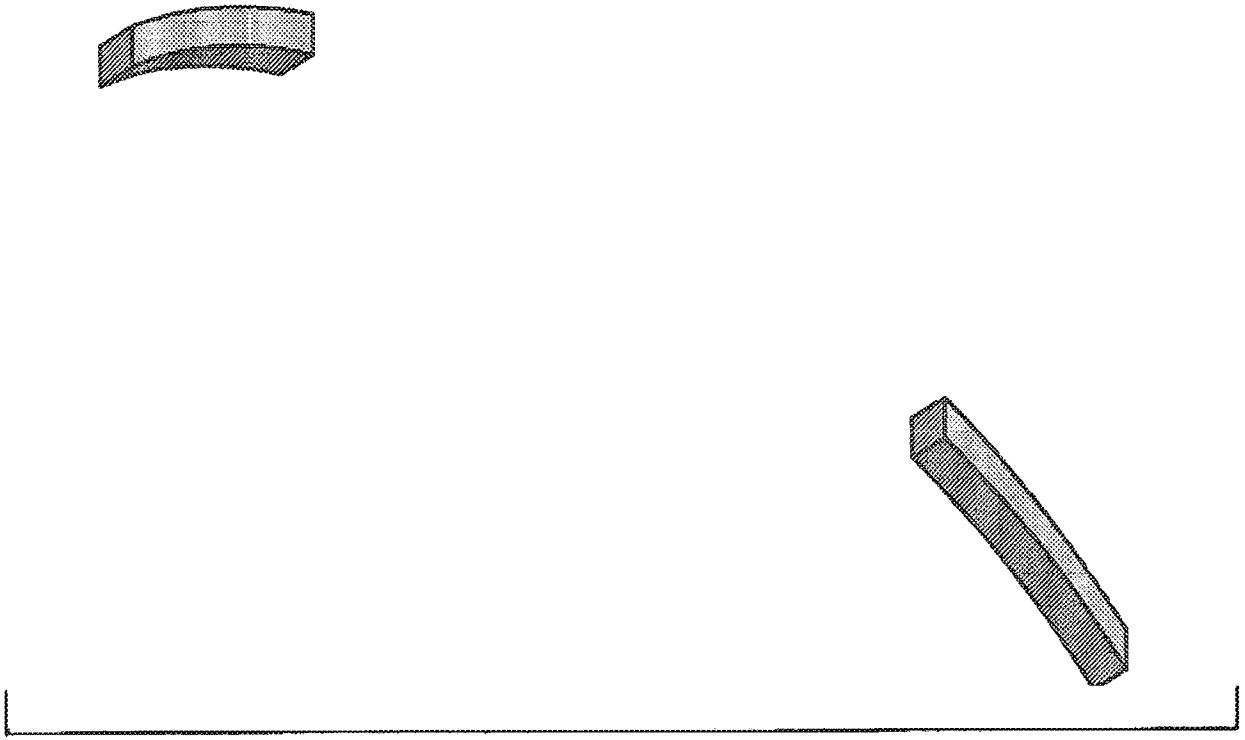
FIG. 117 illustrates an isometric view of the door magnets.

FIG. 116 Door: keeps the rounds from falling out when they are not needed.

FIG. 117 Door Magnets: holds door in place when it is in use.

Figure 118:
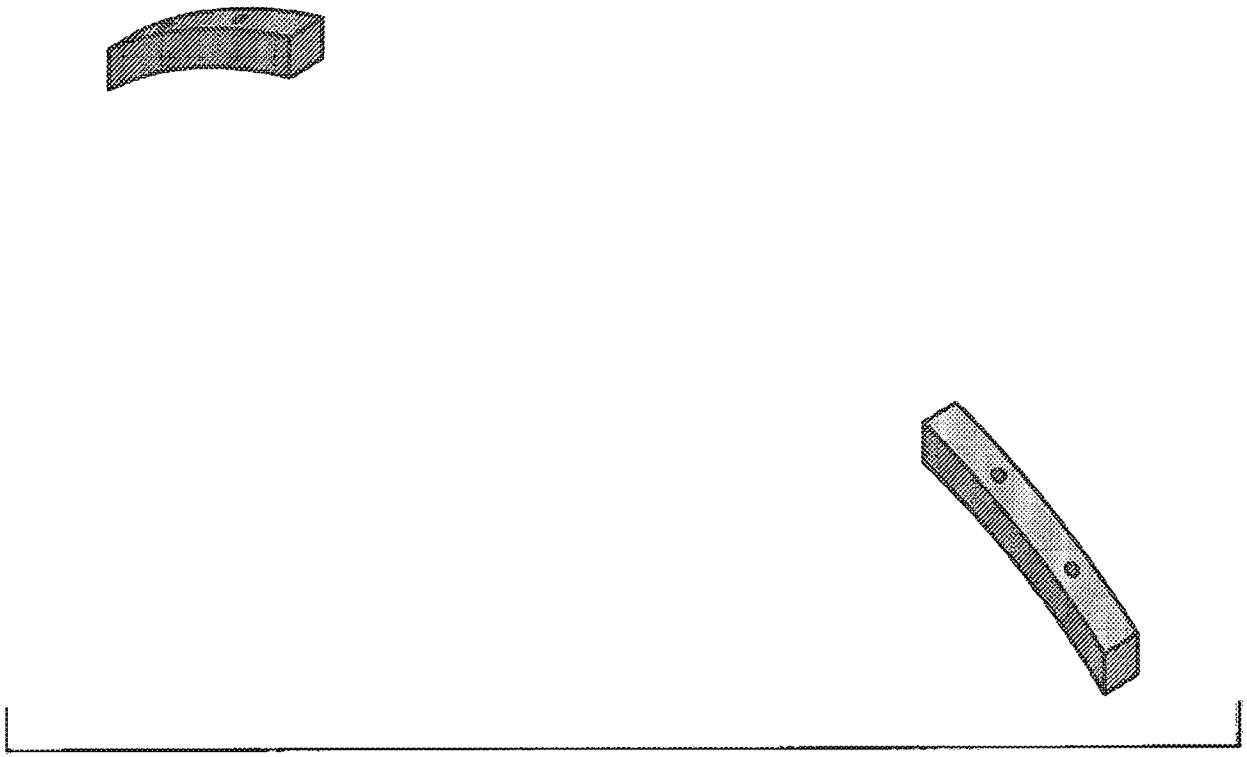
FIG. 118 illustrates an isometric view of the magazine magnet.

FIG. 118 Magazine Magnets: connects door assembly to turtle shell.

Second Embodiment—What the Parts are Made of

FIG. 69 Turtle: various materials

FIG. 72 Turtle: a hard plastic such as PVC

FIG. 76 Latch: plastic and aluminum or stainless steel

FIG. 77 Roller Assembly: aluminum

FIG. 79 Roller Rod: aluminum

FIG. 80 Roller: aluminum

FIG. 82 Motor Assembly: various materials

FIG. 84 Belt Motor: silicone

FIG. 85 Belt Motor Gear: a hard plastic such as PVC

FIG. 86 Battery: various materials

FIG. 87 Air Tank: carbon fiber or aluminum

FIG. 89 CPU: various materials

FIG. 90 Cover: a hard plastic such as PVC

FIG. 91 Regulator: various materials

FIG. 93 Tube Assembly: various materials

FIG. 95 Tube Head: aluminum

FIG. 96 Tube: various materials to include stainless steel threading

FIG. 97 Funnel: aluminum

FIG. 99 Automatic Valve: various materials

FIG. 100 Ammo Belt: various materials

FIG. 102 Motor Belt: silicone

FIG. 104 Round Casing Assembly: various materials

FIG. 105 Round Casing: a hard plastic such as PVC

FIG. 106 Round Propper Assembly: various materials

Figure 120:
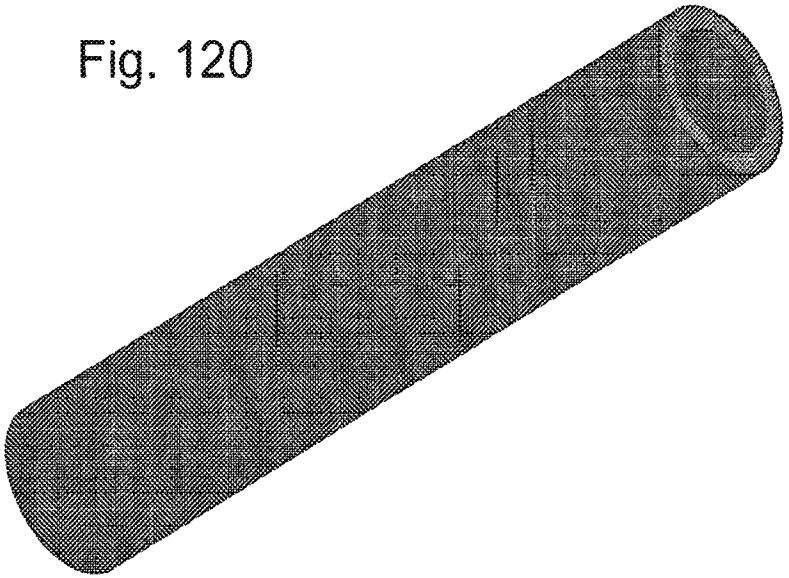

FIG. 108 Round Propper: a hard plastic such as PVC or a metal that won't scratch the round FIG. 109 Rubber Band: silicone FIG. 110 Round Propper Stopper: a hard plastic such as PVC FIG. 112 Round Casing Rod: aluminum FIG. 113 Chain: aluminum FIG. 114 Door Assembly: various materials FIG. 116 Door: a hard plastic such as PVC FIG. 117 Door Magnets: various materials such as iron and nickel FIG. 118 Magazine Magnets: various materials such as iron and nickel Third Embodiment Assembly FIG. 119 shows a hose with two different ends. Each end of the Hose Tube FIG. 120 is connected to Magazine Side Adapter FIG. 121 and Weapon Side Adapter FIG. 122. Magazine Side Adapter FIG. 121 attaches to Turtle Shell FIG. 72, and Weapon Side Adapter FIG. 122S attaches to Hose Adapter FIG. 122.

Third Embodiment—Operation

The Hose snaps in place like a water filter on the Magazine Side, and screws into place like a garden hose on the Weapon Side. The Hose is suited for quick disconnection to allow faster changes between left and right side firing while staying attached to the GL300 FIG. 1 in a more permanent way that cannot be undone quickly, due to its two types of adapter.

Third Embodiment Function

FIG. 119 Hose—Connects GL300 FIG. 1 and Turtle FIG. 119.

FIG. 120 Hose Tube: stretches to accommodate passage of rounds from Turtle to GL300.

Figure 121:
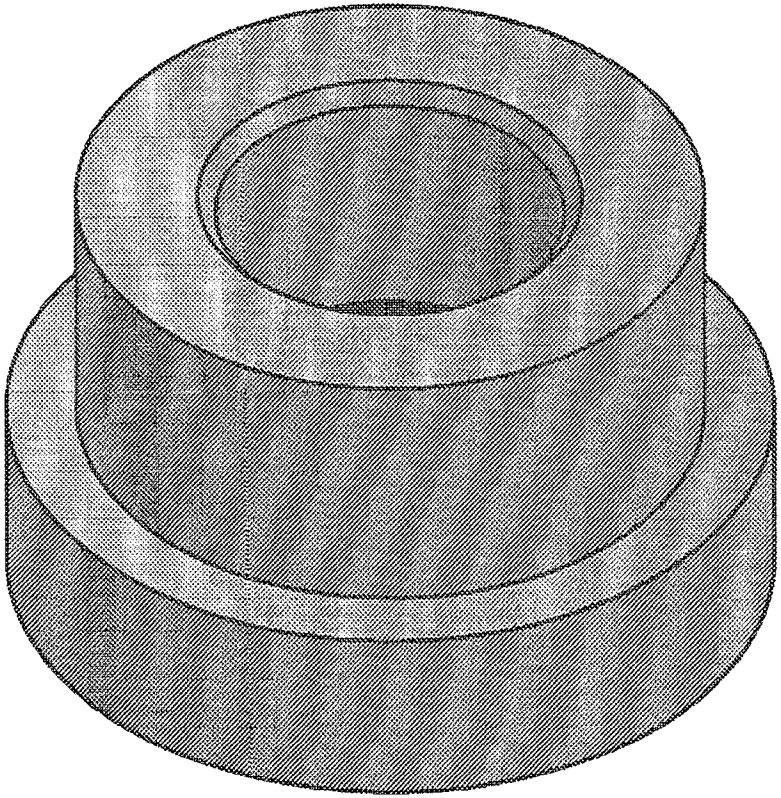

FIG. 121 Magazine Side Adapter: connects hose to Turtle.

Figure 122:
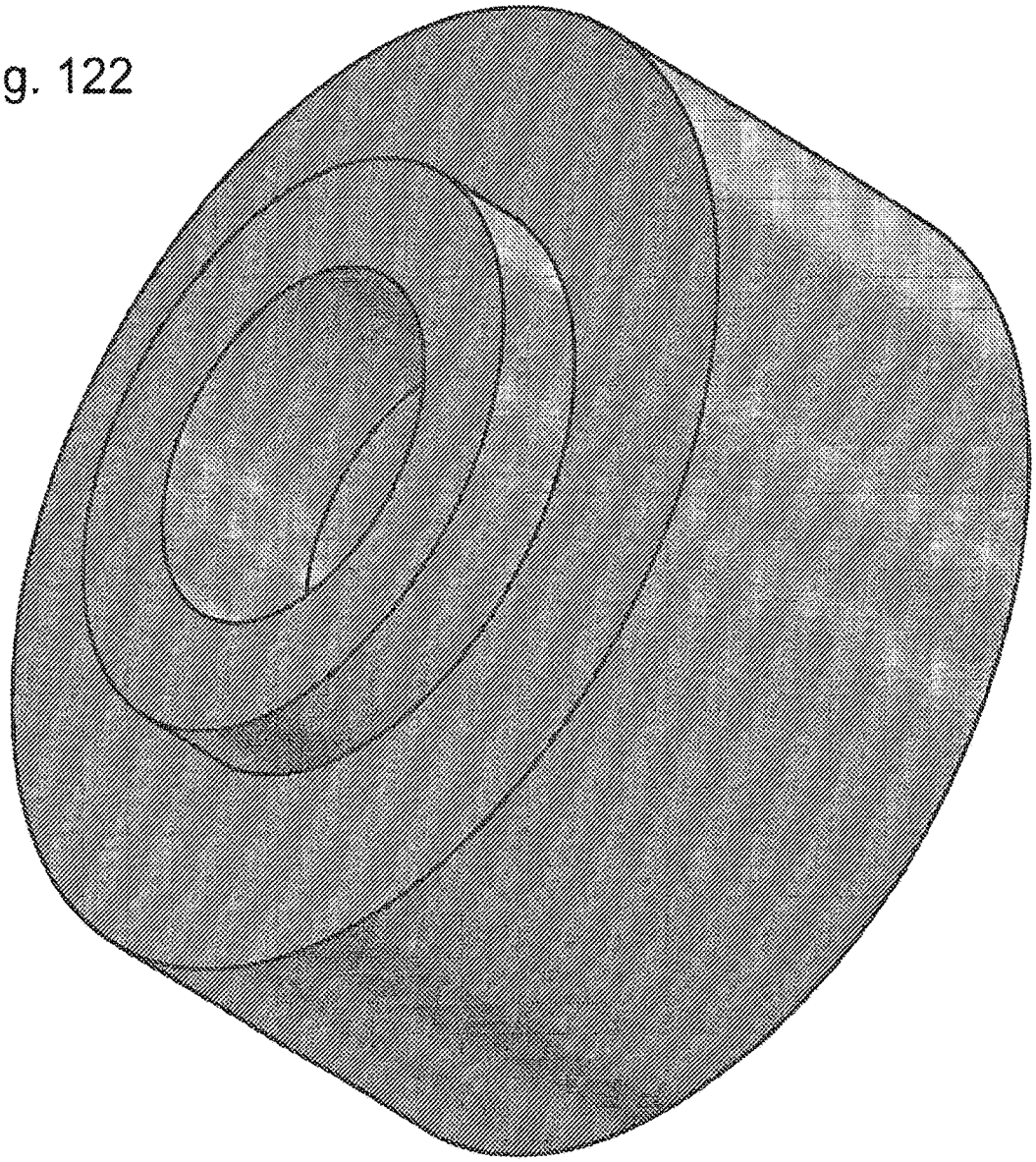

FIG. 122 Weapon Side Adapter: connects Hose FIG. 119 to GL300

Third Embodiment—What the Parts are Made of

FIG. 119 Hose: various materials

FIG. 120 Hose Tube: silicone

FIG. 121 Magazine Side Adapter: a hard plastic such as PVC

FIG. 122 Weapon Side Adapter: a hard plastic such as PVC

CONCLUSION, RAMIFICATIONS, AND SCOPE

The GL300, Turtle, and Hose together are a weapon of war as well as a deterrent of riots. When fully developed, the GL300 and Turtle will make quick work for our nation's military and police not to mention that the invention is sealable and (with the optional addition of a hydraulic ram) can be used to load artillery, tanks, submarines, and aircraft with artillery rounds, tank rounds, torpedoes, and missiles, respectively. A computer program to facilitate the use of the GL300 and Turtle is needed, as well as a drone that can select a target, and communicate to the invention what angle and direction to fire.

Upgrades—Not Shown in Drawings

A computer program to facilitate the use of this invention. Sensors on the barrel and gate to tell the CPU when they are touching.

A sensor to indicate a dud. The gyroscope can do this. A gyroscope to show the degree and direction that the barrel is facing. This would facilitate the operator's firing while lying on his back while totally behind cover. Shots at greater than 45 degrees can be taken as well. This was impossible with other grenade launchers.

A buttstock for better aiming and to reduce the effect of the recoil.

An antenna on the Turtle to communicate by radio or cell phone and Small drones to acquire targets to be neutralized.

An electronic eyepiece for easy targeting. This would interact, with the small drone and make targeting so easy. The drone finds a target, an order is given, and the target shows as a circle. Then the operator simply matches up two circles (one from his gyroscope, one from the drone) and pushes two buttons. No other grenade launcher has this ability.

A pistol grip (attached to the frame where the barrel cover nearly touches the frame) to hold the GL300 better.

A safety switch on the GL300.

Two firing buttons on the left and right sides of barrel sheath 6 that need to be pushed at the same time to fire the GL300, An on/off switch on Turtle and GL300.

A bigger battery for Turtle.

Wires to connect the Turtle and GL300. These should travel the length of the Hose and allow plenty of slack. This can be done with small arches on the top side of the hose (which the wires will pass through) and rubber bands to pull the slack back in (to avoid tangling).

A sliding hatch on the Turtle to make reloading faster. Turtles can stack on one another to allow for 40 plus grenades/ordinance to be carried.

The Turtle can be made in different arrangements and sizes as needed.

A full extrusion of Turtle to allow for larger rounds. The drawings shown are currently configured for 70 mm long grenade rounds.

Straps or a type of harness to allow for the Turtle to be worn on the operator's shoulders like a backpack.

Larger Electric Motors for faster reload of the GL300.

A hydraulic press for larger versions of GL300 and Turtle.

A grip for GL30Q like the M203's grip. M16 rail system Wireless modem

A less complex version of Turtle that holds 20 rounds too, only without any CPU's. This less complex version will have a small extrusion of the outer rim to fit better. It will have latches to connect to the original Turtle that offset the original latches that Turtle has. These latches will go between the original latches.

SEQUENCE LIST

There is no program currently, but a program for the Turtle should be able to:

1. Engage the 7 electric motors and tell each motor the right amount of distance to travel
2. Fire the Gate Solenoid
3. Receive data from the sensors
4. Use the sensor data to know' when the weapon is loaded
5. Turn the valve that corresponds to the side that the Hose is attached to allow the Air
Tank
to load a new round
6. Read a sensor that indicates what side the Hose is attached to (on Turtle)
7. Use the targeting system (gyroscope, UAV, eyepiece)

I claim:

1. A semi-automatic, grenade launching weapon system comprising: a grenade launcher having a barrel assembly with a barrel and wheels; a barrel sheath; a gate housing a solenoid and including a round casing assembly; an electric motor configured to power the barrel assembly back and forth and gate to move up and down; an ejector; an ammunition bearing magazine configured to hold two computers; an ammo belt configured to hold rounds and rotate electronically, said ammo belt further comprising a motor with gears configured to turn said ammo belt; an air tank with two automatic valves configured to send said rounds, wherein said air tank is controlled by a regulator; a removable door containing magnets; a cover; and a hose configured to connect the grenade launcher to the ammunition bearing magazine allowing rounds to pass through.

* * * * *